US006600455B2

(12) United States Patent
Yamamoto et al.

(10) Patent No.: US 6,600,455 B2
(45) Date of Patent: Jul. 29, 2003

(54) M-SHAPED ANTENNA APPARATUS PROVIDED WITH AT LEAST TWO M-SHAPED ANTENNA ELEMENTS

(75) Inventors: Atsushi Yamamoto, Osaka (JP); Hiroshi Iwai, Kobe (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/102,850

(22) Filed: Mar. 22, 2002

(65) Prior Publication Data

US 2002/0190909 A1 Dec. 19, 2002

(30) Foreign Application Priority Data

Mar. 26, 2001 (JP) ..... P2001-088029
Feb. 19, 2002 (JP) ..... P2002-041657

(51) Int. Cl.[7] ..... H01Q 9/30
(52) U.S. Cl. ..... 343/828; 343/826
(58) Field of Search ..... 343/828, 825, 343/826, 827, 830, 829, 867, 742; H01Q 9/30

(56) References Cited

U.S. PATENT DOCUMENTS 4,611,214 A * 9/1986 Campbell et al. ..... 343/790
4,635,066 A * 1/1987 St. Clair et al. ..... 343/705
5,457,470 A * 10/1995 Hai et al. ..... 343/828

FOREIGN PATENT DOCUMENTS

JP 5-136625 6/1993

* cited by examiner

*Primary Examiner*—Hoanganh Le
(74) *Attorney, Agent, or Firm*—Wenderoth, Lind & Ponack, L.L.P.

(57) ABSTRACT

An M-shaped antenna apparatus includes at least two M-shaped antenna elements, a grounding conductor, and a feeding portion. At least two M-shaped antenna elements includes first and second M-shaped antenna elements respectively having first and second resonance frequencies. The first M-shaped antenna element includes a first transmission conductor; a first radiation conductor connected between one end of the first transmission conductor and the grounding conductor; a second radiation conductor connected between a middle portion of the first transmission conductor and the feeding portion; and a third radiation conductor connected between the other end of the first transmission conductor and the grounding conductor. The second M-shaped antenna element includes a second transmission conductor, a fourth radiation conductor, a fifth radiation conductor, and a sixth radiation conductor in a manner similar to that of the first M-shaped antenna element.

22 Claims, 31 Drawing Sheets

FIRST PREFERRED EMBODIMENT

FIRST IMPLEMENTAL EXAMPLE

HORIZONTAL PLANE OF FREQUENCY f2

VERTICAL PLANE OF FREQUENCY f2

HORIZONTAL PLANE OF FREQUENCY f1

VERTICAL PLANE OF FREQUENCY f1

FIRST MODIFIED PREFERRED EMBODIMENT

SECOND MODIFIED PREFERRED EMBODIMENT

THIRD MODIFIED PREFERRED EMBODIMENT

FOURTH MODIFIED PREFERRED EMBODIMENT

SECOND PREFERRED EMBODIMENT

SECOND IMPLEMENTAL EXAMPLE

SECOND PREFERRED EMBODIMENT

FIFTH MODIFIED PREFERRED EMBODIMENT

SIXTH MODIFIED PREFERRED EMBODIMENT

SEVENTH MODIFIED PREFERRED EMBODIMENT

THIRD PREFERRED EMBODIMENT

FOURTH PREFERRED EMBODIMENT

FIRST PREFERRED EMBODIMENT

EIGHTH MODIFIED PREFERRED EMBODIMENT

NINTH MODIFIED PREFERRED EMBODIMENT

TENTH MODIFIED PREFERRED EMBODIMENT

FIFTH PREFERRED EMBODIMENT

ELEVENTH MODIFIED PREFERRED EMBODIMENT

TWELFTH MODIFIED PREFERRED EMBODIMENT

THIRTEENTH MODIFIED PREFERRED EMBODIMENT

HORIZONTAL PLANE OF FREQUENCY f1

VERTICAL PLANE OF FREQUENCY f1

HORIZONTAL PLANE OF FREQUENCY f2

VERTICAL PLANE OF FREQUENCY f2

FREQUENCY CHARACTERISTIC OF IMPEDANCE
OF FREQUENCY SELECTION CIRCUIT 119

MODIFIED IMPLEMENTAL EXAMPLE OF SECOND IMPLEMENTAL EXAMPLE

SIXTH PREFERRED EMBODIMENT

OPERATION OF ONLY M-SHAPED ANTENNA ELEMENT 2

SEVENTH PREFERRED EMBODIMENT

EIGHTH PREFERRED EMBODIMENT

EIGHTH PREFERRED EMBODIMENT

NINTH PREFERRED EMBODIMENT

TENTH PREFERRED EMBODIMENT

ELEVENTH PREFERRED EMBODIMENT

TWELFTH PREFERRED EMBODIMENT

THIRTEENTH PREFERRED EMBODIMENT

FOURTEENTH PREFERRED EMBODIMENT

M-SHAPED ANTENNA APPARATUS PROVIDED WITH AT LEAST TWO M-SHAPED ANTENNA ELEMENTS

BACKGROUND OF THE INVENTION

1. Field of the Invention

The present invention relates to an M-shaped antenna apparatus, and in particular, to an M-shaped antenna apparatus provided with at least two M-shaped antennas.

2. Description of the Related Art

FIG. 24 is a perspective view showing a construction of a prior art antenna apparatus capable of operating at a plurality of frequencies, and FIG. 25 is an enlarged plan view showing a detailed construction of an antenna element 113 and its peripheries of FIG. 24.

Referring to FIG. 24, the prior art antenna apparatus has a rectangular equipment body which is constituted by a grounding conductor 111 provided on a bottom surface located on an X-Y plane, three rectangular top surface conductors 115*a*, 115*b* and 115*c* provided on a top surface and four side surface conductors 114. On the top surface thereof, a rectangular aperture 116 is formed between the top surface conductor 115*a* located in an approximate center portion and the top surface conductor 115*b*, and a rectangular aperture 117 is formed between the top surface conductor 115*a* and the top surface conductor 115*c*. In this case, a circular feeding point 118 is provided in an approximate center portion of the top surface conductor 115*a*. On the other hand, a feeding portion 112 is provided on the grounding conductor 111 just below the feeding point 118, and a center conductor of the feeding portion 112 is connected to the lower end of the antenna element 113. The antenna element 113 is extended in the vertical direction, and its upper end is located at the feeding point 118.

Referring to FIG. 25, at the circular feeding point 118, a gap 120 is formed between the top surface conductor 115*a* and the upper end of the antenna element 113, and a frequency selection circuit 119 is connected between them. In this prior art antenna apparatus, the grounding conductor 111, the top surface conductors 115*a*, 115*b* and 115*c* and the four side surface conductors 114 are electrically connected to each other, forming a rectangular parallelepiped symmetrically with respect to a Z-Y plane and a Z-X plane. On the top surface, two rectangular apertures 116 and 117 of the same shape are arranged symmetrically with respect to the Z-Y plane, the feeding portion 112 is arranged at the origin of the X-Y plane, and the antenna element 113 is constructed of a conductor line perpendicular to the X-Y plane.

The operation of the antenna apparatus shown in FIGS. 24 and 25 will be described next in detail. According to this antenna apparatus, an antenna formed when the gap 120 is short-circuited by replacing the frequency selection circuit 119 with a conductor is referred to as a first antenna element, and the resonance frequency of the first antenna is denoted by f1. Moreover, an antenna formed when the gap 120 is opened by removing the frequency selection circuit 119 is referred to as a second antenna element, and the resonance frequency of the antenna is denoted by f2. Therefore, the first antenna has a structure in which the antenna element 113 and the top surface conductor 115*a* are short-circuited to each other, while the second antenna has a structure in which an electric capacity provided by the gap 120 is connected in series between the antenna element 113 and the top surface conductor 115*a*. With this arrangement, the first and second antennas have different resonance frequencies.

The frequency selection circuit 119 has such a characteristic that it has low impedance at the frequency f1 and high impedance at the frequency f2. If the antenna element 113 and the top surface conductor 115*a* are connected to each other by means of the frequency selection circuit 119, then the frequency selection circuit 119 is put into a low-impedance state, i.e., almost short-circuited at the frequency f1, and the antenna operates as the first antenna. The circuit is put into a high-impedance state, i.e., almost opened at the frequency f2, and the antenna operates as the second antenna. As described above, this antenna apparatus becomes an antenna apparatus that operates at the two frequencies of the first and second antennas with one antenna structure.

FIG. 26 is a perspective view showing a construction of one implemental example (prototype) of the antenna apparatus of FIG. 24. In this implemental example, a relation between the frequency f1 and the frequency f2 is expressed by the following equation (1).

$$f2=2.6\times f1 \quad (1)$$

In this case, the free space wavelength of the frequency f1 is denoted by λ1, and the free space wavelength of the frequency f2 is denoted by λ2. In this case, the grounding conductor 111 has a rectangular shape constructed of two sides that have a length of 0.72×λ1 and a length of 0.56×λ1, and the side surface conductors 114 have a height of 0.06×λ1. The top surface conductor 115*a* located in the approximate center portion has a rectangular shape of which the side parallel to the X-axis has a length of 0.26×λ1 and the side parallel to the Y-axis has a length of 0.56×λ1. The top surface conductors 115*b* and 115*c* located at both ends have a rectangular shape of which the side parallel to the X-axis has a length of 0.08×λ1 and the side parallel to the Y-axis has a length of 0.56×λ1. The two rectangular apertures are the rectangles of which the side parallel to the X-axis has a length of 0.15×λ1 and the side parallel to the Y-axis has a length of 56×λ1. The electric characteristics of this antenna apparatus when the antenna apparatus has a structure symmetrical with respect to the Z-X plane and the Z-Y plane are as follows.

Further, the antenna element 113 is a conductor line that has a diameter of 0.015×λ1 and an element length of 0.06×λ1. The frequency selection circuit 119 is constructed of an LC parallel circuit, whose resonance frequency is the frequency f2. As shown in the Smith chart of FIG. 30, this frequency selection circuit 119 becomes a low impedance at the frequency f1 and becomes a high impedance at the frequency f2. Citing one example in which the frequency f2 is 2.14 GHz, a combination of the inductance L and the electrostatic capacity C of the LC parallel circuit is provided as one example in which L=11 nH and C=0.5 pF.

FIG. 27A is a graph showing a voltage standing wave ratio (VSWR) characteristic with respect to a normalized frequency f/f1 of the first antenna element when the frequency selection circuit 119 is replaced by a short-circuit conductor in the antenna apparatus of the implemental example of FIG. 26. FIG. 27B is a graph showing a voltage standing wave ratio (VSWR) characteristic with respect to a normalized frequency f/f2 of the second antenna element when the frequency selection circuit 119 is put in an open state in the antenna apparatus of the implemental example of FIG. 26. FIG. 27C is a graph showing a voltage standing wave ratio (VSWR) characteristic with respect to the frequency of the antenna apparatus provided with the frequency selection circuit 119 in the antenna apparatus of the implemental example of FIG. 26. In this case, the characteristic impedance of the feeding cable connected to the feeding portion 112 of the antenna apparatus is assumed to be 50 Ω.

FIG. 27A shows an impedance characteristic of the first antenna in which the frequency selection circuit 119 is replaced by a conductor, and it can be understood that resonance occurs at the center frequency f1. FIG. 27B shows an impedance characteristic of the second antenna from which the frequency selection circuit 119 is removed, and it can be understood that resonance occurs at the center frequency f2. In either one of the antennas, the frequency band whose VSWR is equal to or smaller than two occupies 10% or more in a band width ratio, and a satisfactory characteristic of small loss throughout a wide band is exhibited. FIG. 23C shows an impedance characteristic of a prior art experimental antenna provided with the frequency selection circuit 119, and it can be understood that resonance occurs at the two frequencies f1 and f2. As described above, this antenna apparatus can be provided as an antenna apparatus that has a satisfactory impedance characteristic with little reflection loss at the two frequencies f1 and f2.

Even in this experimental antenna apparatus, the height of the antenna element 113 is $0.06\times\lambda 1$ ($=0.16\times\lambda 2$), which is lower than that of the ordinary quarter-wavelength antenna element. This means a capacitive coupling, which occurs between the top surface conductors 115*a*, 115*b* and 115*c* and the grounding conductor 111 of the antenna apparatus and is equivalent to a capacitive load provided at the upper end of the antenna element 113, and this leads to reduction in height of the antenna apparatus.

FIG. 28A is a graph showing a directivity characteristic on the horizontal plane of the frequency f1 in the antenna apparatus of FIG. 26, while FIG. 28B is a graph showing a directivity characteristic on the vertical plane of the frequency f1 in the antenna apparatus of FIG. 26. FIG. 29A is a graph showing a directivity characteristic on the horizontal plane of the frequency f2 in the antenna apparatus of FIG. 26, and FIG. 29B is a graph showing a directivity characteristic on the vertical plane of the frequency f2 in the antenna apparatus of FIG. 26. In this case, one division of the scale of the radiation directivity characteristic corresponds to 10 dB, and the unit is "dBd" based on the gain of a dipole antenna. As a unit for representing the gain of the antenna apparatus, there is "dBi" that is a gain for the radiation electric power from a point wave source, and there is a relation of the following equation (2) between gains "dBd" and "dBi".

$$1\ \text{dBd}=2.15\ \text{dBi} \tag{2}$$

As is apparent from FIGS. 28 and 29, in this antenna apparatus, with regard to the radiation directivity characteristic in the X-Y plane at the frequency f1, the electric wave radiation in the Y-direction is suppressed, and the electric wave radiation in the X-direction is strengthened. However, with regard to the radiation directivity characteristic in the X-Y plane at the frequency f2, intense radiation occurs in six directions although the electric wave radiation in the Y-direction is suppressed. This is ascribed to the fact that the grading lobe occurs since the depth of the antenna apparatus is $1.43\times\lambda 2$ ($=0.56\times\lambda 1$). Moreover, at either frequency, this antenna apparatus scarcely radiates electric waves on the bottom surface side of the antenna apparatus (−Z region in a direction downward of the grounding conductor 111) and radiates very strong electric waves in a +Z region in a direction upward of the top surface of the antenna apparatus. In particular, the directivity characteristic is comparatively strong in a direction obliquely sidewise from the antenna apparatus. In other words, by virtue of the front surface conductor 115*a* and the grounding conductor 111 that peripherally surround the antenna element 113, the radiation power is reduced toward the bottom surface side of the antenna apparatus, i.e., in the −Z direction.

Moreover, in this antenna apparatus, the rectangular apertures 116 and 117 for radiating electric waves are provided on the top surface of the antenna apparatus, and the antenna element 113 that serves as a radiation source is surrounded by the grounding conductor 111 and the top surface conductor 115*a*. Accordingly, there is little influence on the radiation electric waves due to the antenna arrangement environment in the direction of the side surface and the direction of the bottom surface of the antenna apparatus. In other words, when installing this antenna apparatus in an indoor ceiling or the like, it is possible to embed the antenna apparatus in the indoor ceiling and align the antenna apparatus with the indoor ceiling so that the top surface of the antenna apparatus opposes the radiation space, for installation of the M-shaped antenna apparatus. With this arrangement, there is provided an antenna apparatus that has no projecting object on the ceiling or the like and is aesthetically desirable with less conspicuousness.

As described above, according to the construction of the prior art antenna apparatus that has a thin type structure, there is provided an antenna that is smaller than the object projecting from the ceiling and aesthetically desirable with less conspicuousness when it is impossible to embed the antenna in the indoor ceiling.

In connection with the prior art example and the experimental example described herein, there has been described the antenna apparatus that has the structure symmetrical with respect to the Z-Y plane and the Z-X plane. In this case, there is the effect that the directivity characteristic of the electric waves radiated from the antenna apparatus become symmetrical with respect to the Z-Y plane and the Z-X plane. As described above, according to the prior art antenna apparatus, there can be provided a compact antenna that resonates at two or more frequencies with a simple structure.

However, the prior art antenna apparatus shown in FIG. 24 has had the problems as follows. As described above, the above structure is able to operate at two or more frequencies. However, since all the resonance frequencies are determined by the shape of the antenna apparatus, there has been required an advanced designing technology for the designing of the resonance frequencies. In particular, when a plurality of frequency bandwidths are used by a plurality of applications, there has been required a further advanced designing technology for designing of the antenna. Accordingly, in this case, it has been inevitable to admit that the prior art structure, which has been unable to freely easily select a plurality of resonance frequencies, has been improper.

SUMMARY OF THE INVENTION

Accordingly, an essential object of the present invention is to solve the aforementioned problems and provide a compact light-weight antenna apparatus, having a plurality of resonance frequencies with a design simpler than that of the prior art examples and is capable of obtaining a bilateral directivity characteristic.

In order to achieve the aforementioned objective, according to one aspect of the present invention, there is provided an M-shaped antenna apparatus including at least two M-shaped antenna elements, a grounding conductor, and a feeding portion, the at least two M-shaped antenna elements including first and second M-shaped antenna elements respectively having first and second resonance frequencies different from each other. The first M-shaped antenna element includes: a first transmission conductor; a first radiation conductor connected between one end of the first transmission conductor and the grounding conductor; a second radiation conductor connected between a middle portion of the first transmission conductor and the feeding portion; and a third radiation conductor connected between the other end of the first transmission conductor and the grounding conductor. The second M-shaped antenna element includes: a second transmission conductor; a fourth radiation conductor connected between one end of the second transmission conductor and the grounding conductor; a fifth radiation conductor connected between a middle portion of the second transmission conductor and the feeding portion; and a sixth radiation conductor connected between the other end of the second transmission conductor and the grounding conductor.

In the above-mentioned M-shaped antenna apparatus, the fifth radiation conductor preferably shares at least a part of the second radiation conductor.

In the above-mentioned M-shaped antenna apparatus, the fifth radiation conductor preferably shares a part of the first transmission conductor.

The above-mentioned M-shaped antenna apparatus preferably further includes at least one matching conductor, which has one end grounded and adjusts an input impedance of the M-shaped antenna apparatus.

In the above-mentioned M-shaped antenna apparatus, the other end of at least one matching conductor out of the matching conductors is preferably electrically connected to one of the radiation conductor and the transmission conductor.

The above-mentioned M-shaped antenna apparatus preferably further includes at least one directivity characteristic control conductor, which has one end grounded and changes a directivity characteristic of the M-shaped antenna apparatus.

In the above-mentioned M-shaped antenna apparatus, at least one of the first and second transmission conductors preferably further includes an additional conductor section for changing the width thereof.

In the above-mentioned M-shaped antenna apparatus, a space including at least a part of the M-shaped antenna element is preferably filled with a dielectric body so as to oppose the grounding conductor.

In the above-mentioned M-shaped antenna apparatus, the grounding conductor and at least one of the transmission conductors are preferably each formed of a conductor pattern on a dielectric substrate, and at least one of the radiation conductors is preferably formed of a through hole conductor formed in the dielectric substrate.

In the above-mentioned M-shaped antenna apparatus, the at least two M-shaped antenna elements are preferably formed on an identical plane.

In the above-mentioned M-shaped antenna apparatus, the at least two M-shaped antenna elements are preferably formed on planes different from each other.

According to the present invention, there can be easily provided an antenna apparatus, which has two or more resonance frequencies with a simple structure and is capable of obtaining a bilateral directivity characteristic.

According to another aspect of the present invention, there is provided an M-shaped antenna apparatus including at least three M-shaped antenna elements, a grounding conductor, and a feeding portion. At least three M-shaped antenna elements include first, second and third M-shaped antenna elements having first, second and third resonance frequencies, respectively. The first M-shaped antenna element includes: a first transmission conductor; a first radiation conductor connected between one end of the first transmission conductor and the grounding conductor; a second radiation conductor connected between a middle portion of the first transmission conductor and the feeding portion; and a third radiation conductor connected between the other end of the first transmission conductor and the grounding conductor. The second M-shaped antenna element includes: a second transmission conductor; a fourth radiation conductor connected between one end of the second transmission conductor and the grounding conductor; a fifth radiation conductor connected between a middle portion of the second transmission conductor and the feeding portion; and a sixth radiation conductor connected between the other end of the second transmission conductor and the grounding conductor. The third M-shaped antenna element includes: a third transmission conductor; a seventh radiation conductor connected between one end of the third transmission conductor and the grounding conductor; an eighth radiation conductor connected between a middle portion of the third transmission conductor and the feeding portion; and a ninth radiation conductor connected between the other end of the third transmission conductor and the grounding conductor. At least three M-shaped antenna elements are formed on planes different from each other, and at least two of the first, second and third resonance frequencies are different from each other.

In the above-mentioned M-shaped antenna apparatus, at least three M-shaped antenna elements are preferably formed so as to be parallel to each other, and a length of each of the first, second and third radiation conductors, a length of each of the fourth and sixth radiation conductors and a length of each of the seventh and ninth radiation conductors are preferably set so as to be equal to each other. The fifth radiation conductor preferably shares at least a part of the second radiation conductor, and the eighth radiation conductor shares at least a part of the second radiation conductor. The antenna apparatus preferably further comprises: a fourth transmission conductor for connecting a middle portion of the first transmission conductor with a middle portion of the second transmission conductor; and a fifth transmission conductor for connecting a middle portion of the first transmission conductor with a middle portion of the third transmission conductor.

In the above-mentioned M-shaped antenna apparatus, a length of the fourth transmission conductor and a length of the fifth transmission conductor are preferably set so as to be equal to each other, and lengths of the first, second and third transmission conductors are preferably set so as to be equal to each other.

In the above-mentioned M-shaped antenna apparatus, a length of the fourth transmission conductor and a length of the fifth transmission conductor are preferably set so as to be equal to each other, and at least two of lengths of the first, second and third transmission conductors are preferably set so as to be different from each other.

In the above-mentioned M-shaped antenna apparatus, a length of the fourth transmission conductor and a length of the fifth transmission conductor are preferably set so as to be different from each other, and lengths of the first, second and third transmission conductors are preferably set so as to be equal to each other.

In the above-mentioned M-shaped antenna apparatus, the at least three M-shaped antenna elements are preferably formed so as to be parallel to each other, and a length of each of the fourth and sixth radiation conductors and a length of each of the seventh and ninth radiation conductors are preferably set so as to be equal to each other. The fifth radiation conductor preferably shares at least a part of the second radiation conductor, the eighth radiation conductor shares at least a part of the second radiation conductor. The antenna apparatus preferably further includes: a fourth transmission conductor for connecting a middle portion of the second radiation conductor with a middle portion of the second transmission conductor; and a fifth transmission conductor for connecting a middle portion of the second radiation conductor with a middle portion of the third transmission conductor.

In the above-mentioned M-shaped antenna apparatus, a length of the fourth transmission conductor and a length of the fifth transmission conductor are preferably set so as to be equal to each other, and at least two of lengths of the first, second and third transmission conductors are preferably set so as to be different from each other.

In the above-mentioned M-shaped antenna apparatus, at least three M-shaped antenna elements are preferably formed so as to be parallel to each other, and a length of each of the fourth and sixth radiation conductors and a length of each of the seventh and ninth radiation conductors are set so as to be equal to each other. The fifth radiation conductor preferably shares the second radiation conductor and a tenth radiation conductor whose one end is connected to the second radiation conductor, and the eighth radiation conductor preferably shares the second radiation conductor and the tenth radiation conductor. The antenna apparatus preferably further includes: a fourth transmission conductor for connecting the other end of the tenth radiation conductor with a middle portion of the second transmission conductor; and a fifth transmission conductor for connecting the other end of the tenth radiation conductor with a middle portion of the third transmission conductor.

In the above-mentioned M-shaped antenna apparatus, a length of the fourth transmission conductor and a length of the fifth transmission conductor are preferably set so as to be equal to each other, and at least two of lengths of the first, second and third transmission conductors are preferably set so as to be different from each other.

In the above-mentioned M-shaped antenna apparatus, the grounding conductor preferably has a circular shape.

According to the present invention, there can be easily provided an antenna apparatus, which has three or more resonance frequencies with a simple structure and is able to obtain a symmetrical or asymmetrical bilateral directivity characteristic.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 3A is a view showing an electric field of the M-shaped antenna element 1 and FIG. 3B is a view showing a magnetic current of the M-shaped antenna element 1;

DETAILED DESCRIPTION OF THE PREFERRED EMBODIMENTS

Figure 1:
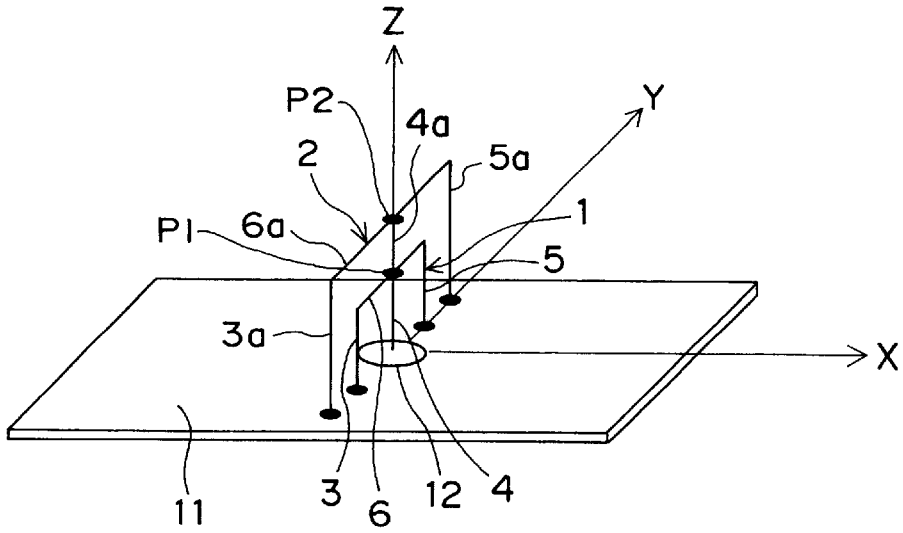
FIG. 1 is a perspective view showing a construction of an M-shaped antenna apparatus according to a first preferred embodiment of the present invention.

Preferred embodiments of the present invention will be described below with reference to the drawings. It is to be noted that same components are denoted by same reference numerals in the figures described below.

First Preferred Embodiment

Figure 2:
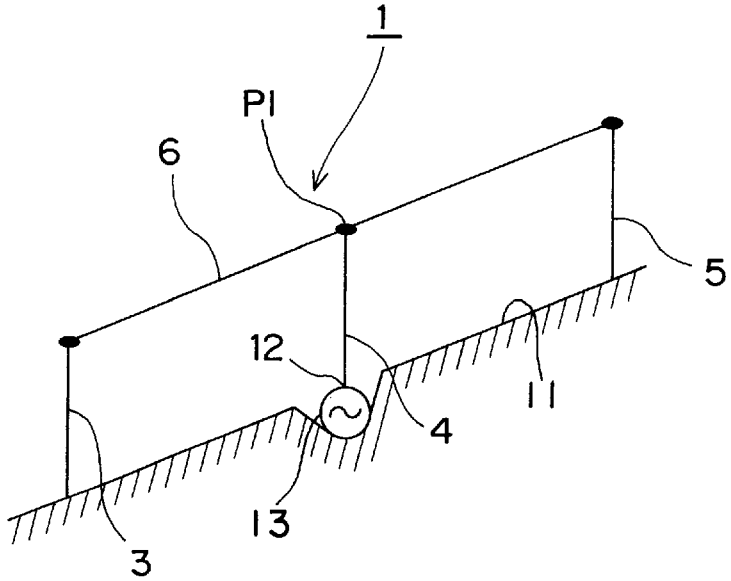
FIG. 2 is a perspective view showing a basic structure of an M-shaped antenna element 1 of FIG. 1.

FIG. 1 is a perspective view showing a construction of an M-shaped antenna apparatus according to a first preferred embodiment of the present invention, and FIG. 2 is a perspective view showing a basic structure of the M-shaped antenna element 1 of FIG. 1.

Referring to FIG. 1, the M-shaped antenna apparatus of the first preferred embodiment is characterized in that two M-shaped antenna elements 1 and 2 are provided on a grounding conductor 11 that has a feeding portion 12 in an approximate center portion and, in particular, the M-shaped antenna element 2 is superposed on top and both side surfaces of the M-shaped antenna element 1 sharing a radiation conductor 4.

According to the basic structure of the M-shaped antenna element 1, as shown in FIG. 2, three radiation conductors 3, 4 and 5, which have the same length are provided so that the radiation conductors 3, 4 and are separated apart at specified regular intervals so as to be parallel to each other on the grounding conductor 11 constructed of a metal plate of a rectangular shape, and the upper ends of those radiation conductors are connected to a transmission conductor 6. In this case, one end of the transmission conductor 6 is connected to the upper end of the radiation conductor 3, the other end of the transmission conductor 6 is connected to the upper end of the radiation conductor 5, and the approximate center portion of the transmission conductor 6 is connected to the upper end of the radiation conductor 4 at a connection point P1. On the other hand, the lower ends of the radiation conductors 3 and 5 are connected to the grounding conductor 11, and the lower end of the radiation conductor 4 located at the center of the three radiation conductors 3, 4 and 5 is connected to a feeding power source 13 of, for example, radio equipment via a feeding point 12 and a feeding cable (not shown).

Referring to FIG. 1, a circular hole is formed in the approximate center portion of the grounding conductor 11, forming the feeding portion 12 connected to the feeding cable (not shown). A grounding conductor of the feeding cable has a top surface connected to the grounding conductor 11 located on the X-Y plane and a center conductor whose lower end is connected to the radiation conductor 4. The M-shaped antenna element 1 is provided on the grounding conductor 11 that has the feeding point 12. In this case, the radiation conductor 3 has a lower end grounded and an upper end connected to one end of the transmission conductor 6. The radiation conductor 5 has a lower end grounded and an upper end connected to the other end of the transmission conductor 6. Further, the upper end of the radiation conductor 4 is connected to the approximate center portion of the transmission conductor 6 at the connection point P1. The radiation conductor 4 is extended on the Z-axis, and the radiation conductors 3 and 5 are formed so as to be parallel to the Z-axis.

The M-shaped antenna element 2 has a structure similar to that of the M-shaped antenna element 1. The radiation conductor 3*a* of the M-shaped antenna element 2 has a lower end grounded and an upper end connected to one end of a transmission conductor 6*a*. The radiation conductor 5*a* has a lower end grounded and an upper end connected to the other end of the transmission conductor 6*a*. Further, the connection point P1 is connected to the approximate center portion of the transmission conductor 6*a* at a connection point P2 via a radiation conductor 4*a*. As the radiation conductor of the M-shaped antenna element 2, the radiation conductor 4 and the radiation conductor 4*a* are used, and the radiation conductor 4 is shared by the two M-shaped antenna elements 1 and 2. The radiation conductors 3*a* and 5*a* have a length set so as to be longer than the length of each of the radiation conductors 3, 4 and 5 only by the length of the radiation conductor 4*a*. The radiation conductor 4*a* is extended on the Z-axis, and the radiation conductors 3*a* and 5*a* are formed so as to be parallel to the Z-axis.

According to the aforementioned first preferred embodiment, there is shown the case where the grounding conductor 11 has a rectangular shape symmetrical with respect to the Z-Y plane and the Z-X plane, the feeding portion 12 is arranged at the origin of the X-Y plane, the M-shaped antenna element 1 and the M-shaped antenna element 2 are each constructed of a conductor line and arranged on the Z-Y plane, and the radiation conductor 4 of the M-shaped antenna element 1 and the radiation conductor 4*a* of the M-shaped antenna element 2 are arranged on the Z-axis.

Figure 3A:
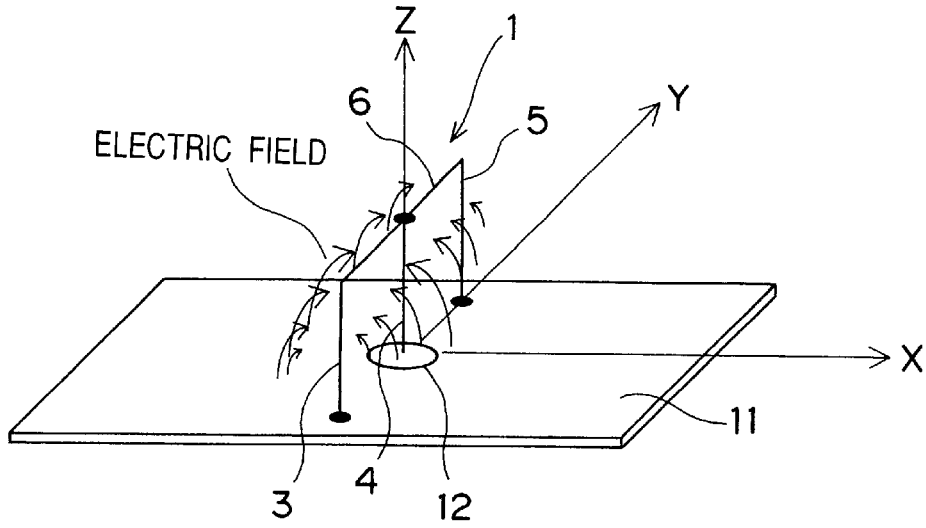
FIGS. 3A and 3B are perspective views showing an operation of the M-shaped antenna element 1 of FIG. 2, where
Figure 3B:
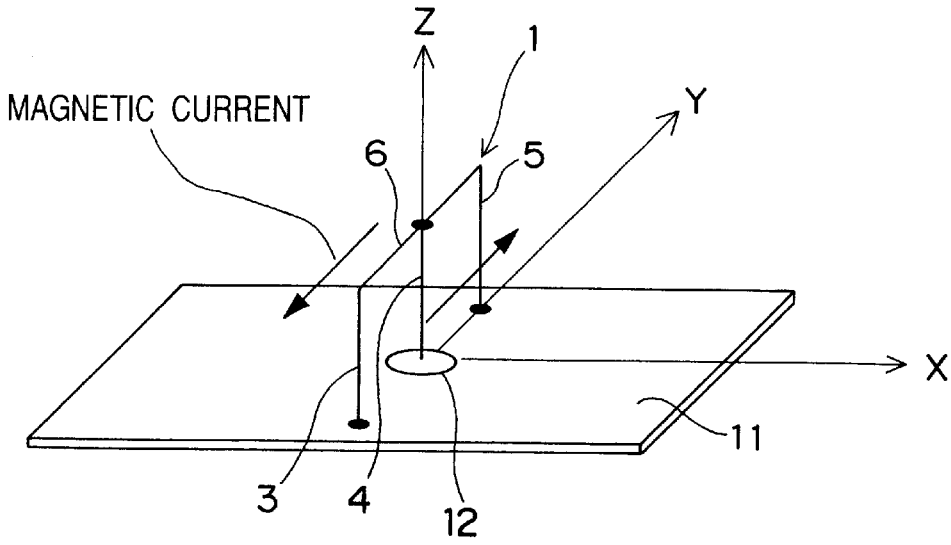

FIGS. 3A and 3B are perspective views showing an operation of the M-shaped antenna element 1 of FIG. 2, where FIG. 3A is a view showing an electric field of the M-shaped antenna element 1 and FIG. 3B is a view showing a magnetic current in the M-shaped antenna element 1. The principle of operation of the electric wave radiation of the one M-shaped antenna element 1 of FIG. 1 will be described in detail with reference to FIG. 3. In other words, in FIG. 3, electric wave excitation is achieved by the radiation conductors 3, 4 and 5 in this M-shaped antenna element 1, and a bilateral directivity characteristic is obtained by the M-shaped antenna element 1. The principle of operation for obtaining the bilateral directivity characteristic will be described below with reference to FIG. 3.

The direction of the electric field generated between the transmission conductor 6 and the grounding conductor 11 of the M-shaped antenna element 1 becomes as shown in FIG. 3A. Explaining a magnetic current in substitution for this electric field, as shown in FIG. 3B, two linear magnetic current sources, which are parallel to the Y-axis and extended in opposite directions and have equal amplitudes, can substitute for the electric field. In other words, the electric wave radiation can be regarded as a radiation with an array of these two magnetic current sources. In general, the radiation electric wave in an antenna array is obtained by multiplying an array factor determined by the phase difference of a current fed to the radiation source and the element interval by the radiation pattern of the single body of the radiation source. If the radiation pattern of the single body of this radiation source is replaced by a radiation pattern provided by the single body of the aforementioned linear magnetic current source, then the radiation pattern of this M-shaped antenna element 1 is obtained in an approximating manner.

In concrete, electric waves radiated from the two magnetic current sources are arranged symmetrically with respect to the Z-Y plane, and therefore, the electric waves cancel each other since they have equal amplitude and reversed phases on the Z-Y plane. In other words, no electric wave is radiated on the Z-Y plane. Moreover, there is a direction in which the electric waves radiated from the two magnetic current sources are in phase on the Z-X plane, and the electric waves are intensified in the direction. When a distance between the magnetic current sources is half-wavelength in a free space according to one example, the radiation electric waves are intensified in the +X-direction and the −X-direction since the waves are in phase in the X-axis direction. In other words, this structure is able to produce the effect of the antenna array with one M-shaped antenna element 1 and obtain a bilateral directivity characteristic.

Figure 4:
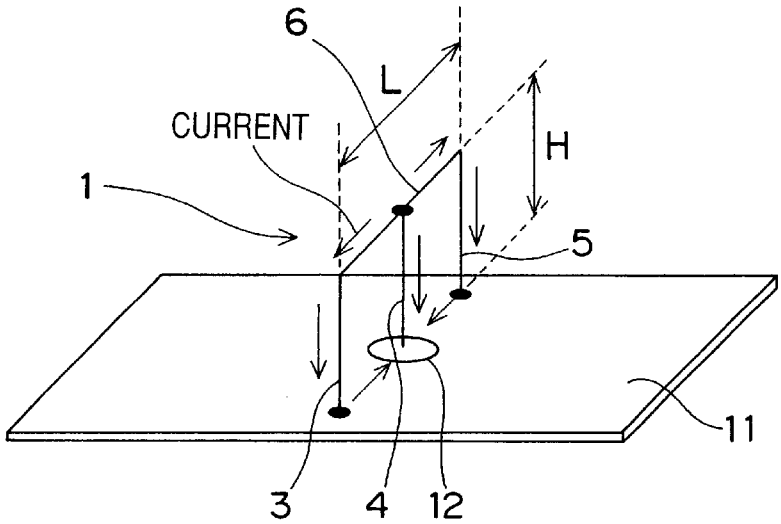
FIG. 4 is a perspective view showing an operation of the M-shaped antenna element 1 of FIG. 2, illustrating a current in the M-shaped antenna element 1.
Figure 5:
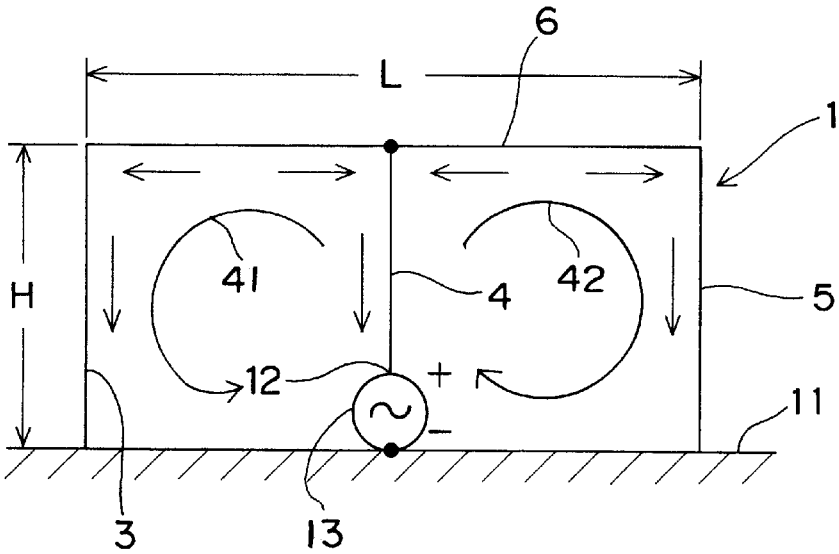
FIG. 5 is a schematic view showing an operating current of the M-shaped antenna element 1 of FIG. 2.

FIG. 4 is a perspective view showing an operation of the M-shaped antenna element 1 of FIG. 2, illustrating a current in the M-shaped antenna element 1. FIG. 5 is a schematic view showing an operating current of the M-shaped antenna element 1 of FIG. 2. The fact that the impedance characteristic becomes dual resonant will be described with reference to these figures.

In the M-shaped antenna element 1 shown in FIG. 4, the current that flows through the antenna apparatus of the present preferred embodiment is shown. According to FIG. 4, the resonance mode of the M-shaped antenna element 1 can be expressed by two loop circuits 41 and 42 as shown in FIG. 5. In this case, the resonance condition is expressed by the following equation (3).

$$L/2+2H=n\cdot(\lambda/2) \quad (3)$$

In this equation, λ represents a free space wavelength, and n represents a natural number. In order to obtain a bilateral directivity characteristic, n=1. The resonance frequency can be determined so as to satisfy this condition. Accordingly, by uniting the two M-shaped antenna elements of different sizes, or the M-shaped antenna element 1 whose resonance frequency is f10 and the M-shaped antenna element 2 whose resonance frequency is f20 with each other as shown in FIG. 1, the M-shaped antenna apparatus of the present preferred embodiment becomes an antenna apparatus that operates at two resonance frequencies. As described above, the M-shaped antenna apparatus of the present preferred embodiment, which permits separate designing of the resonance frequencies of the two M-shaped antenna elements 1 and 2, becomes an excellent antenna apparatus of a high degree of freedom of designing.

Figure 6:
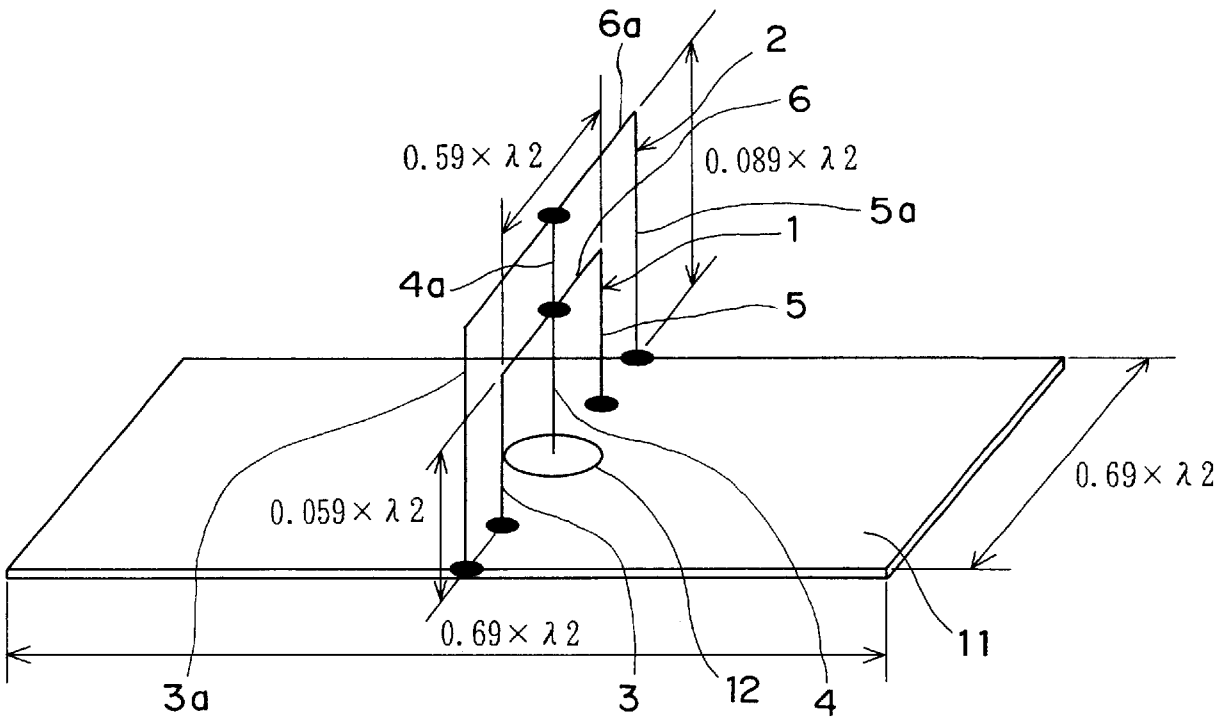
FIG. 6 is a perspective view showing a construction of an M-shaped antenna apparatus according to a first implemental example of the first preferred embodiment.

FIG. 6 is a perspective view showing a construction of an M-shaped antenna apparatus according to the first implemental example (prototype) of the first preferred embodiment. In this case, the use frequency of the M-shaped antenna element 1 is denoted by f1, and the use frequency of the M-shaped antenna element 2 is denoted by f2. In this case, the use frequency means the use frequency at which a radio signal can be transmitted when the two M-shaped antenna elements 1 and 2 are united or combined with each other. A free space wavelength corresponding to the frequency f1 is assumed to be λ1, and a free space wavelength corresponding to the frequency f2 is assumed to be λ2. In this implemental example, the grounding conductor has a square shape of 0.69×λ2, and the conductors 3 to 6 of the M-shaped antenna element 1 are each constructed of a conductor line of a diameter of 0.008×λ2. The radiation conductors 3 to 5 have a height of 0.059×λ2, and the transmission conductor 6 parallel to the Y-axis has a length of 0.59×λ2. The conductors 3*a* to 6*a* of the M-shaped antenna element 2 are each constructed of a conductor line of a diameter of 0.008×λ2, and the radiation conductors 3*a* to 5*a* have a height of 0.089×λ2. The transmission conductor 6*a* parallel to the Y-axis has a length of 0.69×λ2. The feeding portion 12 is located in the center portion of the grounding conductor 11. Further, a relation between the two resonance frequencies f1 and f2 is expressed by the following equation (4).

$$f1=1.4\times f2 \quad (4)$$

Figure 7A:
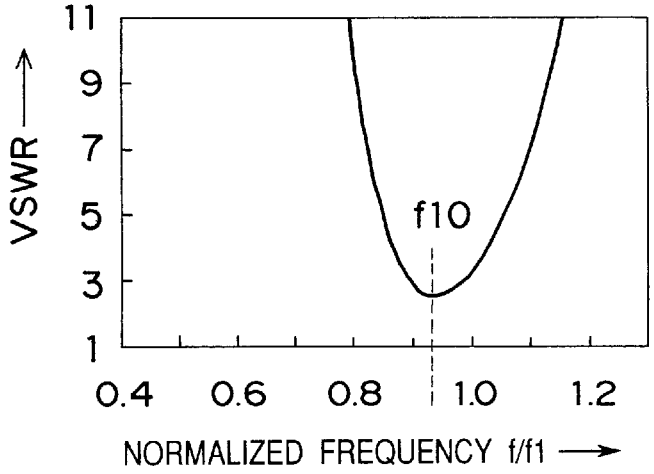
FIG. 7A is a graph showing a voltage standing wave ratio (VSWR) characteristic with respect to a normalized frequency f/f1 of only the M-shaped antenna element 1 of the M-shaped antenna apparatus of FIG. 6.
Figure 7B:
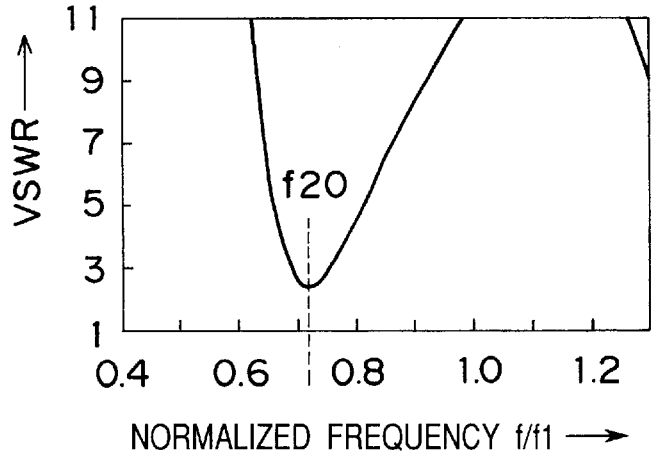
FIG. 7B is a graph showing a voltage standing wave ratio (VSWR) characteristic with respect to the normalized frequency f/f1 of only the M-shaped antenna element 2 of the M-shaped antenna apparatus.
Figure 7C:
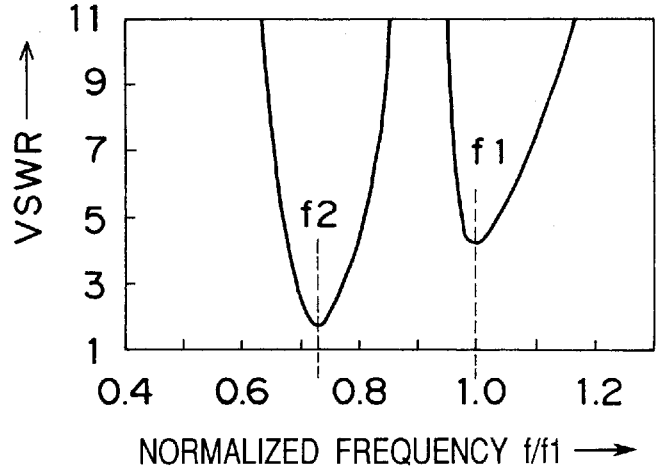
FIG. 7C is a graph showing a voltage standing wave ratio (VSWR) characteristic with respect to the normalized frequency f/f1 of the M-shaped antenna apparatus of FIG. 6 provided with the aforementioned two antenna elements 1 and 2.

FIG. 7A is a graph showing a voltage standing wave ratio (VSWR) characteristic with respect to the normalized frequency f/f1 of only the M-shaped antenna element 1 of the M-shaped antenna apparatus of FIG. 6. FIG. 7B is a graph showing a voltage standing wave ratio (VSWR) characteristic with respect to the normalized frequency f/f1 of only the M-shaped antenna element 2 of the M-shaped antenna apparatus. FIG. 7C is a graph showing a voltage standing wave ratio (VSWR) characteristic with respect to the normalized frequency f/f1 of the M-shaped antenna apparatus of FIG. 6 provided with the aforementioned two antenna elements 1 and 2. In this case, the horizontal axis represents the frequency f/f1 normalized by f1 in all the figures of FIGS. 7A, 7B and 7C.

As is apparent from FIG. 7C, it can be understood that the M-shaped antenna apparatus of this implemental example resonates at the two use frequencies of the frequencies f1 and f2. As is apparent from FIGS. 7A and 7B, the frequencies f1 and f2 have values very close to the resonance frequency f10 of the M-shaped antenna apparatus of only the M-shaped antenna element 1 and the resonance frequency f20 of the M-shaped antenna apparatus of only the M-shaped antenna element 2, respectively. As described above, the M-shaped antenna apparatus of the present implemental example is provided as an antenna apparatus that resonates at the desired two frequencies f1 and f2 by the simple design of the single units of the M-shaped antenna elements 1 and 2.

Figure 8A:
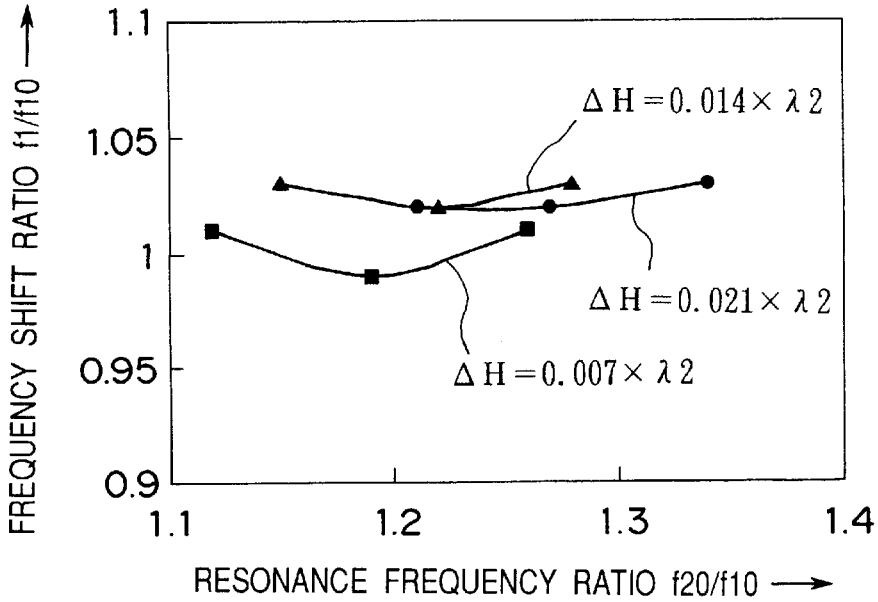
FIG. 8A is a graph showing a frequency shift ratio f1/f10 with respect to a resonance frequency ratio f20/f10 using a height difference ΔH between two antenna elements 1 and 2 as a parameter in the M-shaped antenna apparatus of FIG. 6.
Figure 8B:
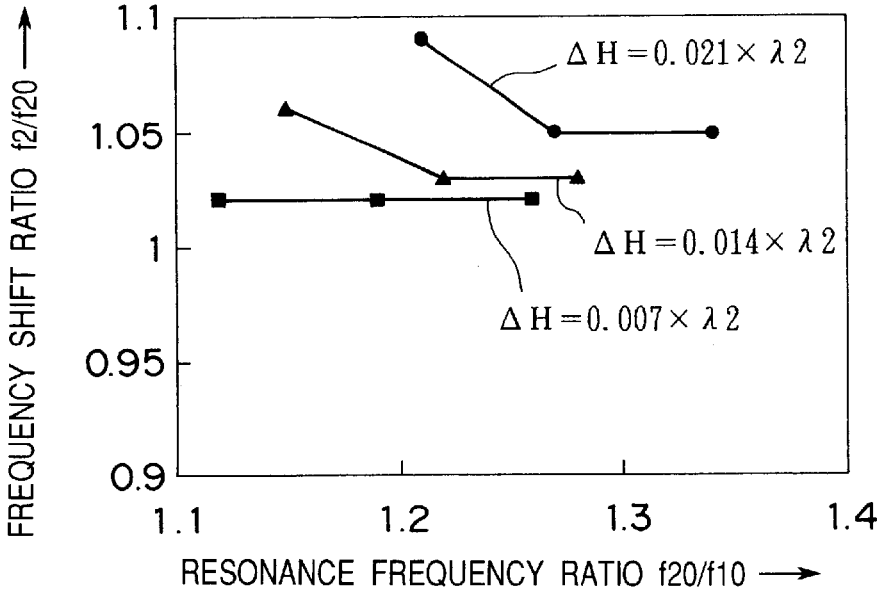
FIG. 8B is a graph showing a frequency shift ratio f2/f20 with respect to the resonance frequency ratio f20/f10 using the height difference ΔH between the two antenna elements 1 and 2 as a parameter of the M-shaped antenna apparatus.

Next, the resonance frequency will be examined in detail. The M-shaped antenna elements 1 and 2 of the M-shaped antenna apparatus of the present implemental example have a slight difference between the use frequency f1 and the resonance frequency f10 and a difference between the use frequency f2 and the resonance frequency f20 due to the existence of the other M-shaped antenna elements 2 and 1 in comparison with the case of the single units of the M-shaped antenna elements 1 and 2. If these differences are large, there is needed some correction in designing the M-shaped antenna apparatus of the present implemental example from the single units of the M-shaped antenna elements 1 and 2. In other words, the smaller the differences are, the easier the designing of the M-shaped antenna apparatus becomes. Accordingly, the relations of the single units of the M-shaped antenna elements 1 and 2 to the resonance frequencies f10 and f20 of the M-shaped antenna apparatus of the present implemental example are shown. In other words, the relation between the resonance frequency f10 and the use frequency f1 and the relation between the resonance frequency f20 and the use frequency f2 are examined, and the results are shown in FIGS. 8A and 8B. Hereinafter, a ratio of frequency shift of the use frequency f1 with respect to the resonance frequency f10 is expressed by a frequency shift ratio f1/f10, and a ratio of frequency shift of the use frequency f2 with respect to the resonance frequency f20 is expressed by a frequency shift ratio f2/f20.

FIG. 8A is a graph showing a frequency shift ratio f1/f10 with respect to a resonance frequency ratio f20/f10 using a height difference ΔH between the two antenna elements 1 and 2 as a parameter in the M-shaped antenna apparatus of FIG. 6. FIG. 8B is a graph showing a frequency shift ratio f2/f20 with respect to the resonance frequency ratio f20/f10 using the height difference ΔH between the two antenna elements 1 and 2 as a parameter in the M-shaped antenna apparatus. In this case, the height difference ΔH between the antenna elements 1 and 2 is a height difference between the radiation conductors, and in concrete, a difference between the height of the radiation conductors 3 to 5 and the height of the radiation conductors 3*a* to 5*a*.

As is apparent from FIG. 8A, it can be understood that the frequency shift ratio f1/f10 is close to one in any case and the difference between the frequencies f1 and f10 is very small. In concrete, the difference is equal to or smaller than 3%. According to the above description, it can be understood that the first resonance frequency f1 of the M-shaped antenna apparatus of the present implemental example can be accurately obtained from the resonance frequency f10 of the M-shaped antenna element 1, allowing the M-shaped antenna apparatus of the present implemental example to be easily designed. In particular, if the height difference ΔH between the radiation conductors is set so as to be equal to or lower than 0.007×λ2, then the frequency shift ratio f1/f10 is close to one and the resonance frequency difference is equal to or smaller than ±1% without regard to the value of the resonance frequency ratio f20/f10.

Next, the resonance frequency f2 of the M-shaped antenna element 2 is examined. As is apparent from FIG. 8B, the variation of the frequency shift ratio f2/f20 is larger than that of the frequency shift ratio f1/f10, and the variation is equal to or smaller than 9%. Also, in this case, it can be understood that the variation in the resonance frequency is small. In other words, the use frequency f2 of the M-shaped antenna element 2 of the M-shaped antenna apparatus of the present implemental example can be accurately obtained from the resonance frequency f20 of the M-shaped antenna element 2, and this allows the M-shaped antenna apparatus of the present implemental example to be easily designed. Moreover, it can be understood that the frequency shift ratio f2/f20 becomes closer to one as the height difference ΔH between the radiation conductors is smaller. In particular, if the height difference ΔH between the radiation conductors is set so as to be equal to or lower than 0.007×λ2, then the frequency shift ratio f2/f20 is close to one and the resonance frequency difference is equal to or smaller than 3% without regard to the value of the resonance frequency ratio f20/f10.

As described above, it can be understood that the M-shaped antenna apparatus of the present implemental example can easily achieve a multi-frequency operation by individually designing the M-shaped antenna elements 1 and 2 that have the desired resonance frequencies and uniting the elements into an the integrated type as shown in FIG. 1.

Figure 9A:
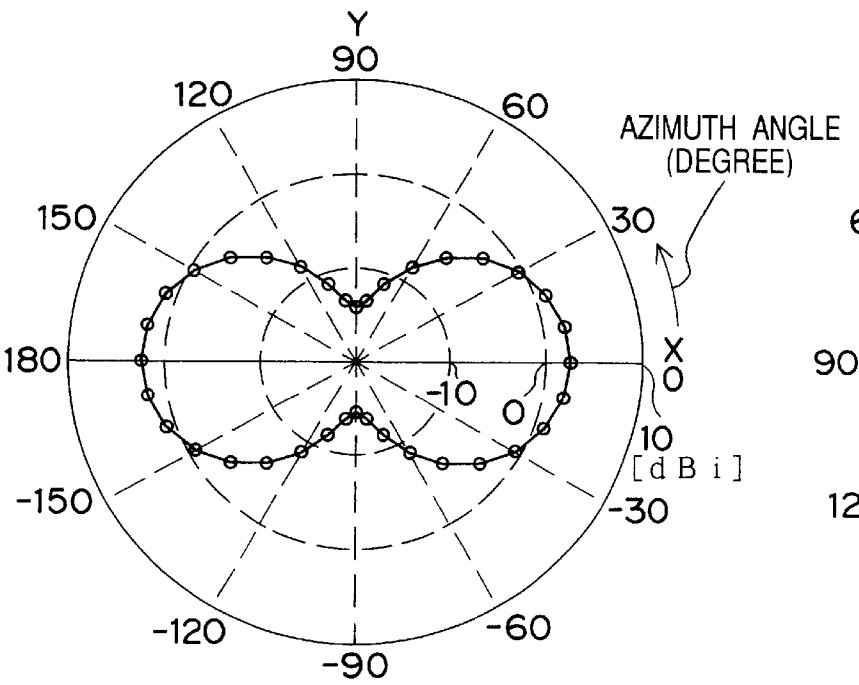
FIG. 9A is a graph showing a directivity characteristic on horizontal plane of the frequency f2 in the M-shaped antenna apparatus of FIG. 6.
Figure 9B:
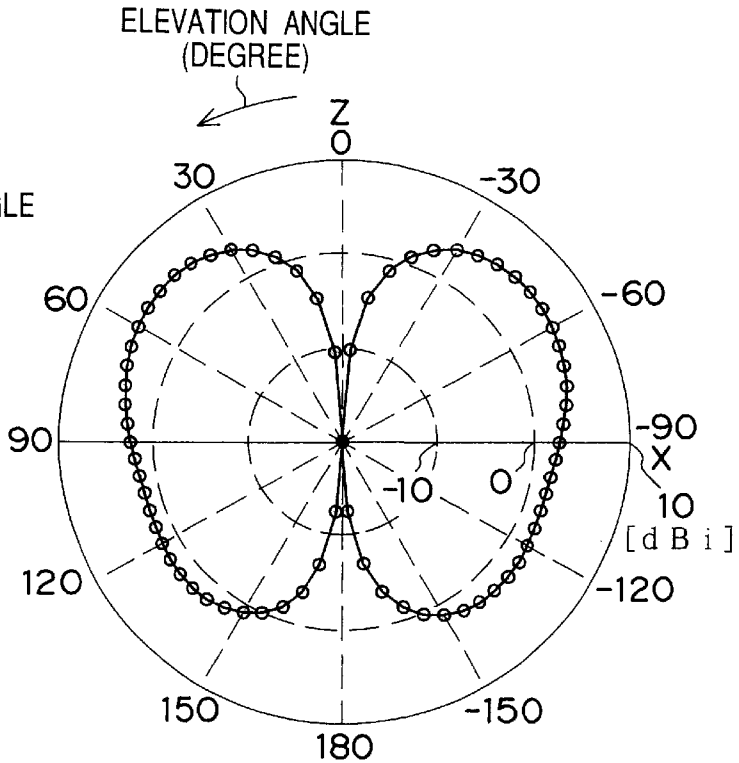
FIG. 9B is a graph showing a directivity characteristic on vertical plane of the frequency f2 in the M-shaped antenna apparatus.
Figure 10A:
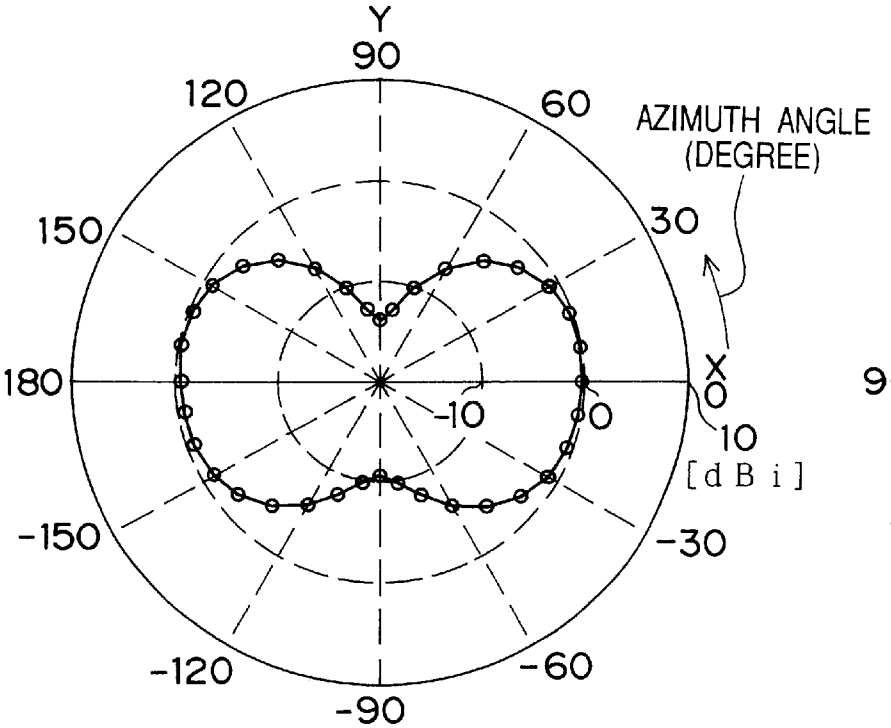
FIG. 10A is a graph showing a directivity characteristic on horizontal plane of the frequency f1 in the M-shaped antenna apparatus of FIG. 6.
Figure 10B:
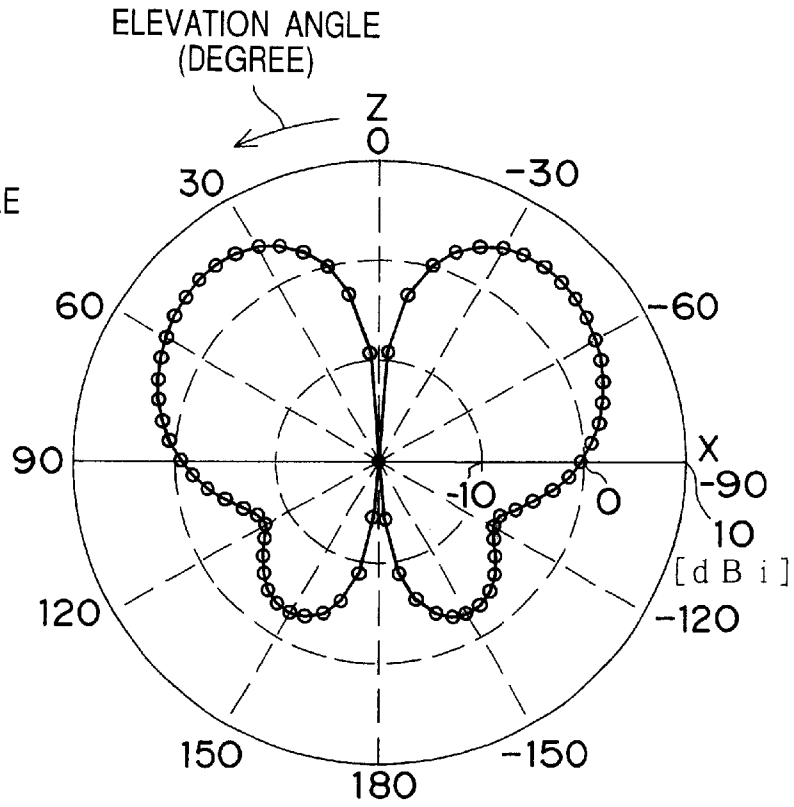
FIG. 10B is a graph showing a directivity characteristic on vertical plane of the frequency f1 in the M-shaped antenna apparatus.

FIG. 9A is a graph showing a directivity characteristic on horizontal plane of the frequency f2 in the M-shaped antenna apparatus of FIG. 6. FIG. 9B is a graph showing a directivity characteristic on vertical plane of the frequency f2 in the M-shaped antenna apparatus. FIG. 10A is a graph showing a directivity characteristic on horizontal plane of the frequency f1 in the M-shaped antenna apparatus of FIG. 6. FIG. 10B is a graph showing a directivity characteristic on vertical plane of the frequency f1 in the M-shaped antenna apparatus.

As is apparent from FIGS. 9A, 9B, 10A and 10B, it can be understood that a bilateral directivity characteristic roughly equal to the horizontal plane is obtained when the use frequencies are f2 and f1. As described above, it can be understood that this M-shaped antenna apparatus has the two resonance frequencies f1 and f2 and achieves the bilateral directivity characteristic with the simple structure. Moreover, the height H of the M-shaped antenna apparatus is 0.089×λ2 (=0.12×λ1) also in the M-shaped antenna apparatus of the present implemental example made for experimental purpose, and an antenna of a thin shape is provided. According to the description of the aforementioned preferred embodiment and implemental example, this M-shaped antenna apparatus has the structure symmetrical with respect to the Z-Y plane and the Z-X plane. In this case, there is the particular advantageous effect that the directivity characteristic of the radiation electric waves from the M-shaped antenna apparatus becomes symmetrical with respect to the Z-Y plane and the Z-X plane. As described above, according to the present preferred embodiment, there can be provided an M-shaped antenna apparatus that keeps a small thin shape and concurrently has two resonance frequencies and the bilateral directivity characteristic with the simple structure.

Modified Preferred Embodiments of First Preferred Embodiment

According to the description of the aforementioned preferred embodiment and implemental example, this M-shaped antenna apparatus has the structure symmetrical with respect to the Z-Y plane and the Z-X plane. However, the present invention is not limited to this, and it is acceptable to provide a structure symmetrical with respect to only the Z-Y plane or a structure asymmetrical with respect to the Z-Y plane or the Z-X plane in order to obtain, for example, the desired radiation directivity characteristic or input impedance characteristic. With the above structure, there can be provided an antenna apparatus that has a radiation directivity characteristic optimum for the objective radiation space.

According to the description of the aforementioned preferred embodiment and implemental example, the radiation conductor 4 of the M-shaped antenna element 1 and the radiation conductor 4*a* of the M-shaped antenna element 2 are arranged on the Z-axis. However, the present invention is not limited to this, and it is acceptable to provide a structure in which the radiation conductors are arranged in different positions in order to obtain, for example, the desired input impedance characteristic.

According to the description of the aforementioned preferred embodiment and implemental example, the M-shaped antenna apparatus is provided with the two M-shaped antenna elements 1 and 2. However, the present invention is not limited to this, and it is acceptable to provide an M-shaped antenna apparatus provided with three or more M-shaped antenna elements in order to obtain, for example, three or more resonance frequencies.

According to the description of the aforementioned preferred embodiment and implemental example, the M-shaped antenna apparatus in which the conductors of the M-shaped antenna elements 1 and 2 are each constructed of a conductor line. However, the present invention is not limited to this, and it is acceptable to provide an M-shaped antenna constructed of a plate-shaped conductor in order to obtain, for example, the desired radiation directivity characteristic or input impedance characteristic. In this case, the transmission conductors 6 and 6*a* may have a structure of a circular shape, a semicircular shape, an oval shape, a semioval shape, a square shape, a rectangular shape or a polygonal shape, a combination of these shapes or another shape. When the transmission conductors 6 and 6*a* have a curved surface shape such as a circular shape, a semicircular shape, an oval shape or a semioval shape, with regard to the radiation directivity characteristic, there is such a particular advantageous effect that the effect of diffraction at the corner portions becomes less as a consequence of the reduction in the number of corner portions of the transmission conductors 6*a* and 6*a* and the cross-polarization conversion loss of the radiation electric waves from the M-shaped antenna apparatus is reduced.

First Modified Preferred Embodiment

Figure 11:
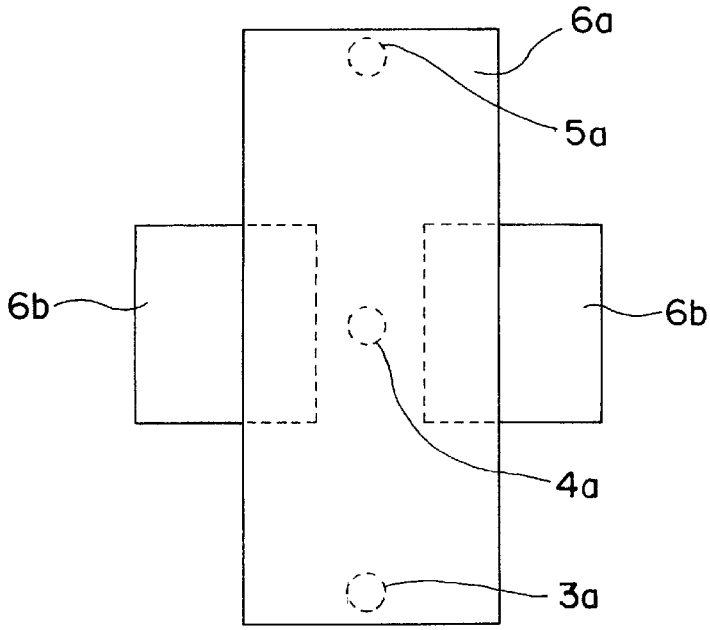
FIG. 11 is a plan view showing a transmission conductor provided with a transmission conductor 6*a* and two transmission conductor additional sections 6*b* according to a first modified preferred embodiment modified from the first preferred embodiment.

FIG. 11 is a plan view showing a transmission conductor provided with a transmission conductor 6*a* and two transmission conductor additional sections 6*b* according to a first modified preferred embodiment modified from the first preferred embodiment.

Referring to FIG. 11, two transmission conductor additional sections 6*b* for expanding the width of the transmission conductor 6*a* are formed on both sides in the widthwise direction of the approximate center portion in the longitudinal direction (the radiation conductors 3, 4 and 5 are arranged side by side in this longitudinal direction) of the transmission conductor 6*a* of a rectangular shape. In this case, it is preferable to provide a mechanism for adjusting the width of the transmission conductor by sliding the transmission conductor additional sections 6*b* in the widthwise direction. This allows adjustment of the input impedance in the feeding portion 12 of the M-shaped antenna apparatus by changing the distribution of current flowing through the transmission conductor 6*a*. In other words, when the impedance characteristic is slightly shifted due to the surrounding environment in which the M-shaped antenna apparatus is installed, the input impedance can be changed to allow adjustment to the desired input impedance by moving the transmission conductor additional sections 6*b* in the widthwise direction. On the other hand, the radiation directivity characteristic of the M-shaped antenna apparatus is determined by the distribution of the electric field excited in the M-shaped antenna as shown in FIG. 3. Therefore, by changing the positions of the transmission conductor additional sections 6*b* in the widthwise direction, the directivity characteristic can be changed.

Second Modified Preferred Embodiment

Figure 12:
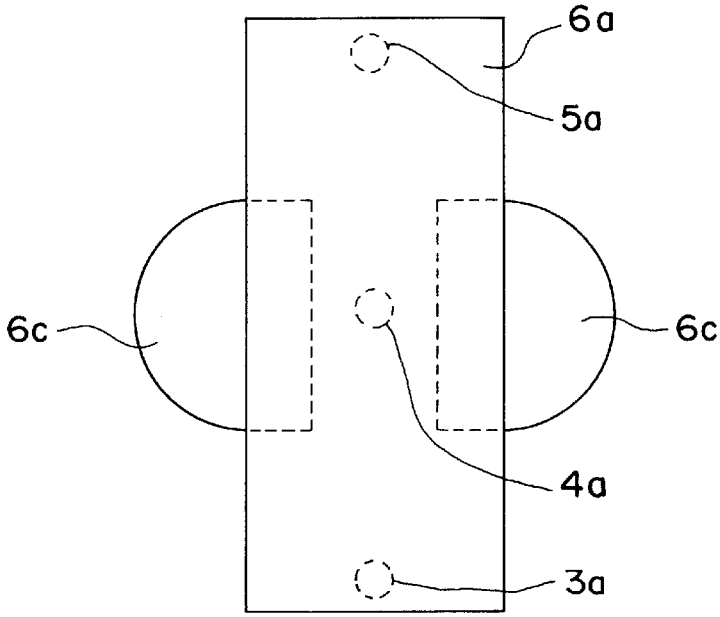
FIG. 12 is a plan view showing a transmission conductor provided with a transmission conductor 6*a* and two transmission conductor additional sections 6*c* according to a second modified preferred embodiment modified from the first preferred embodiment.

FIG. 12 is a plan view showing a transmission conductor provided with a transmission conductor 6*a* and two transmission conductor additional sections 6*c* according to a second modified preferred embodiment modified from the first preferred embodiment. According to the description of the aforementioned first modified preferred embodiment, the two transmission conductor additional sections 6*b* of a rectangular shape have been taken as an example. In the second modified preferred embodiment, transmission conductor additional sections 6*c* projecting from the transmission conductor 6*a* have a semicircular shape. According to this second modified preferred embodiment, the diffraction loss is a little, and the electric waves are radiated also in a direction other than the direction (for example, the Y-direction) in which a bilateral directivity characteristic is exhibited. As described above, there can be provided an antenna optimum for the environment in which the antenna is installed by virtue of the transmission conductor additional sections 6*b* and 6*c*.

It is to be noted that the transmission conductor additional sections 6*c* projecting from the transmission conductor 6*a* may have a curved shape such as a semioval shape. The transmission conductor additional sections 6*b* or 6*c* may be added to the transmission conductor 6.

Third Modified Preferred Embodiment

Figure 13:
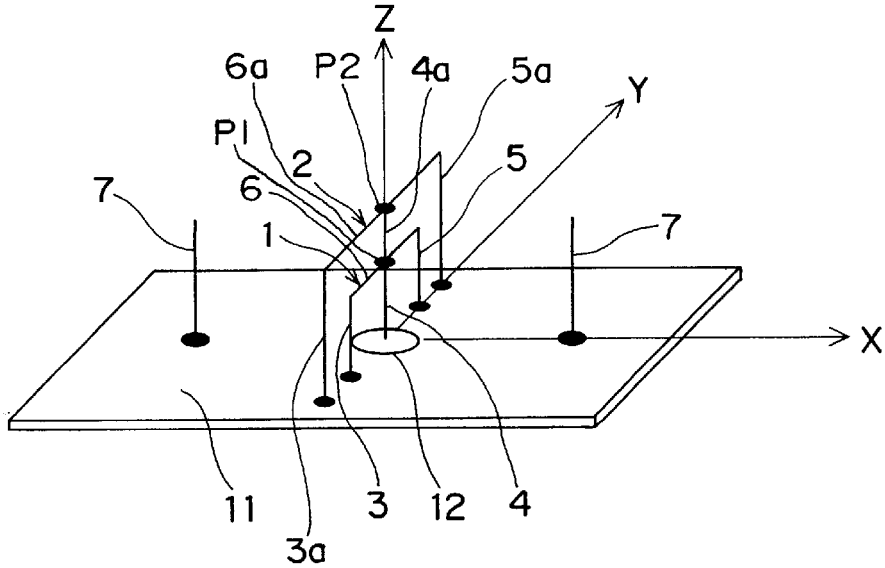
FIG. 13 is a perspective view showing a construction of an M-shaped antenna apparatus provided with two directivity characteristic control conductors 7 according to a third modified preferred embodiment modified from the first preferred embodiment.

FIG. 13 is a perspective view showing a construction of an M-shaped antenna apparatus provided with two directivity characteristic control conductors 7 according to a third modified preferred embodiment modified from the first preferred embodiment. This third modified preferred embodiment is characterized in that two directivity characteristic control conductors 7 for changing the radiation directivity characteristic of the M-shaped antenna apparatus are further provided in comparison with the first preferred embodiment.

Referring to FIG. 13, the two directivity characteristic control conductors 7 are each constructed of a linear conductor, provided on the X-axis symmetrically with respect to the Z-Y plane and have their lower ends grounded. For example, when the length of each of the two directivity characteristic control conductors 7 is set shorter than quarter-wavelength, the directivity characteristic control conductors 7 operate as a waveguide, and the radiated electric waves are pulled toward the directivity characteristic control conductors 7. As a result, the bilateral directivity characteristic becomes sharper. Therefore, an M-shaped antenna apparatus suitable for an extremely elongated space such as a passageway can be provided. When the length of each of the two directivity characteristic control conductors 7 is set so as to be longer than the quarter-wavelength, the directivity characteristic control conductors 7 operate as a reflector, and the radiated electric waves are partially reflected in the direction of the directivity characteristic control conductors 7. As a result, the width of the bilateral directivity characteristic becomes wider. Therefore, an M-shaped antenna apparatus that has a bilateral directivity characteristic close to the non-directional characteristic can be provided. In other words, the directivity characteristic control conductors 7 operate as a parasitic antenna element for controlling the directivity characteristic of the M-shaped antenna apparatus.

Although the directivity characteristic control conductors 7 are each constructed of a linear conductor in the third modified preferred embodiment, the conductors can also be constructed of conductors of another shape. The directivity characteristic control conductors 7 may be each constituted of a helical type conductor constructed of, for example, a spiral conductor line or constituted of a conductor line bent in an L-figured shape. With this arrangement, the thickness of the antenna can be reduced without impairing the aforementioned effect. Moreover, the third modified preferred embodiment is provided with two directivity characteristic control conductors 7. However, the number is not limited to two and permitted to be three or more. With this arrangement, the degree of freedom of the antenna structure is increased, and the radiation directivity characteristic can be more largely controlled.

Fourth Modified Preferred Embodiment

Figure 14:
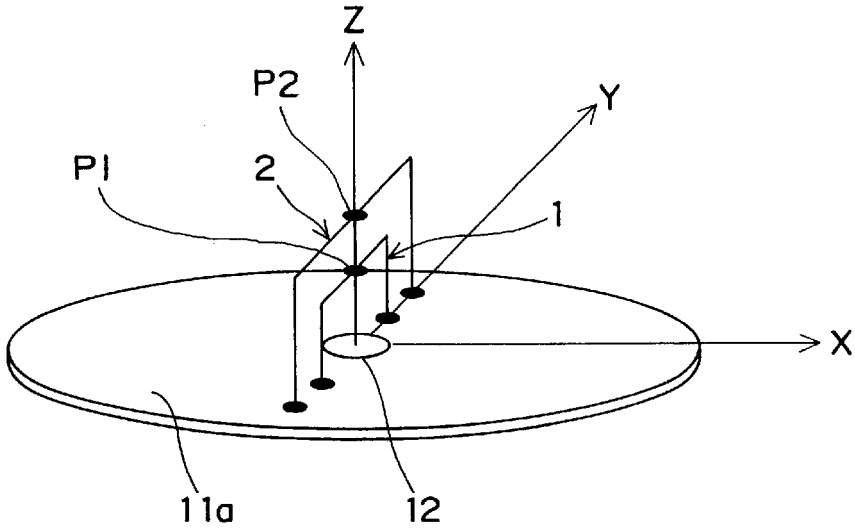
FIG. 14 is a perspective view showing a construction of an M-shaped antenna apparatus provided with a circular grounding conductor 11*a* according to a fourth modified preferred embodiment modified from the first preferred embodiment.

FIG. 14 is a perspective view showing a construction of an M-shaped antenna apparatus provided with a circular grounding conductor 11*a* according to a fourth modified preferred embodiment modified from the first preferred embodiment. The fourth modified preferred embodiment is characterized in that the circular grounding conductor 11*a* is provided in place of the rectangular grounding conductor 11 in comparison with the first preferred embodiment. In FIG. 14, the feeding portion 12 is formed in the center portion of the grounding conductor 11*a*.

The shape of the grounding conductor 11 is not limited to the circular shape and permitted to be a polygonal shape, a semicircular shape, an oval shape, a curved surface shape, a combination of these shapes or another shape in order to obtain, for example, the desired radiation directivity characteristic or input impedance characteristic. By making the grounding conductor 11 have a curved external shape, with regard to the radiation directivity characteristic, there is such a particular advantageous effect that the effect of diffraction at the corner portions becomes less as a consequence of the reduction in the number of corner portions of the grounding conductor 11 and the cross-polarization conversion loss of the radiation electric waves from the M-shaped antenna apparatus is reduced. Moreover, when the M-shaped antenna apparatus is installed on a ceiling or the like, there is a demand for coordinating the shape of the antenna apparatus with the texture of the ceiling surface or the shape of the room so that the antenna apparatus becomes less conspicuous. However, when the shape of the antenna apparatus is a rectangular or another polygonal shape, there are limitations on the direction in which the antenna is installed since the texture of the ceiling surface or the shape of the room are fixed. Accordingly, when the grounding conductor 11*a* has a circular shape, i.e., when the bottom surface of the antenna apparatus has a circular shape, in installing the antenna apparatus on the ceiling, there is the advantage that the antenna apparatus can be installed without taking care of the texture of the ceiling surface or the shape of the room. Furthermore, when the bottom surface of the antenna apparatus has a circular shape, it is possible to change the mounting direction by turning the antenna apparatus. With this arrangement, the direction in which the electric waves are radiated can be adjusted, and a radiation directivity characteristic optimum for the installation position of the antenna apparatus can be obtained.

Furthermore, it is acceptable to arrange this M-shaped antenna apparatus in an array shape, constituting a phased array antenna or an adaptive antenna array. This arrangement enables the further control of the directivity characteristic of the radiation electric waves.

Second Preferred Embodiment

Figure 15:
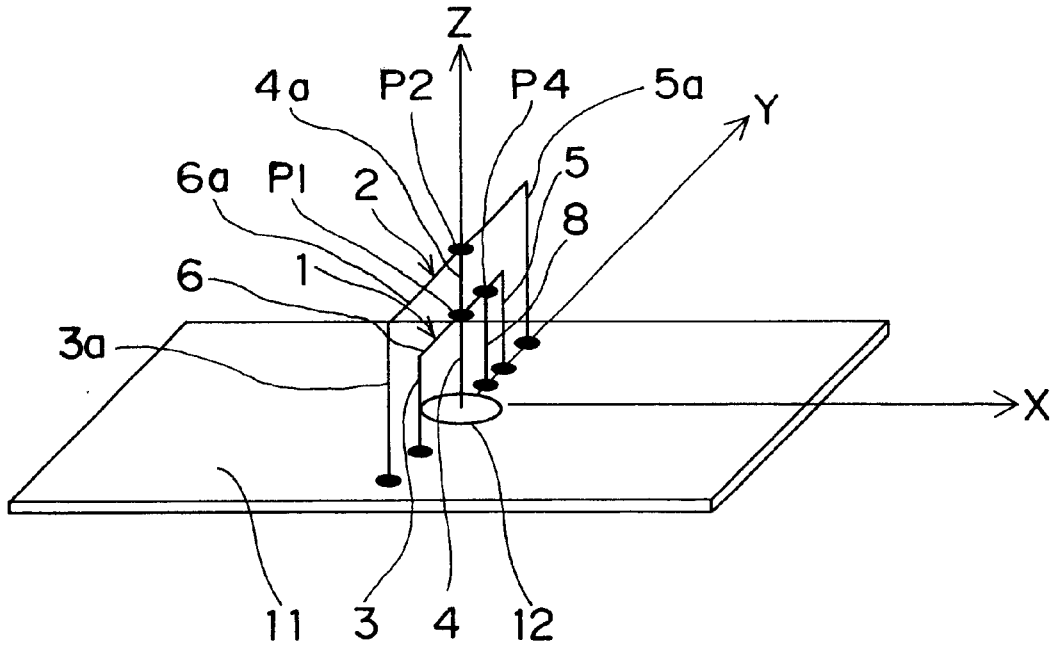
FIG. 15 is a perspective view showing a construction of an M-shaped antenna apparatus according to a second preferred embodiment of the present invention.

FIG. 15 is a perspective view showing a construction of an M-shaped antenna apparatus according to a second preferred embodiment of the present invention. The second preferred embodiment is characterized in that a matching conductor 8 constructed of a linear conductor is further provided in comparison with the first preferred embodiment. The other construction is similar to that of the first preferred embodiment, and no detailed description is provided. In this case, the matching conductor 8 is constructed of the conductor line and provided so as to be parallel to the radiation conductors 3, 4 and 5. One end of the matching conductor 8 is connected to the approximate middle point located between the other end of the transmission conductor 6 to which the radiation conductor 5 is connected and the connection point P1, while the other end of the matching conductor 8 is grounded.

The M-shaped antenna apparatus of the second preferred embodiment constructed as above has operation and effect similar to those of the first preferred embodiment and is further provided with the following operation and effect. In other words, in the M-shaped antenna apparatus of the first preferred embodiment, there possibly occurs a deteriorated state of impedance matching between the M-shaped antenna apparatus and the feeding cable in the feeding portion 12 depending on the antenna structure. If the impedance matching state is deteriorated as described above, then the electric power supplied to the M-shaped antenna elements 1 and 2 of the M-shaped antenna apparatus decreases to disadvantageously reduce the radiation efficiency of the antenna apparatus. Therefore, by providing the matching conductor 8 in the vicinity of the M-shaped antenna elements 1 and 2 with interposition of an interval, the input impedance of the antenna apparatus is varied to provide a satisfactory state of matching with the feeding cable in the feeding portion 12, by which the radiation efficiency of the antenna apparatus can be improved. Furthermore, when the matching conductor 8 is smaller than the M-shaped antenna elements 1 and 2, the radiation directivity characteristic of the M-shaped antenna apparatus of the present preferred embodiment scarcely changes in comparison with the case of non-existence of the matching conductor 8 (first preferred embodiment). In other words, the impedance matching state can be made satisfactory while scarcely changing the desired radiation directivity characteristic.

Figure 16:
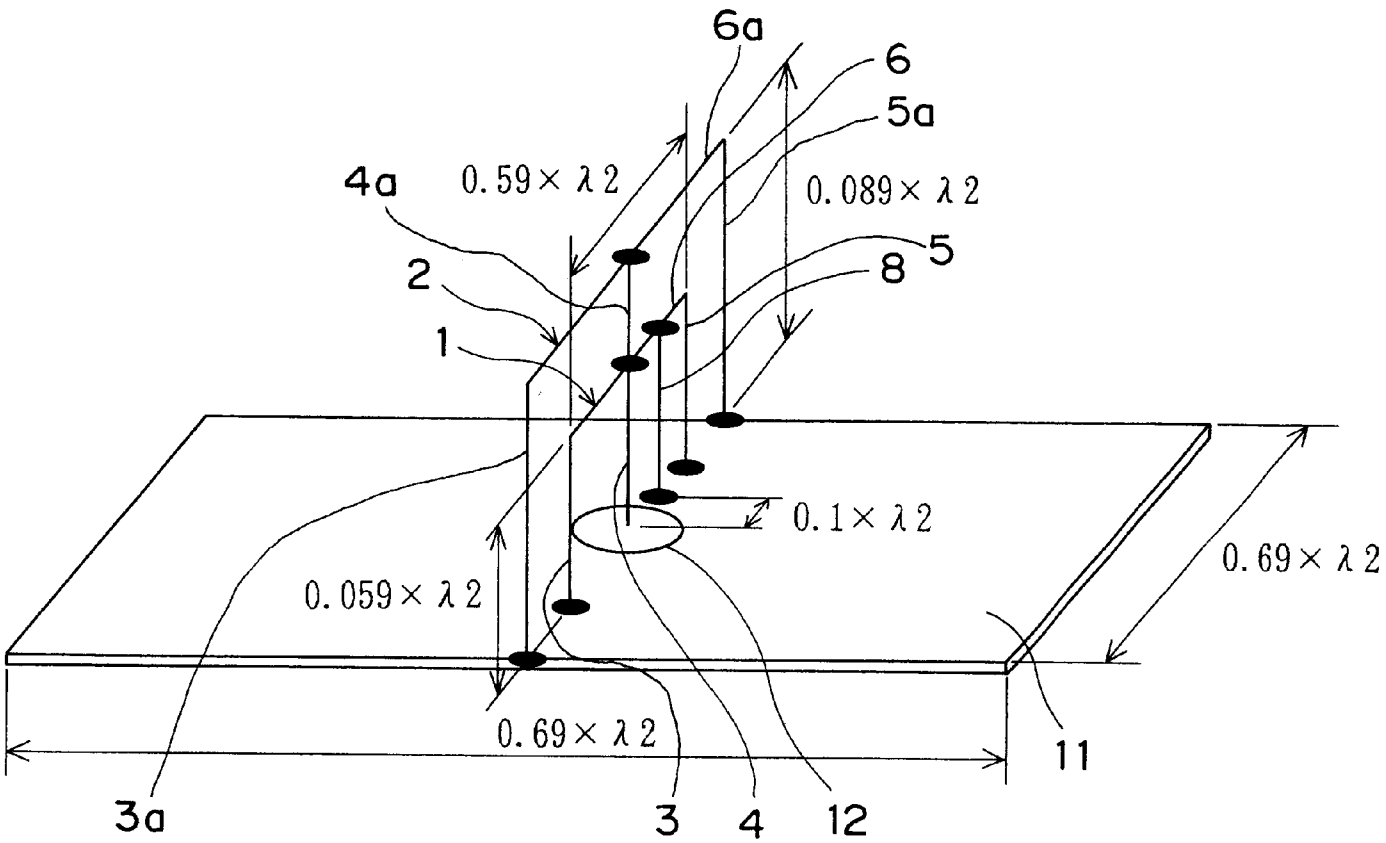
FIG. 16 is a perspective view showing a construction of an M-shaped antenna apparatus according to a second implemental example of the second preferred embodiment.

FIG. 16 is a perspective view showing a construction of an M-shaped antenna apparatus according to a second implemental example (prototype) of the second preferred embodiment. The matching conductor 8 of the M-shaped antenna apparatus of the second implemental example is constructed of a conductor line of a diameter of $0.008\times\lambda 2$ and installed in a position separated apart from the origin by a distance of $0.1\times\lambda 2$ in the Y-axis direction. The other antenna structure is similar to the structure of the M-shaped antenna apparatus of the first implemental example.

Figure 17:
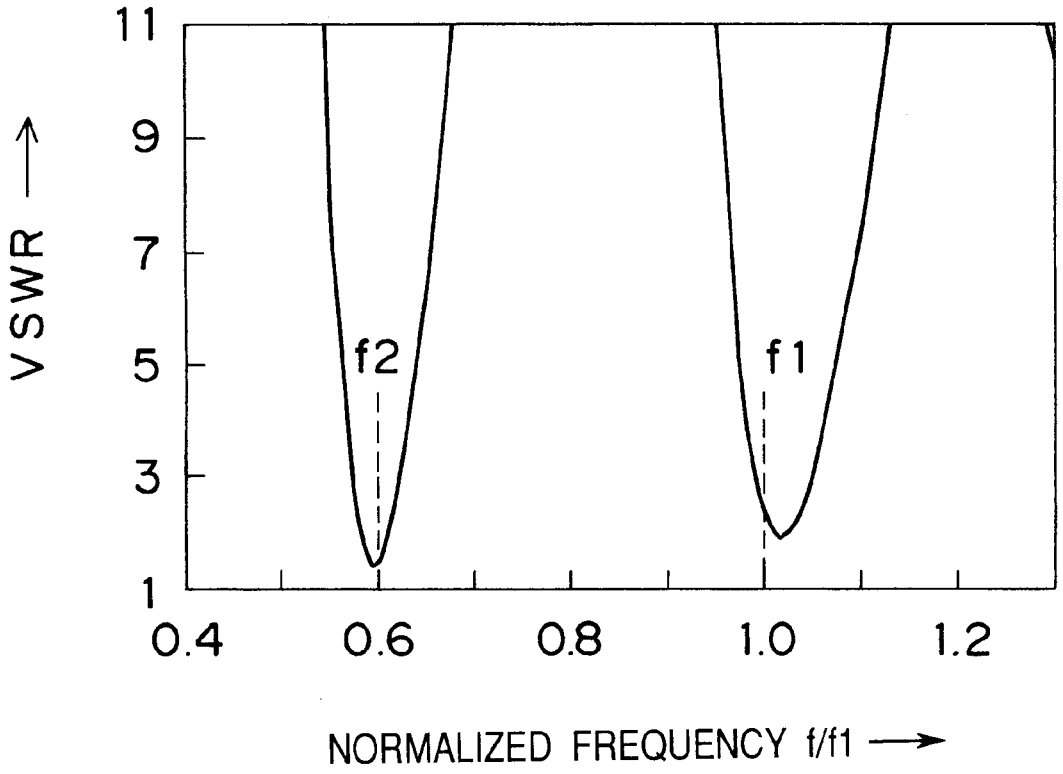
FIG. 17 is a graph showing a voltage standing wave ratio (VSWR) characteristic with respect to the normalized frequency f/f1 in the M-shaped antenna apparatus of FIG. 16.

FIG. 17 is a graph showing a voltage standing wave ratio (VSWR) characteristic with respect to the normalized frequency f/f1 in the M-shaped antenna apparatus of FIG. 16. In this case, in FIG. 17, the horizontal axis represents the frequency normalized by the use frequency f1. As is apparent from FIG. 17, it can be understood that the M-shaped antenna apparatus of the second implemental example exhibits a satisfactory impedance characteristic with a little reflection loss of VSWR which is equal to or smaller than two (i.e., the reflection loss is equal to or smaller than 10 dB) at the two use frequencies f1 and f2. It is to be noted that the radiation directivity characteristic is similar to that of FIGS. 9A, 9B, 10A and 10B, exhibiting a bilateral directivity characteristic. Also, in the M-shaped antenna apparatus of the second implemental example, the height of the antenna apparatus is $0.089\times\lambda 2(=0.12\times\lambda 1)$, and an antenna apparatus of a thin shape can be provided.

Modified Preferred Embodiments of Second Preferred Embodiment

The first to fourth modified preferred embodiments, which have been described in connection with the first preferred embodiment, and any other modified preferred embodiment can be applied to the second preferred embodiment, and similar operation and effect can be obtained.

The M-shaped antenna apparatus that has one matching conductor 8 has been described in connection with the second preferred embodiment. However, the present invention is not limited to this, and it is acceptable to provide two or more matching conductors 8 in order to obtain, for example, the desired input impedance characteristic. With this arrangement, the degree of freedom of the antenna structure is increased, and the state of impedance matching with the feeding cable in the feeding portion 12 can be further improved.

The M-shaped antenna apparatus of the structure, in which the matching conductor 8 is arranged on the Y-axis, has been described in connection with the second preferred embodiment. However, the present invention is not limited to this, and it is possible to arrange, for example, the matching conductor 8 in an arbitrary position on the X-Y plane of the grounding conductor 11. With this arrangement, the degree of freedom of the antenna structure is increased, and the state of impedance matching with the feeding cable in the feeding portion 12 can be further improved.

Although the matching conductor 8 is constructed of the linear conductor in the second preferred embodiment, the matching conductor can also be constructed of a conductor of another shape. For example, it is acceptable to constitute the matching conductor of a helical type conductor constructed of a spiral conductor line or constitute the matching conductor of a conductor line bent in an L-letter shape. With this arrangement, the degree of freedom of the antenna structure is increased, and the state of impedance matching with the feeding cable in the feeding portion 12 can be further improved.

In the second preferred embodiment, the matching conductor 8 is connected to the transmission conductor 6 of the M-shaped antenna element 1. However, the present invention is not limited to this, and the matching conductor may be connected to the transmission conductor 6*a* of the M-shaped antenna element 2.

Fifth Modified Preferred Embodiment

Figure 18A:
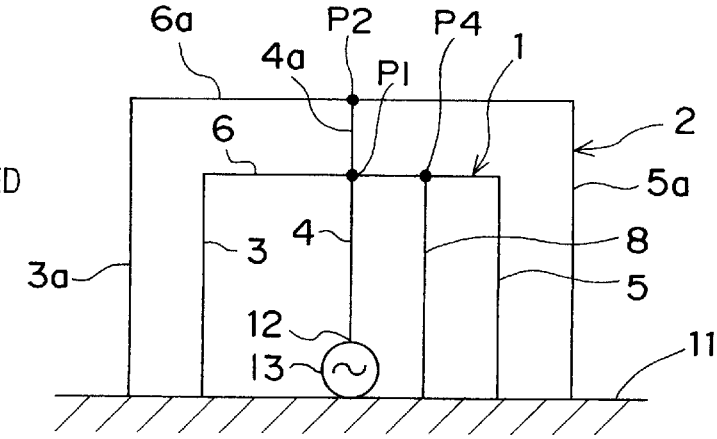
FIG. 18A is a schematic view showing a construction of the M-shaped antenna apparatus of the second preferred embodiment.
Figure 18B:
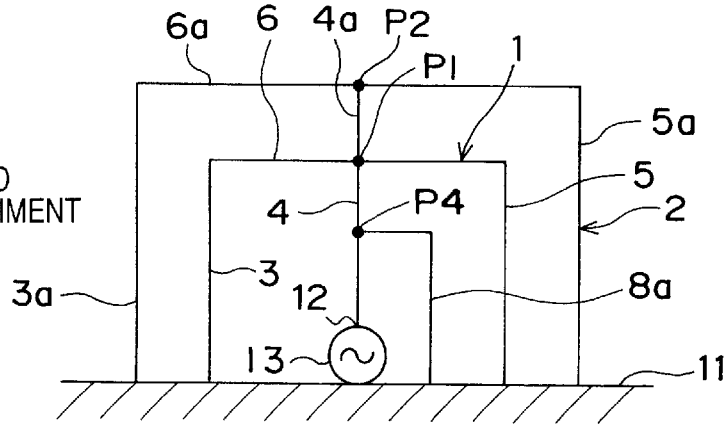
FIG. 18B is a schematic view showing a construction of an M-shaped antenna apparatus according to a fifth modified preferred embodiment modified from the second preferred embodiment.

FIG. 18B is a schematic view showing a construction of an M-shaped antenna apparatus according to a fifth modified preferred embodiment modified from the second preferred embodiment. Although the one end of the matching conductor 8 is connected between the connection point P1 and the other end of the transmission conductor 6 in the second preferred embodiment as shown in FIG. 18A, it is acceptable to connect the one end to a middle point P4 of the radiation conductor 4 as shown in FIG. 18B of the fifth modified preferred embodiment. With this arrangement, the state of impedance matching with the feeding cable in the feeding portion 12 can be further improved.

Sixth Modified Preferred Embodiment

Figure 18C:
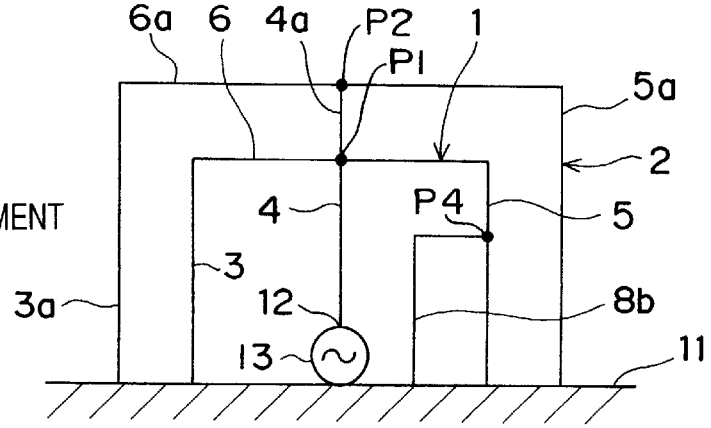
FIG. 18C is a schematic view showing a construction of an M-shaped antenna apparatus according to a sixth modified preferred embodiment modified from the second preferred embodiment.

FIG. 18C is a schematic view showing a construction of an M-shaped antenna apparatus according to a sixth modified preferred embodiment modified from the second preferred embodiment. Although the one end of the matching conductor 8 is connected between the connection point P1 and the other end of the transmission conductor 6 in the second preferred embodiment as shown in FIG. 18A, it is acceptable to connect the one end to a middle point P4 of the radiation conductor 5 as shown in FIG. 18C of the sixth modified preferred embodiment. With this arrangement, the state of impedance matching with the feeding cable in the feeding portion 12 can be further improved.

Seventh Modified Preferred Embodiment

Figure 19:
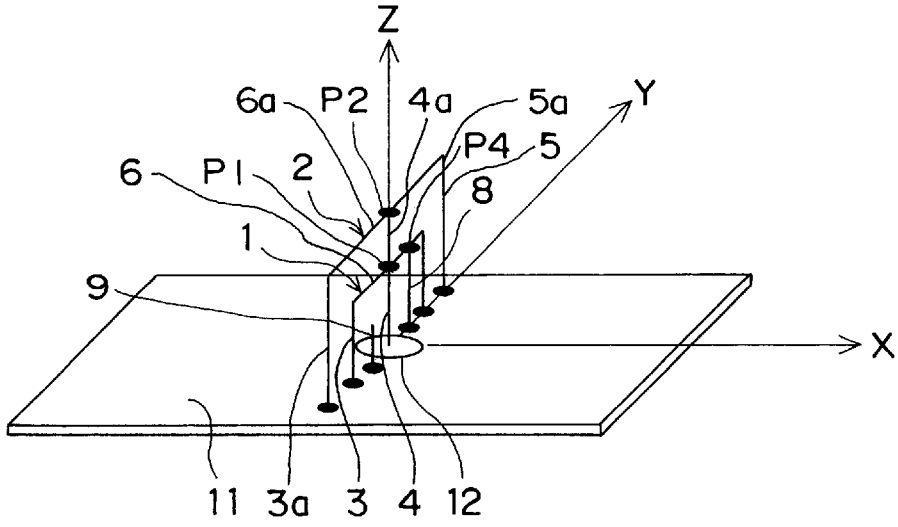
FIG. 19 is a perspective view showing a construction of an M-shaped antenna apparatus according to a seventh modified preferred embodiment modified from the second preferred embodiment.

FIG. 19 is a perspective view showing a construction of an M-shaped antenna apparatus according to a seventh modified preferred embodiment modified from the second preferred embodiment. Although the matching conductor 8 is connected to the transmission conductor 6 of the M-shaped antenna element 1 in the second preferred embodiment, it is acceptable to further provide a matching conductor 9 that is connected to neither the radiation conductor nor the transmission conductor according to the seventh modified preferred embodiment. This matching conductor 9 is located on the Y-Z plane parallel to the radiation conductors 3 and 4, and the lower end of the matching conductor 9 is grounded between the radiation conductors 3 and 4. In other words, by providing a construction in which the upper end of the matching conductor 9 is not connected to the M-shaped antenna elements 1 and 2, the degree of freedom of the antenna structure is increased, and the state of impedance matching with the feeding cable in the feeding portion 12 can be further improved.

Third Preferred Embodiment

Figure 20:
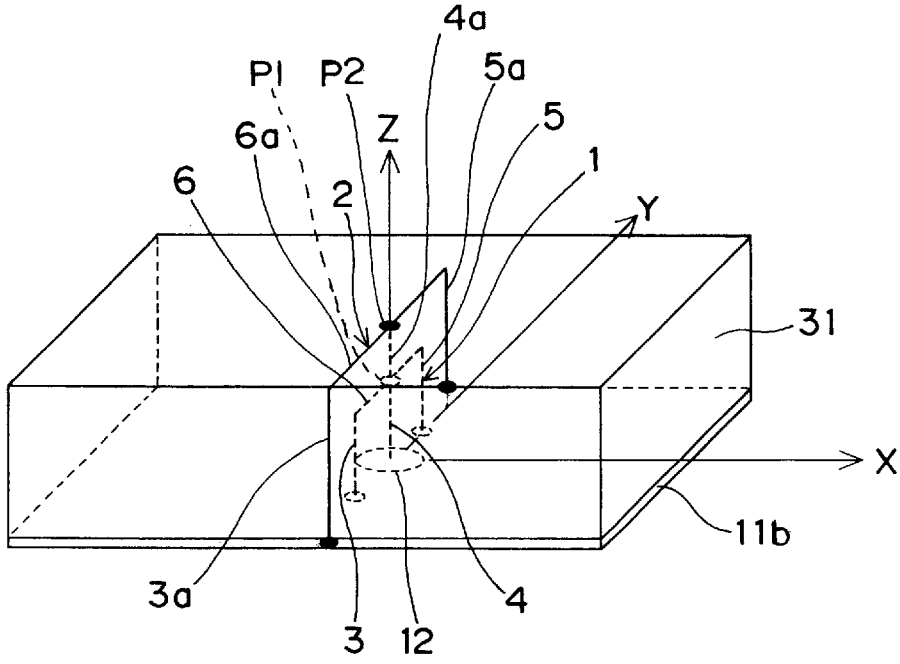
FIG. 20 is a perspective view showing a construction of an M-shaped antenna apparatus according to a third preferred embodiment of the present invention.

FIG. 20 is a perspective view showing a construction of an M-shaped antenna apparatus according to a third preferred embodiment of the present invention. The third preferred embodiment is characterized in that two M-shaped antenna elements 1 and 2 are provided in a dielectric body 31 on the rear surface of which a grounding conductor 11*b* of a rectangular shape is formed and on the surface of the dielectric body 31 in comparison with the first preferred embodiment. The other construction is similar to that of the first preferred embodiment, and no detailed description is provided. In this case, the radiation conductor 4*a* of the M-shaped antenna element 1 and the M-shaped antenna element 2 is formed inside the dielectric body 31. The radiation conductors 3*a* and 5*a* of the M-shaped antenna element 2 are formed on the side surfaces of the dielectric body 31, and the transmission conductor 6*a* is formed on the top surface of the dielectric body 31.

In FIG. 20, the grounding conductor 11*b* has a rectangular shape symmetrical with respect to the Z-Y plane and the Z-X plane, and the feeding portion 12 is arranged at the origin of the X-Y plane. The M-shaped antenna elements 1 and 2 are each constructed of a conductor line and arranged on the Z-Y plane. In this case, the radiation conductor 4 of the M-shaped antenna element 1 and the radiation conductor 4*a* of the M-shaped antenna element 2 are arranged on the Z-axis. In this case, the dielectric body 31, whose bottom surface is the grounding conductor 11*b*, has a rectangular pillar shape of a height equal to the height of the M-shaped antenna element 2. The M-shaped antenna apparatus of the third preferred embodiment constructed as above has operation and effect similar to those of the first preferred embodiment.

The M-shaped antenna apparatus of the present preferred embodiment is constituted by inserting the dielectric body 31 in a space that includes a region on the Y-Z plane surrounded by the radiation conductors 3*a* and 5*a* and the transmission conductor 6*a* of the M-shaped antenna element 2 and the grounding conductor 11*b* and is extended in the −X-direction and the +X-direction of the region. It is assumed that the ratio of the dielectric constant (relative dielectric constant) of the dielectric body 31 with respect to the dielectric constant $\epsilon_o$ in a vacuum is $\epsilon_r$, then the wavelength in the dielectric body 31 becomes $$\frac{1}{\sqrt{\varepsilon_r}}$$

times the wavelength in the vacuum. The relative dielectric constant $\epsilon_r$ is not smaller than one, and therefore, the wavelength is shortened in the dielectric body 31. Therefore, by inserting the dielectric body 31 in the antenna, the M-shaped antenna apparatus can be reduced in size and weight and made to have a thin structure.

It is acceptable to apply the first preferred embodiment, its modified preferred embodiment, the second preferred embodiment and its modified preferred embodiment to the third preferred embodiment.

Fourth Preferred Embodiment

Figure 21:
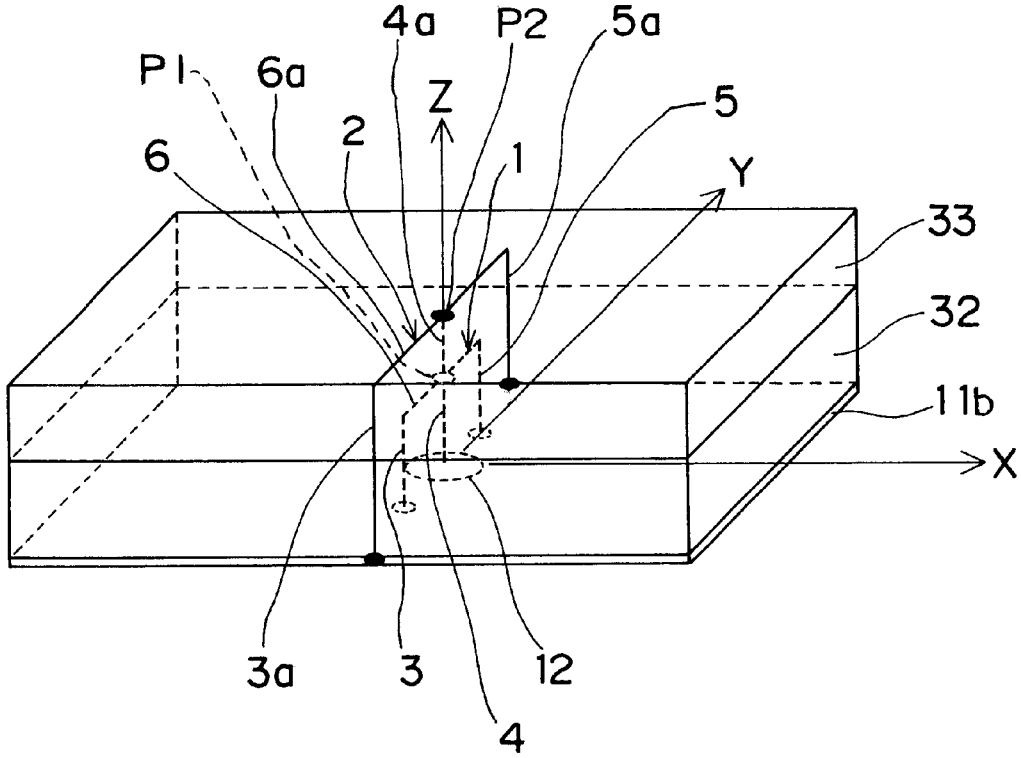
FIG. 21 is a perspective view showing a construction of an M-shaped antenna apparatus according to a fourth preferred embodiment of the present invention.

FIG. 21 is a perspective view showing a construction of an M-shaped antenna apparatus according to a fourth preferred embodiment of the present invention. This fourth preferred embodiment is characterized in that the M-shaped antenna elements 1 and 2 are formed in a dielectric substrate 32 on the rear surface of which the grounding conductor 11*b* is formed, on the surface of the dielectric substrate 32, in a dielectric substrate 33 and on the surface of the dielectric substrate 33. In this case, the radiation conductors 3, 4 and 5 of the M-shaped antenna element 1 is constituted by a through hole conductor that penetrates the dielectric substrate 32 in the direction of thickness, and its transmission conductor 6 is constructed of a conductor pattern (or a conductor foil) formed on the top surface of the dielectric substrate 32. The radiation conductor 4*a* of the M-shaped antenna element 2 is constituted by a through hole conductor that penetrates the dielectric substrate 33 in the direction of thickness, its radiation conductors 3*a* and 5*a* are formed on the side surfaces of the dielectric substrates 32 and 33, and its transmission conductor 6*a* is constructed of a conductor pattern (or a conductor foil) formed on the top surface of the dielectric substrate 33. It is to be noted that the radiation conductors 3*a* and 5*a* may be constructed of a semicircular through hole conductor that penetrates the dielectric substrates 32 and 33 in the direction of thickness.

Accordingly, the conductors of the M-shaped antenna elements 1 and 2 can be formed by using a print wiring printing technology. Therefore, the substrate processing of high processing accuracy, such as the etching process, can be utilized, by which the antenna manufacturing accuracy is improved and cost reduction can be achieved by mass production.

Next, one example of the manufacturing procedure of the M-shaped antenna apparatus of the present preferred embodiment will be described with reference to FIG. 21. First of all, the transmission conductor 6 of the M-shaped antenna element 2 is formed by cutting the dielectric substrate 32 to the size of the grounding conductor 11*b* and abrading away a part of the conductor foil on one surface by, for example, etching or machining, and the radiation conductors 3, 4 and 5 of the M-shaped antenna element 1 are constituted by a through hole conductor that penetrates the dielectric substrate 32 in the direction of thickness. In this case, the surface, which belongs to the M-shaped antenna element 1 and on which the transmission conductor 6 is formed, is served as the top surface of the dielectric substrate 32. Moreover, the conductor foil portion on the rear surface of the dielectric substrate 32 serves as the grounding conductor 11*b*. In this grounding conductor 11*b*, a circular hole of an appropriate size is abraded away from the conductor foil around the position of the through hole conductor that forms the radiation conductor 4, forming a feeding portion 12 of a coaxial shape.

Further, the other dielectric substrate 33 is cut to the same size as that of the dielectric substrate 32, and the transmission conductor 6 of the M-shaped antenna element 2 is formed by abrading away a part of the conductor foil by, for example, etching or machining, from one surface of the conductor foil of the dielectric substrate 33. The other surface of the dielectric substrate 33 is entirely abraded away. Further, the radiation conductor 4*a* of the M-shaped antenna element 2 is constituted by a through hole conductor. In this dielectric substrate 33, the surface, which belongs to the M-shaped antenna element 2 and on which the transmission conductor 6*a* is formed, is served as the top surface of the dielectric substrate 33, and the surface, which belongs to the dielectric substrate 33 and is entirely abraded away, is served as the bottom surface. By sticking the top surface of the dielectric substrate 32 to the bottom surface of the dielectric substrate 34 and further forming the radiation conductors 3*a* and 5*a* on the side surfaces of the dielectric substrates 32 and 33, the M-shaped antenna apparatus of the present preferred embodiment is produced.

As described above, according to the present preferred embodiment, there can be provided an M-shaped antenna apparatus, which has a simple structure, a small size, a thin shape, high processing accuracy and a reduced deterioration of the antenna characteristics and concurrently possesses a satisfactory impedance characteristic of a small reflection loss at the two resonance frequencies and a bilateral directivity characteristic.

The antenna apparatus of the structure in which the antenna surrounded by the conductor is internally filled with the dielectric material has been described in connection with the third and fourth preferred embodiments. However, the present invention is not limited to this, and the structure may include a dielectric material existing in a part of the antenna. For example, the M-shaped antenna element 1 may be filled with the dielectric material 31 (third preferred embodiment) or formed of a dielectric substrate 32 (fourth preferred embodiment).

It is acceptable to apply the first preferred embodiment, its modified preferred embodiment, the second preferred embodiment and its modified preferred embodiment to the fourth preferred embodiment described above.

Eighth Modified Preferred Embodiment

Figure 22A:
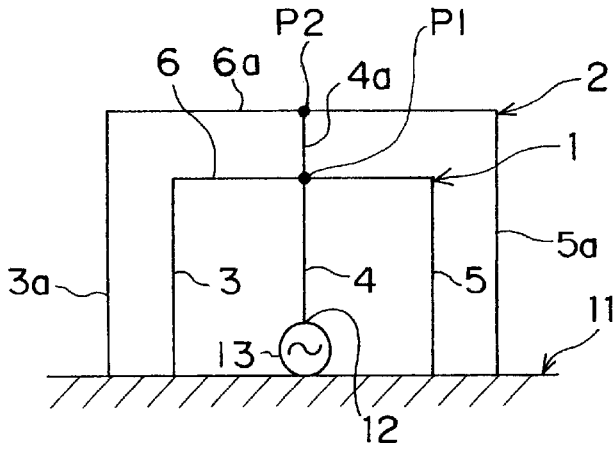
FIG. 22A is a schematic view showing a construction of the M-shaped antenna apparatus of the first preferred embodiment.
Figure 22B:
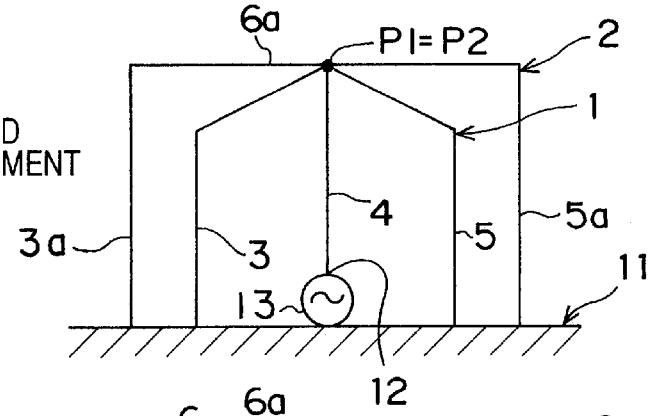
FIG. 22B is a perspective view showing a construction of an M-shaped antenna apparatus according to an eighth modified preferred embodiment modified from the first preferred embodiment.

FIG. 22B is a perspective view showing a construction of an M-shaped antenna apparatus according to an eighth modified preferred embodiment modified from the first preferred embodiment. In the first preferred embodiment, as shown in FIG. 22A, the connection point P1 and the connection point P2 are connected to each other via the radiation conductor 4*a*. In other words, the M-shaped antenna element 1 employs only the radiation conductor 4 connected to the feeding point 12. However, the M-shaped antenna element 2 uses both the radiation conductors 4 and 4*a* connected to the feeding point 12 as the radiation conductors, and the radiation conductor 4 is shared by the two M-shaped antenna elements 1 and 2.

As shown in FIG. 22B showing an eighth modified preferred embodiment, it is acceptable to make the connection point P1 and the connection point P2 serve as an identical connection point without forming the radiation conductor 4*a*. In other words, each of the radiation conductors 3, 4 and 5 has one end connected to the connection point P1 P2 located in the center portion of the transmission conductor 6*a*. In other words, according to the eighth modified preferred embodiment, the radiation conductor 4 is shared by the two M-shaped antenna elements 1 and 2.

Ninth Modified Preferred Embodiment

Figure 22C:
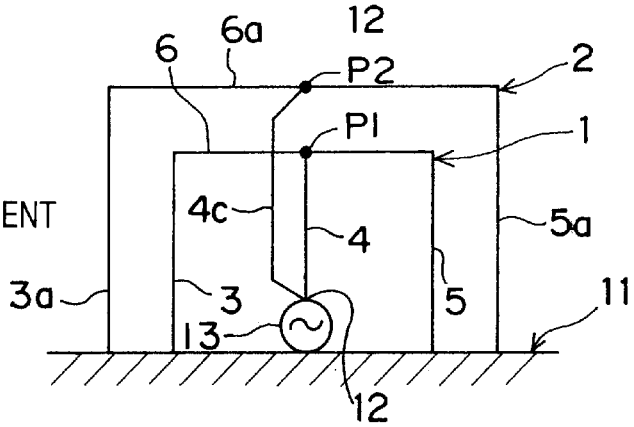
FIG. 22C is a perspective view showing a construction of an M-shaped antenna apparatus according to a ninth modified preferred embodiment modified from the first preferred embodiment.

FIG. 22C is a perspective view showing a construction of an M-shaped antenna apparatus according to a ninth modified preferred embodiment modified from the first preferred embodiment. This antenna apparatus is characterized in that a radiation conductor 4*c* is provided in place of the radiation conductor 4*a* of the first preferred embodiment. One end of the radiation conductor 4*c* is connected to the connection point P2, while the other end of the radiation conductor 4*a* is connected directly to the feeding point 12. It is to be noted that the radiation conductor 4*c* is electrically insulated from the transmission conductor 6. In other words, according to the ninth modified preferred embodiment, the radiation conductors 4 and 4*c* are separately used by the two M-shaped antenna elements 1 and 2.

Tenth Modified Preferred Embodiment

Figure 22D:
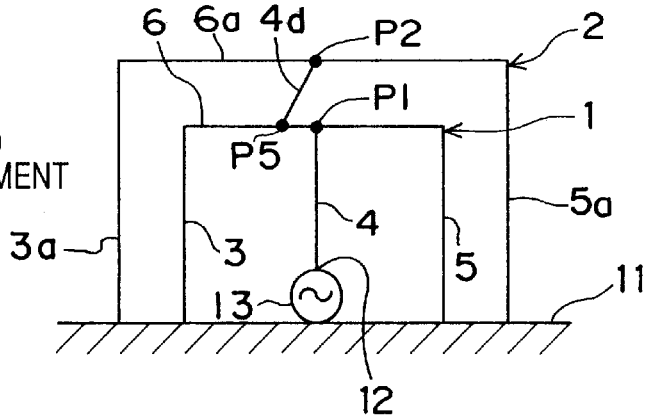
FIG. 22D is a perspective view showing a construction of an M-shaped antenna apparatus according to a tenth modified preferred embodiment modified from the first preferred embodiment.

FIG. 22D is a perspective view showing a construction of an M-shaped antenna apparatus according to a tenth modified preferred embodiment modified from the first preferred embodiment. In the first preferred embodiment, the radiation conductor 4*a* is connected to the point between the connection point P2 and the connection point P1. In the tenth modified preferred embodiment, a radiation conductor 4*d* is provided in place of the radiation conductor 4*a*. One end of the radiation conductor 4*d* is connected to the connection point P2, while the other end of the radiation conductor 4*d* is connected to a connection point P5 located between the connection point P1 and one end or the other end of the transmission conductor 6. In this case, by moving the position of the connection point P5 on the transmission conductor 6, the input impedance of the M-shaped antenna apparatus can be adjusted.

In the tenth modified preferred embodiment, the M-shaped antenna element 1 uses only the radiation conductor 4 connected to the feeding point 12. However, the M-shaped antenna element 2 uses the radiation conductors 4 and 4*d* connected to the feeding point 12 and a part of the transmission conductor 6 as a radiation conductor, and the radiation conductor 4 is shared by the two M-shaped antenna elements 1 and 2.

Fifth Preferred Embodiment

Figure 23A:
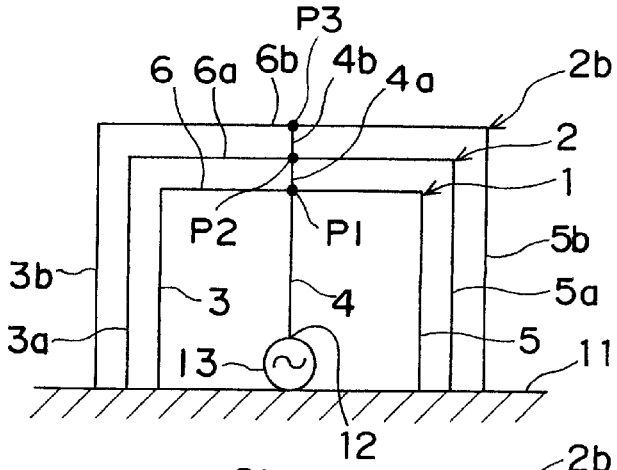
FIG. 23A is a schematic view showing a construction of an M-shaped antenna apparatus according to a fifth preferred embodiment of the present invention.

FIG. 23A is a schematic view showing a construction of an M-shaped antenna apparatus according to a fifth preferred embodiment of the present invention. This antenna apparatus is characterized in that a third M-shaped antenna element 2*b* is further provided in comparison with the first preferred embodiment shown in FIG. 22A. In this case, the M-shaped antenna element 2*b* is provided with radiation conductors 3*b*, 4*b* and 5*b* and a transmission conductor 6*b*. One end of the radiation conductor 3*b* is connected to one end of the transmission conductor 6*b*, and the other end of the radiation conductor 3*b* is grounded. One end of the radiation conductor 5*b* is connected to the other end of the transmission conductor 6*b*, and the other end of the radiation conductor 5*b* is grounded. Further, one end of the radiation conductor 4*b* is connected to the connection point P3 located in the center portion of the transmission conductor 6*b*, and the other end is connected to the connection point P2.

The fifth preferred embodiment constructed as above has the particular operation and advantageous effect that the three M-shaped antenna elements 1, 2 and 2*b* having three resonance frequencies are provided and the antenna apparatus can be used at three use frequencies different from each other in addition to the operation and advantageous effect of the aforementioned preferred embodiment.

Eleventh Modified Preferred Embodiment

Figure 23B:
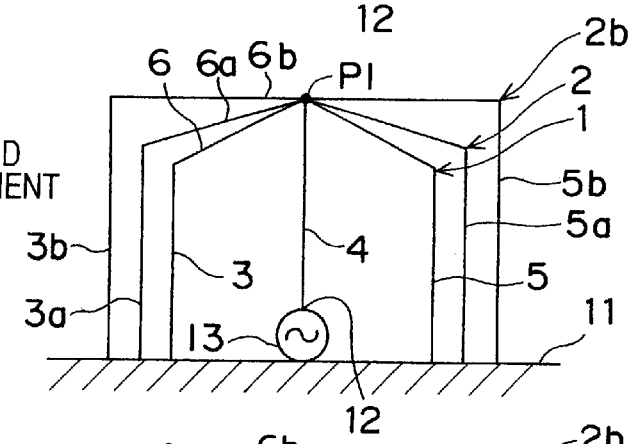
FIG. 23B is a perspective view showing a construction of an M-shaped antenna apparatus according to an eleventh modified preferred embodiment modified from the fifth preferred embodiment.

FIG. 23B is a perspective view showing a construction of an M-shaped antenna apparatus according to an eleventh modified preferred embodiment modified from the fifth preferred embodiment. This antenna apparatus is characterized in that the radiation conductors 4*a* and 4*b* of the fifth preferred embodiment are not formed. In this case, the center portions of the transmission conductors 6, 6*a* and 6*b* are all connected to the connection point P1, and all of the three M-shaped antenna elements 1, 2 and 2*b* use the radiation conductor 4.

Twelfth Modified Preferred Embodiment

Figure 23C:
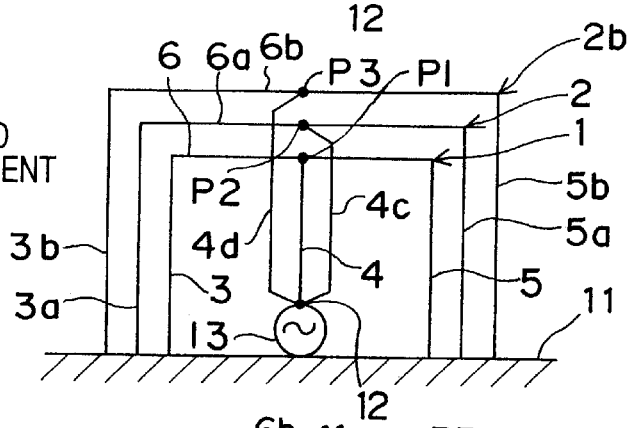
FIG. 23C is a perspective view showing a construction of an M-shaped antenna apparatus according to a twelfth modified preferred embodiment modified from the fifth preferred embodiment.

FIG. 23C is a perspective view showing a construction of an M-shaped antenna apparatus according to a twelfth modified preferred embodiment modified from the fifth preferred embodiment. This antenna apparatus is characterized in that a radiation conductor 4*c* is provided in place of the radiation conductor 4*a* of the fifth preferred embodiment, and a radiation conductor 4*d* is provided in place of the radiation conductor 4*b* of the fifth preferred embodiment. In this case, one end of the radiation conductor 4*c* is connected to the connection point P2, while the other end of the radiation conductor 4*c* is connected directly to the feeding point 12. One end of the radiation conductor 4*d* is connected to the connection point P3, while the other end of the radiation conductor 4*d* is connected directly to the feeding point 12. It is to be noted that the radiation conductors 4*c* and 4*d* are electrically insulated from the transmission conductors 6, 6*a* and 6*b*.

Thirteenth Modified Preferred Embodiment

Figure 23D:
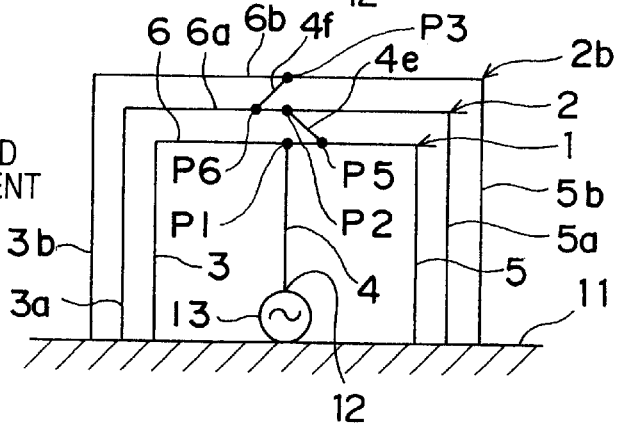
FIG. 23D is a perspective view showing a construction of an M-shaped antenna apparatus according to a thirteenth modified preferred embodiment modified from the fifth preferred embodiment.
Figure 24:
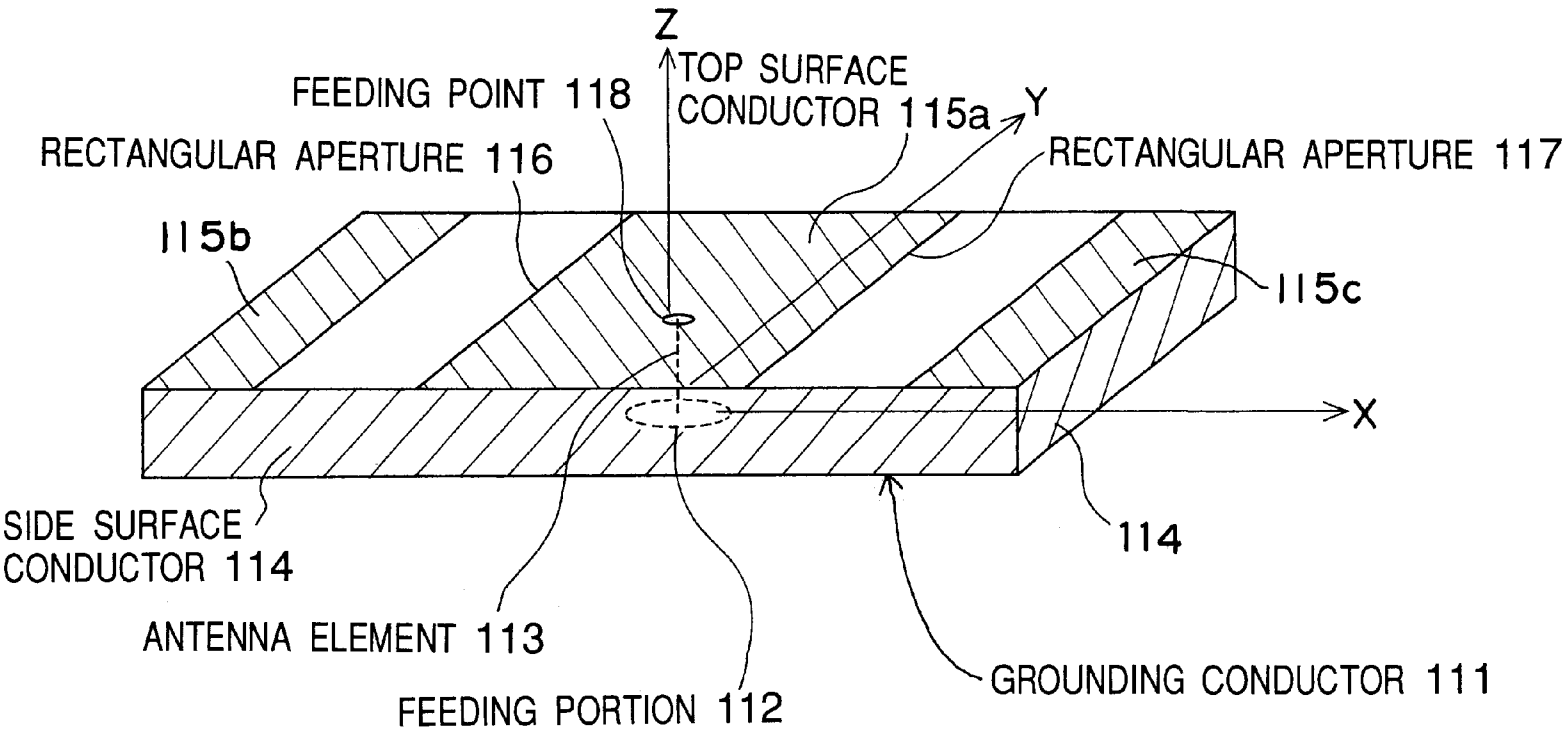
Fig.24 PRIOR ART
FIG. 24 is a perspective view showing a construction of a prior art antenna apparatus capable of operating at a plurality of frequencies.
Figure 25:
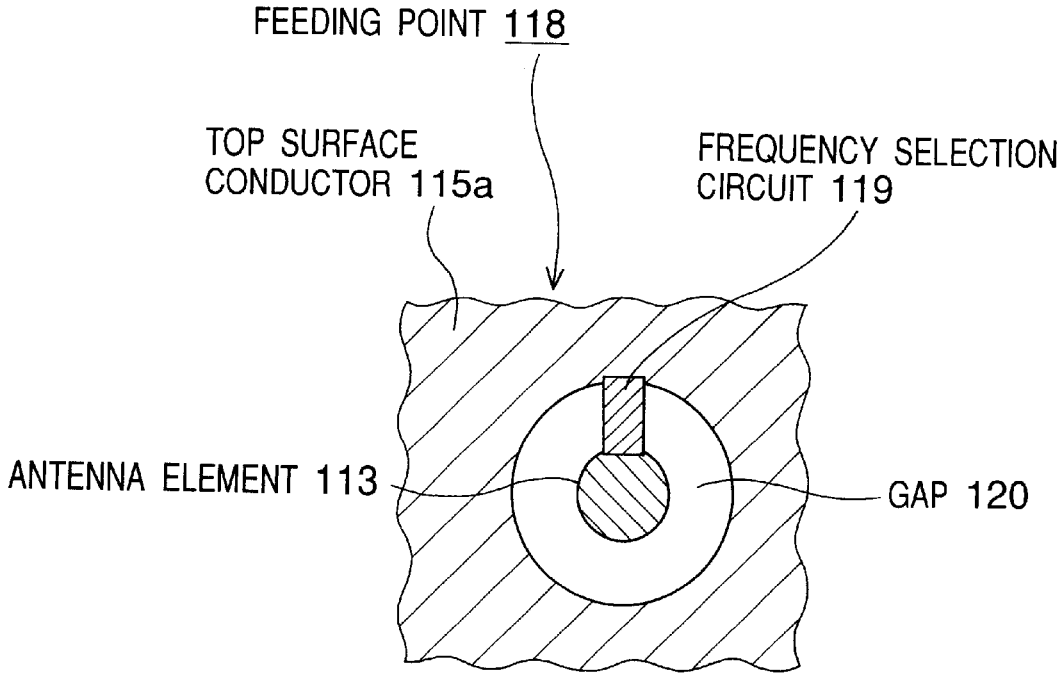
Fig.25 PRIOR ART
FIG. 25 is an enlarged plan view showing a detailed construction of the antenna element 113 and its peripheries of FIG. 24.
Figure 26:
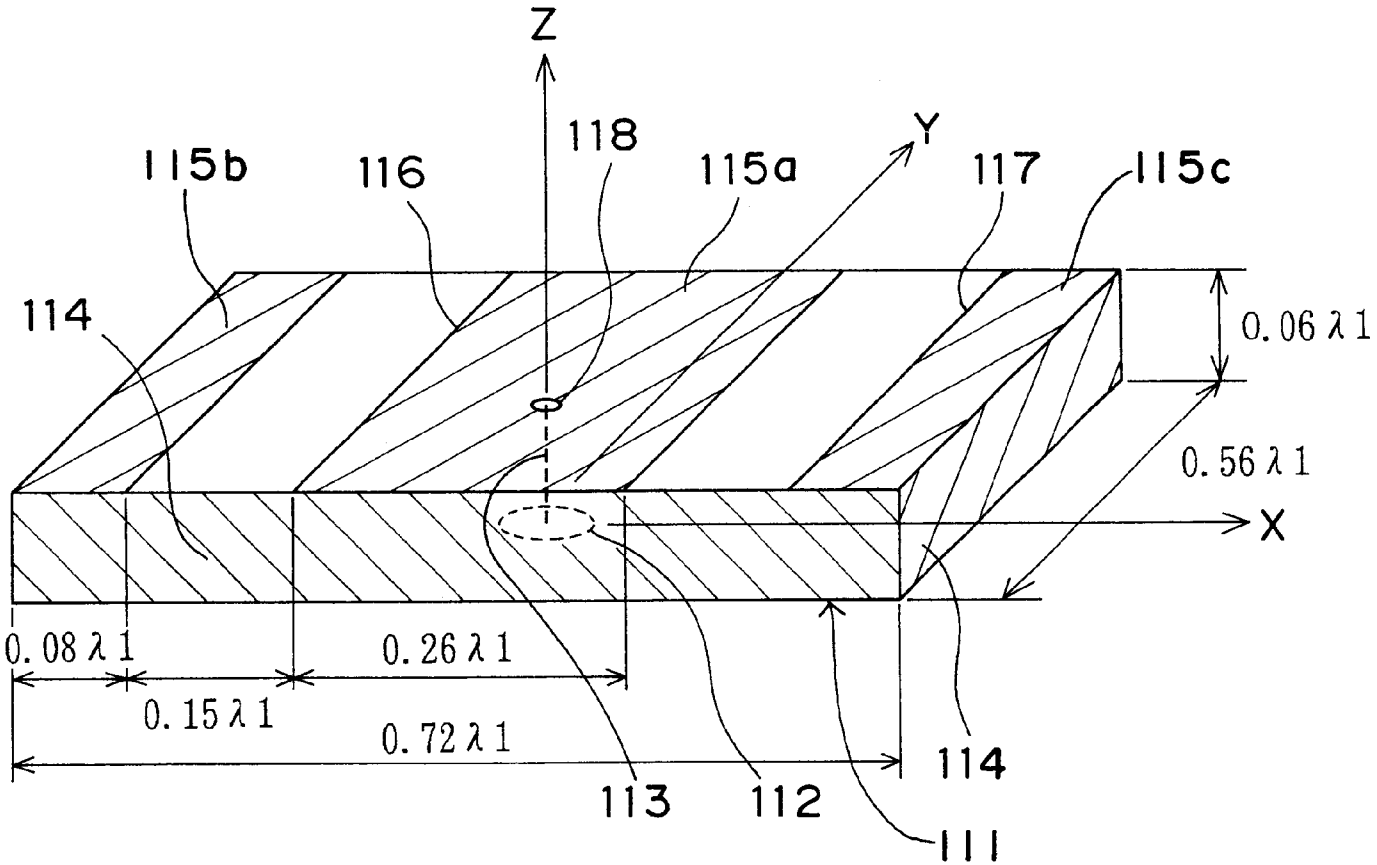
Fig.26 PRIOR ART
FIG. 26 is a perspective view showing a construction of one implemental example of the antenna apparatus of FIG. 24.
Figure 27A:
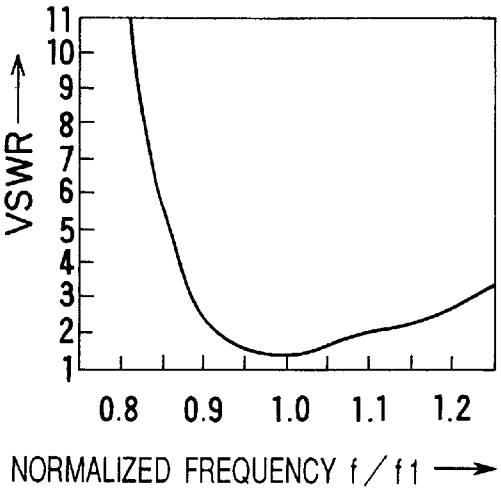
Fig.27A PRIOR ART
FIG. 27A is a graph showing a voltage standing wave ratio (VSWR) characteristic with respect to the normalized frequency f/f1 of the first antenna element when a frequency selection circuit 119 is replaced by a short-circuit conductor in the antenna apparatus of the implemental example of FIG. 26.
Figure 27B:
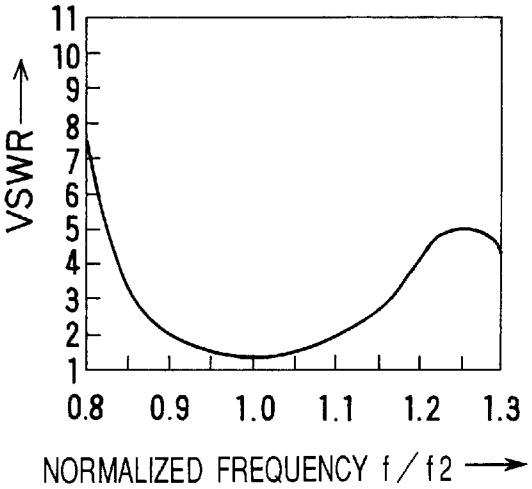
Fig.27B PRIOR ART
FIG. 27B is a graph showing a voltage standing wave ratio (VSWR) characteristic with respect to the normalized frequency f/f2 of the second antenna element when the frequency selection circuit 119 is put into an open state in the antenna apparatus of the implemental example of FIG. 26.
Figure 27C:
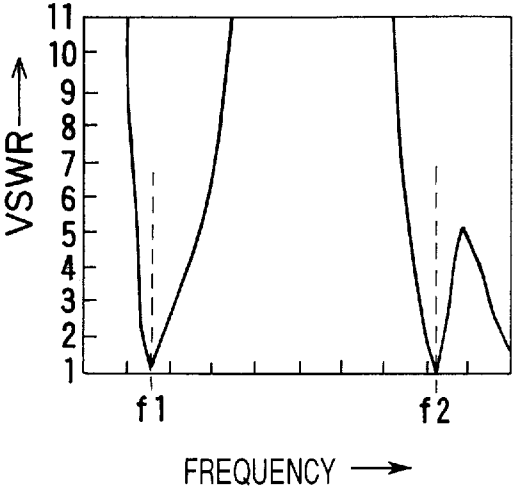
Fig.27C PRIOR ART
FIG. 27C is a graph showing a voltage standing wave ratio (VSWR) characteristic with respect to the frequency of the antenna apparatus provided with the frequency selection circuit 119 in the antenna apparatus of the implemental example of FIG. 26.
Figure 28A:
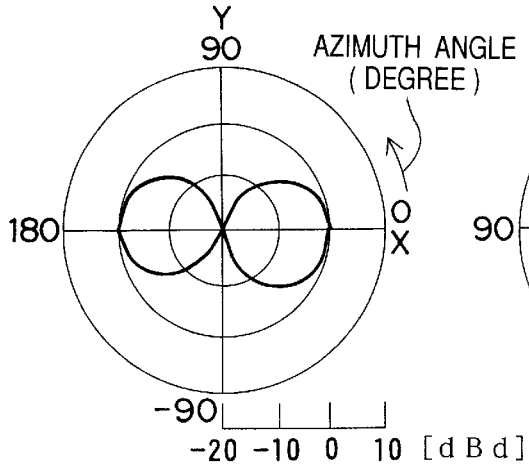
Fig.28A PRIOR ART
FIG. 28A is a graph showing a directivity characteristic on the horizontal plane of the frequency f1 in the antenna apparatus of FIG. 26.
Figure 28B:
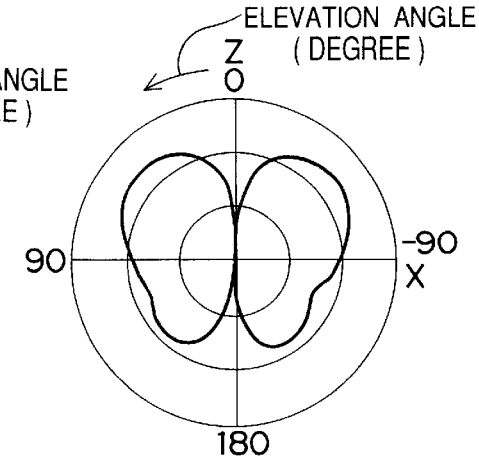
Fig.28B PRIOR ART
FIG. 28B is a graph showing a directivity characteristic on the vertical plane of the frequency f1 in the antenna apparatus of FIG. 26.
Figure 29A:
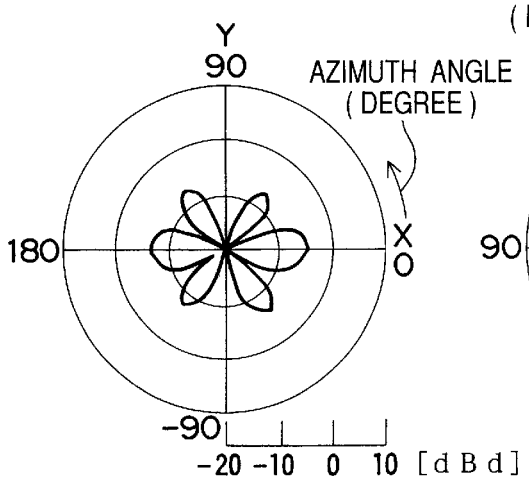
Fig.29A PRIOR ART
FIG. 29A is a graph showing a directivity characteristic on the horizontal plane of the frequency f2 in the antenna apparatus of FIG. 26.
Figure 29B:
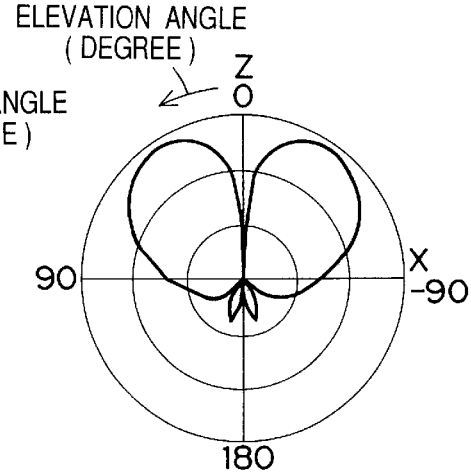
Fig.29B PRIOR ART
FIG. 29B is a graph showing a directivity characteristic on the vertical plane of the frequency f2 in the antenna apparatus of FIG. 26.
Figure 30:
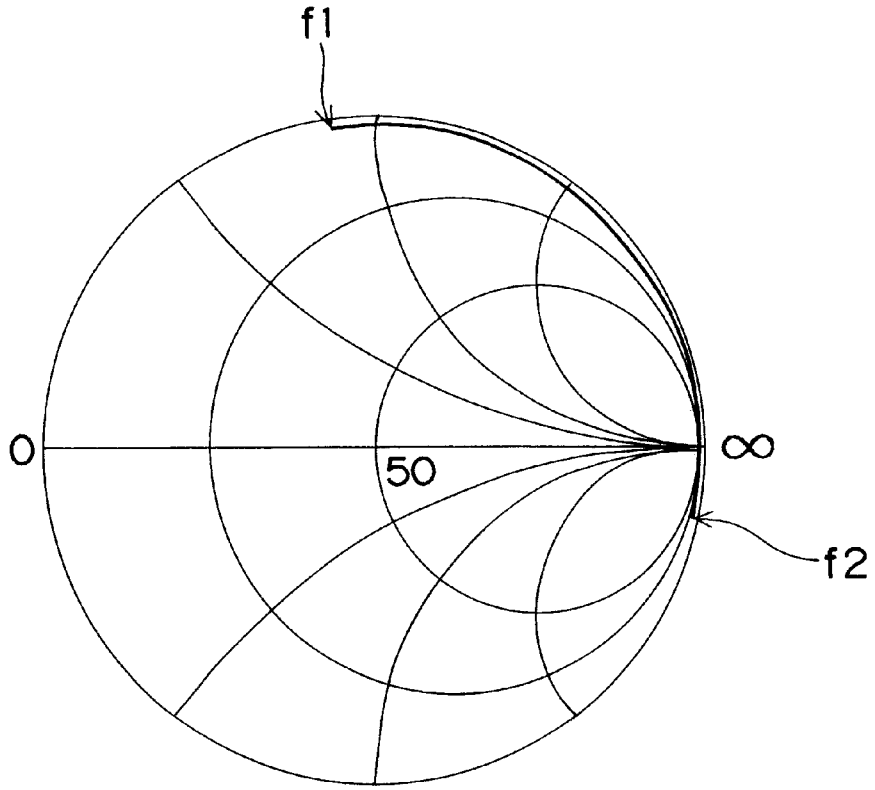
Fig.30 PRIOR ART
FIG. 30 is a Smith chart showing a frequency characteristic of the impedance of the frequency selection circuit 119 of FIG. 26.

FIG. 23D is a perspective view showing a construction of an M-shaped antenna apparatus according to a thirteenth modified preferred embodiment modified from the fifth preferred embodiment. In the fifth preferred embodiment, the radiation conductor 4*a* is connected to a point between the connection point P2 and the connection point P1, and the radiation conductor 4*b* is connected to a point between the connection point P3 and the connection point P2. In the thirteenth modified preferred embodiment, a radiation conductor 4*e* is provided in place of the radiation conductor 4*a*, and a radiation conductor 4*f* is provided in place of the radiation conductor 4*b*. In this case, one end of the radiation conductor 4*e* is connected to the connection point P2, while the other end of the radiation conductor 4*e* is connected to the connection point P5 located between the connection point P1 and the one end or the other end of the transmission conductor 6. One end of the radiation conductor 4*f* is connected to the connection point P3, while the other end of the radiation conductor 4*f* is connected to a connection point P6 located between the connection point P2 and the one end or the other end of the transmission conductor 6*a*. In this case, the input impedance of the M-shaped antenna apparatus can be adjusted by moving the positions of the connection points P5 and P6, respectively, on the transmission conductors 6 and 6*a*.

Modified Implemental Example of Second Implemental Example

Figure 31:
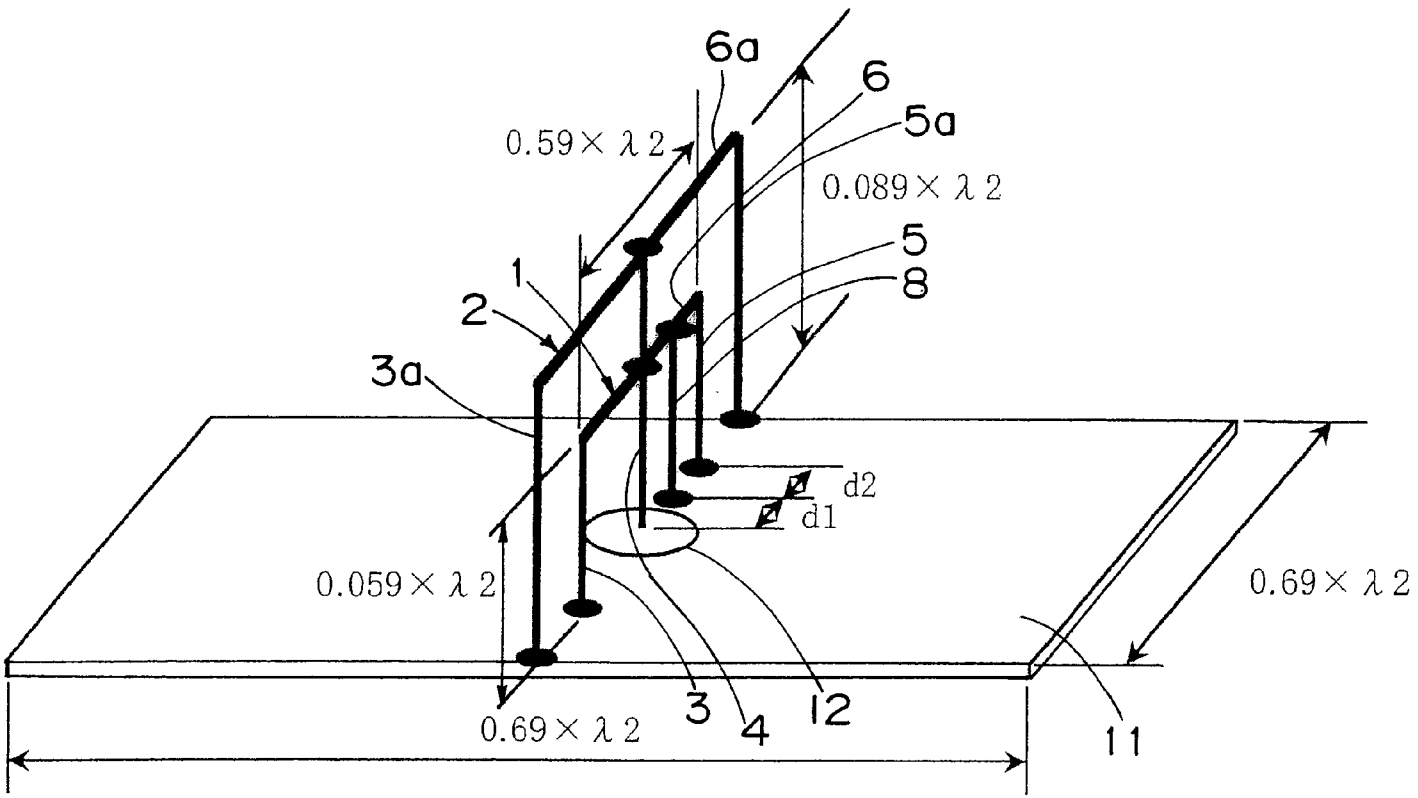
FIG. 31 is a perspective view showing a construction of an M-shaped antenna apparatus according to a modified implemental example of the second implemental example of the present invention.

FIG. 31 is a perspective view showing a construction of an M-shaped antenna apparatus according to a modified implemental example of the second implemental example of the present invention. This modified implemental example of the second implemental example is characterized in that, when a distance d1 between the center of the feeding portion 12 (one end located on the feeding portion side of the radiation conductor 4) and one end located on the grounding conductor 11 side of the matching conductor 8 and a distance d2 between the one end located on the grounding conductor 11 side of the matching conductor 8 and the one end located on the grounding conductor side of the radiation conductor 5 are varied in this modified implemental example of the second implemental example, a reflection coefficient $S_{11}$ at the frequency f1 and a reflection coefficient $S_{11}$ at the frequency f2 are measured in the feeding portion 12 of the M-shaped antenna apparatus, and the optimum setting values of the distances d1 and d2 are obtained. Table 1 shows a reflection coefficient $S_{11}$ in this case. It is to be noted that the distances d1 and d2 are expressed by using the wavelength λ2 corresponding to the frequency f2 as a unit and set according to the following equation (5) in this case.

$$d1+d2=0.3\times\lambda 2 \quad (5)$$

TABLE 1

| Distance d1 [Wavelength] | Distance d2 [Wavelength] | Reflection Coefficient $S_{11}$ at Frequency f1 [dB] | Reflection Coefficient $S_{11}$ at Frequency f2 [dB] |
|---|---|---|---|
| 0.010 | 0.290 | −1.6 | −6.7 |
| 0.025 | 0.275 | −9.0 | −33.8 |
| 0.035 | 0.265 | −11.4 | −24.9 |
| 0.050 | 0.250 | −14.8 | −20.2 |

TABLE 1-continued

| Distance d1 [Wavelength] | Distance d2 [Wavelength] | Reflection Coefficient $S_{11}$ at Frequency f1 [dB] | Reflection Coefficient $S_{11}$ at Frequency f2 [dB] |
|---|---|---|---|
| 0.100 | 0.200 | −37.3 | −14.3 |
| 0.150 | 0.150 | −21.5 | −11.7 |
| 0.200 | 0.100 | −16.0 | −10.0 |
| 0.250 | 0.050 | −13.3 | −8.0 |
| 0.275 | 0.025 | −12.3 | −6.8 |

It is assumed that the optimum setting values are obtained when the reflection coefficient $S_{11}$ becomes equal to or smaller than −10 dB at both the frequencies f1 and f2 in Table 1, then the distances d1 and d2 fall within the range of the following equations (6) and (7).

$$0.035\times\lambda 2 \leqq d1 \leqq 0.200\times\lambda 2 \quad (6)$$

$$0.265\times\lambda 2 \leqq d2 \leqq 0.100\times\lambda 2 \quad (7)$$

If the distances d1 and d2 are selectively set as described above, then the M-shaped antenna apparatus can operate at or below −10 dB when the reflection coefficient $S_{11}$ is within the frequency range of f1 to f2.

Sixth Preferred Embodiment

Figure 32:
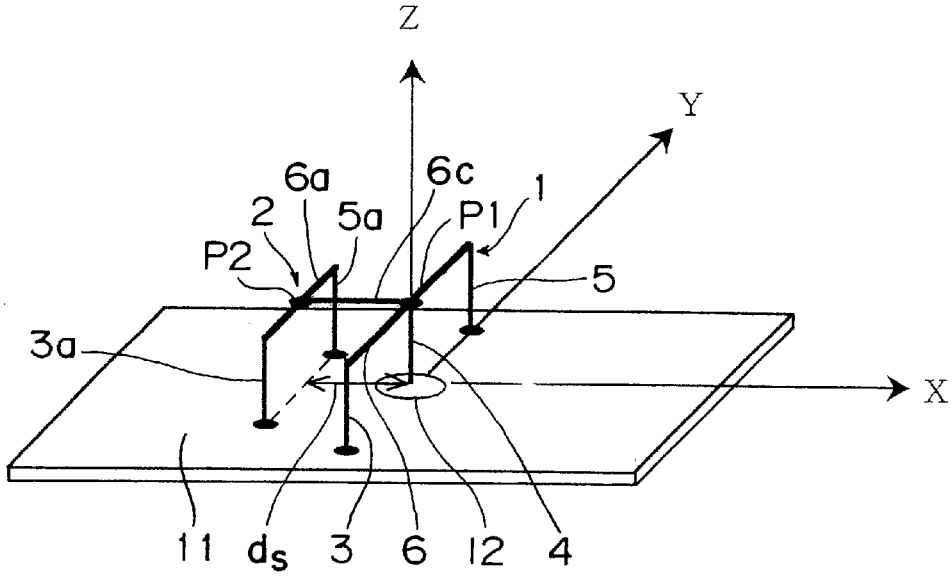
FIG. 32 is a perspective view showing a construction of an M-shaped antenna apparatus according to a sixth preferred embodiment of the present invention.

FIG. 32 is a perspective view showing a construction of an M-shaped antenna apparatus according to a sixth preferred embodiment of the present invention. In the aforementioned first to fifth preferred embodiments and the implemental examples and modified implemental examples thereof, the plurality of M-shaped antenna elements 1, 2 and 2*b* are formed on an identical plane of, for example, the Y-Z plane. In the sixth to fourteenth preferred embodiments described hereinbelow, the plurality of M-shaped antenna elements 1, 2 and 2*b* are characterized in that they are parallel to the flat plane of, for example, the Y-Z plane and formed on planes different from each other.

Figure 33:
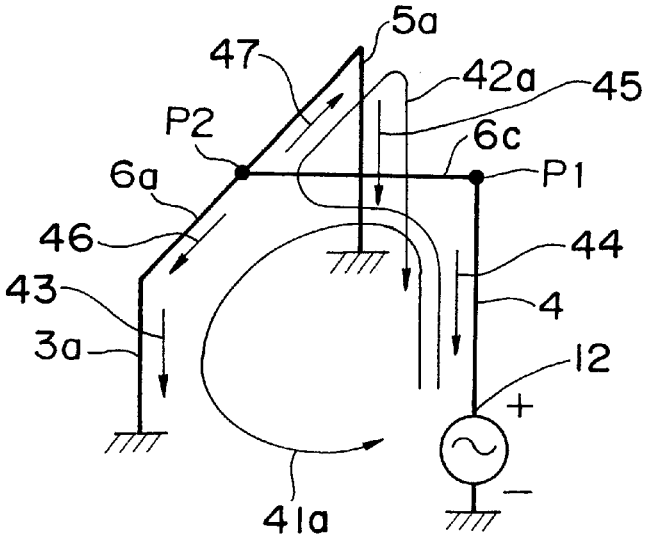
FIG. 33 is a schematic perspective view showing an operation of only the M-shaped antenna element 2 in the M-shaped antenna apparatus of FIG. 32.

Referring to FIG. 32, there is formed an M-shaped antenna element 1, which is provided with radiation conductors 3, 4 and 5 and a transmission conductor 6 on the Y-Z plane and has a construction similar to that of the first preferred embodiment. There is formed an M-shaped antenna element 2, which is provided with radiation conductors 3*a* and 5*a* and a transmission conductor 6*a* on a plane parallel to the Y-Z plane that is extended in the -X-direction from the Y-Z plane and separated apart by a specified distance ds and has a construction similar to that of the first preferred embodiment. In this case, there is formed a transmission conductor 6*c*, which is extended so as to be parallel to the X-Y plane from the connection point P1 that is the center point of the transmission conductor 6 and is connected to the connection point P2 that is the center point of the transmission conductor 6*a*. It is to be noted that the transmission conductor 6*c* is parallel to the X-axis direction, and the length of the transmission conductor 6*a* is set shorter than the length of the transmission conductor 6. The length of the antenna extended from the feeding point 12 of the M-shaped antenna element 1 via the radiation conductor 4, the transmission conductor 6 and the radiation conductor 3 to the feeding point 12 and the length of the antenna extended from the feeding point 12 of the M-shaped antenna element 1 via the radiation conductor 4, the transmission conductor 6 and the radiation conductor 5 to the feeding point 12 are set so as to become an integral multiple of the half-wavelength of the frequency f1. On the other hand, as shown in FIG. 33 that indicates a current distribution by arrows 43 to 47 in the M-shaped antenna element 2, the length of a loop circuit indicated by the arrow 41*a* looping from the feeding portion 12 via the radiation conductor 4, the transmission conductor 6*c*, the transmission conductor 6*a* and the radiation conductor 3*a* back to the feeding portion 12 is set so as to become an integral multiple of the half-wavelength of the frequency f2, and the length of a loop circuit indicated by the arrow 42*a* looping from the feeding portion 12 via the radiation conductor 4, the transmission conductor 6*c*, the transmission conductor 6*a* and the radiation conductor 5*a* back to the feeding portion 12 is set so as to become an integral multiple of the half-wavelength of the frequency f2.

According to the M-shaped antenna apparatus constructed as above, there is constituted a dual-frequency antenna apparatus in which the one M-shaped antenna element 1 operates at the frequency f1 and the other M-shaped antenna element 2 operates at the frequency f2, and the antenna apparatus has a bilateral directivity characteristic similar to that of the first preferred embodiment. However, the transmission conductor 6 and the transmission conductor 6*a* have different lengths, and therefore, the M-shaped antenna element 1, which has the resonance frequency f1, has a narrower beam of a higher gain in the direction toward the M-shaped antenna element 2 that operates as a pseudo-waveguide in comparison with the directivity characteristic of the first preferred embodiment and has a directivity characteristic similar to that of the first preferred embodiment in the direction opposite to the M-shaped antenna element 2. The M-shaped antenna element 2, which has the resonance frequency f2, has a narrower beam of a lower gain in the direction toward the M-shaped antenna element 1 that operates as a pseudo-reflector in comparison with the directivity characteristic of the first preferred embodiment and has a directivity characteristic similar to that of the first preferred embodiment in the direction opposite to the M-shaped antenna element 1. Therefore, the M-shaped antenna apparatus has an asymmetrical bilateral directivity characteristic as a whole.

Seventh Preferred Embodiment

Figure 34:
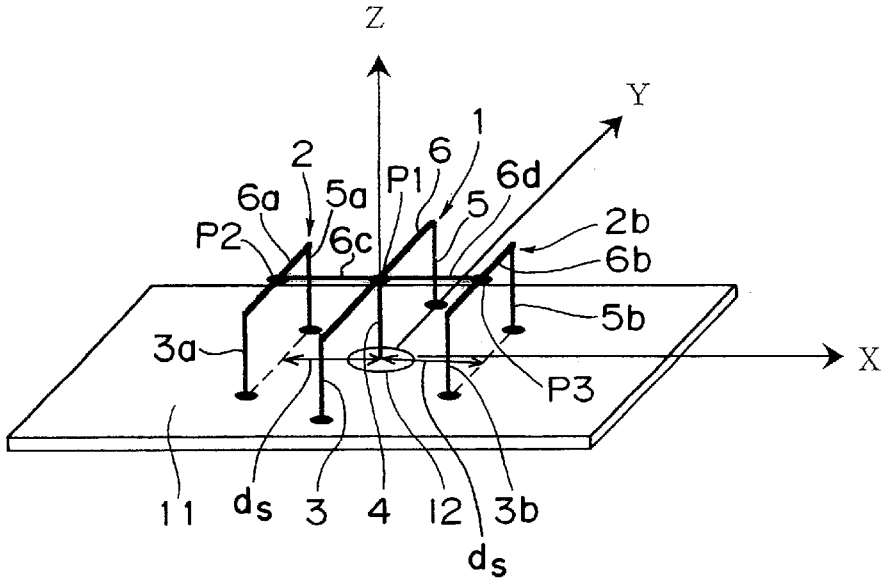
FIG. 34 is a perspective view showing a construction of an M-shaped antenna apparatus according to a seventh preferred embodiment of the present invention.

FIG. 34 is a perspective view showing a construction of an M-shaped antenna apparatus according to a seventh preferred embodiment of the present invention. The M-shaped antenna apparatus of this seventh preferred embodiment is characterized in that radiation conductors 3*b* and 5*b* and a transmission conductor 6*b* are provided on a plane that is extended in the X-direction from the Y-Z plane, separated apart by a specified distance ds and in parallel to the Y-Z plane in comparison with the M-shaped antenna apparatus of the sixth preferred embodiment, forming an M-shaped antenna element 2*b* that has a construction similar to that of the M-shaped antenna element 2.

Referring to FIG. 34, the transmission conductor 6*b* has a length equal to that of the transmission conductor 6*a*, and the connection point P3 that is the center point of the transmission conductor 6*b* is connected to the connection point P1 that is the center point of the transmission conductor 6 via a transmission conductor 6*d* that has a length equal to that of the transmission conductor 6*c* and is extended so as to be parallel to the X-axis direction. In this case, the M-shaped antenna element 2*b* is set so that the length of a loop circuit looping from the feeding portion 12 via the radiation conductor 4, the transmission conductor 6*d*, the transmission conductor 6*b* and the radiation conductor 3*b* back to the feeding portion 12 becomes an integral multiple of the half-wavelength of the frequency f2, and the length of a loop circuit looping from the feeding portion 12 via the radiation conductor 4, the transmission conductor 6*d*, the transmission conductor 6*b* and the radiation conductor 5*b* back to the feeding portion 12 becomes an integral multiple of the half-wavelength of the frequency f2.

According to the M-shaped antenna apparatus constructed as above, there is constituted a dual-frequency antenna apparatus in which the one M-shaped antenna element 1 operates at the frequency f1 and the other M-shaped antenna elements 2 and 2*b* operate at the frequency f2, and the antenna apparatus has a bilateral directivity characteristic similar to that of the first preferred embodiment. However, the transmission conductor 6 and the transmission conductors 6*a* and 6*b* have different lengths, and therefore, the M-shaped antenna element 1, which has the resonance frequency f1, has a narrower beam of a higher gain in the direction toward the M-shaped antenna elements 2 and 2*b* that operate as a pseudo-waveguide in comparison with the directivity characteristic of the first preferred embodiment. The M-shaped antenna elements 2 and 2*a*, which have the resonance frequency f2, have a narrower beam of a lower gain in the direction toward the M-shaped antenna element 1 that operates as a pseudo-reflector in comparison with the directivity characteristic of the first preferred embodiment and have a directivity characteristic similar to that of the first preferred embodiment in the direction opposite to the M-shaped antenna element 1. Therefore, the M-shaped antenna apparatus has a symmetrical bilateral directivity characteristic as a whole.

Eighth Preferred Embodiment

Figure 35:
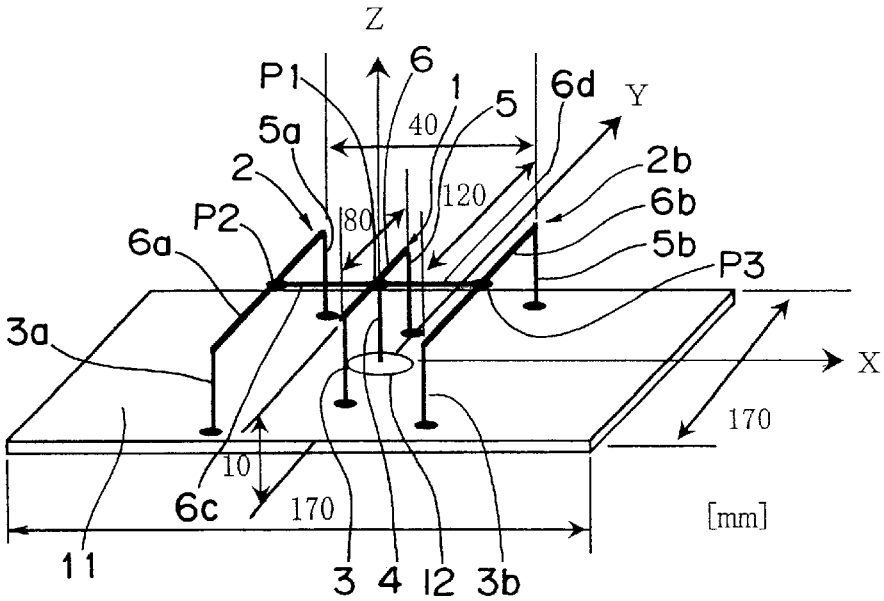
FIG. 35 is a perspective view showing a construction of an M-shaped antenna apparatus according to an eighth preferred embodiment of the present invention.

FIG. 35 is a perspective view showing a construction of an M-shaped antenna apparatus according to an eighth preferred embodiment of the present invention. The M-shaped antenna apparatus of this eighth preferred embodiment is characterized in that the length of each of the transmission conductors 6*a* and 6*b* is set so as to be longer than the length of the transmission conductor 6 in comparison with the M-shaped antenna apparatus of the seventh preferred embodiment. In this case, the M-shaped antenna element 1 has the resonance frequency f1, while both the M-shaped antenna elements 2 and 2*b* have the resonance frequency f2. The M-shaped antenna apparatus has a structure symmetrical with respect to the Y-Z plane as a whole in a manner similar to that of the seventh preferred embodiment and has a symmetrical bilateral directivity characteristic as a whole. The lengths of the conductors are each indicated by a measurement unit (in millimeters) as shown in FIG. 35.

Figure 36:
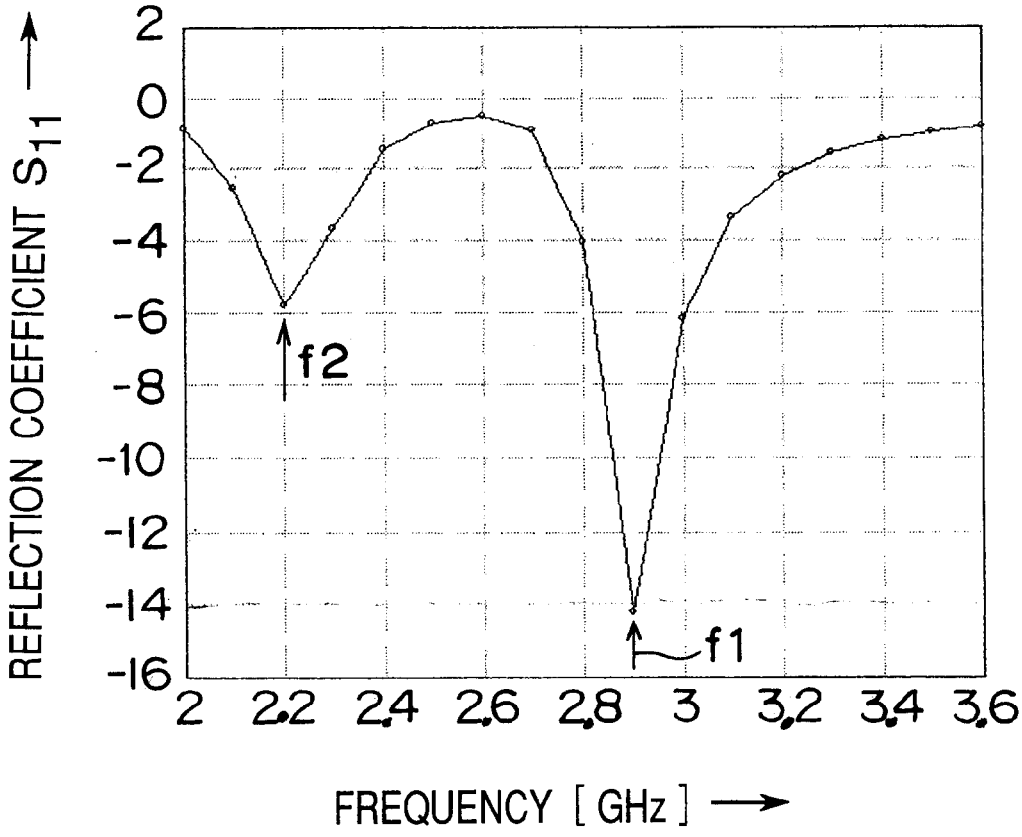
FIG. 36 is a graph showing a frequency characteristic of a reflection coefficient $S_{11}$ of the M-shaped antenna apparatus of FIG. 35.

FIG. 36 is a graph showing a frequency characteristic of the reflection coefficient $S_{11}$ of the M-shaped antenna apparatus of FIG. 35. As is apparent from FIG. 36, the reflection coefficient $S_{11}$ of the M-shaped antenna apparatus has a minimum point at the resonance frequency f1=about 2.9 GHz of the M-shaped antenna element 1 and has a minimum point at the resonance frequency f2=about 2.2 GHz of the M-shaped antenna elements 2 and 2*b*. This fact therefore means that the M-shaped antenna apparatus can operate at the two frequencies f1 and f2.

Ninth Preferred Embodiment

Figure 37:
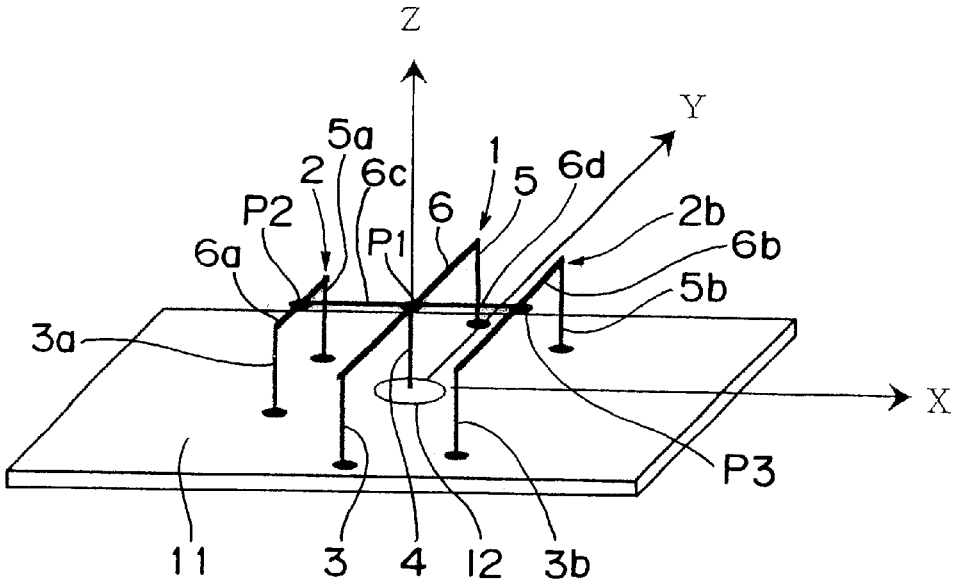
FIG. 37 is a perspective view showing a construction of an M-shaped antenna apparatus according to a ninth preferred embodiment of the present invention.

FIG. 37 is a perspective view showing a construction of an M-shaped antenna apparatus according to a ninth preferred embodiment of the present invention. The M-shaped antenna apparatus of this ninth preferred embodiment is characterized in that three resonance frequencies f1, f2 and f3 are provided by the setting that the lengths of the transmission conductors 6, 6*a* and 6*b* differ from each other and the length of the loop circuits of the M-shaped antenna elements 1, 2 and 2*b* differ from each other in comparison with the seventh and eighth preferred embodiments.

Referring to FIG. 37, the lengths of the transmission conductors 6, 6*a* and 6*b* are set so as to be parallel to each other in the Y-axis direction and different from each other. The M-shaped antenna element 1 is set so that the length of a loop circuit looping from the feeding portion 12 via the radiation conductor 4, the transmission conductor 6 and the radiation conductor 3 back to the feeding portion 12 becomes an integral multiple of the half-wavelength of the frequency f1, and the length of a loop circuit looping from the feeding portion 12 via the radiation conductor 4, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the transmission conductor 6*c*, the transmission conductor 6*a* and the radiation conductor 3*a* back to the feeding portion 12 become an integral multiple of the half-wavelength of the frequency f2, and the length of a loop circuit looping from the feeding portion 12 via the radiation conductor 4, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the transmission conductor 6*d*, the transmission conductor 6*b* and the radiation conductor 3*b* back to the feeding portion 12 become an integral multiple of the half-wavelength of the frequency f3, and the length of a loop circuit looping from the feeding portion 12 via the radiation conductor 4, the transmission conductor 6*d*, the transmission conductor 6*b* and the radiation conductor 5*b* back to the feeding portion 12 becomes an integral multiple of the half-wavelength of the frequency f3.

The M-shaped antenna apparatus constructed as above can operate at the three resonance frequencies f1, f2 and f3. The antenna apparatus has an asymmetrical structure with respect to the Y-Z plane as a whole, and therefore, it has an asymmetrical bilateral directivity characteristic as a whole. Moreover, the transmission conductors 6, 6*a* and 6*b*, which are different from each other, has the particular advantageous effect that the FB ratio, which is the ratio of the front gain to the back gain (X-axis direction or -X-axis direction), can be changed by the M-shaped antenna elements 1, 2 and 2*b*.

Tenth Preferred Embodiment

Figure 38:
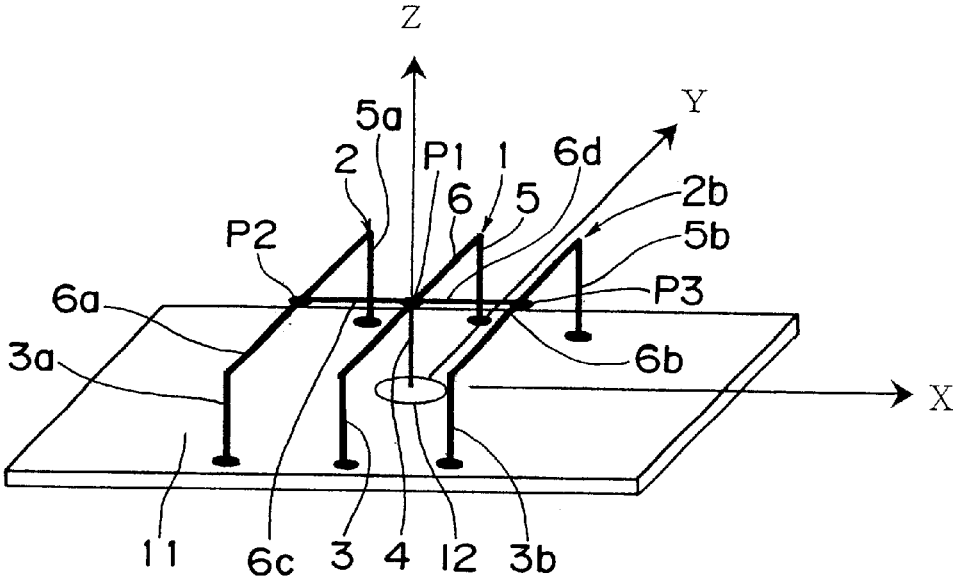
FIG. 38 is a perspective view showing a construction of an M-shaped antenna apparatus according to a tenth preferred embodiment of the present invention.

FIG. 38 is a perspective view showing a construction of an M-shaped antenna apparatus according to a tenth preferred embodiment of the present invention. The M-shaped antenna apparatus of this tenth preferred embodiment is characterized in that two resonance frequencies f1 and f2 are provided by the setting that the lengths of the transmission conductors 6, 6*a* and 6*b* are equal to each other and the lengths of the loop circuits of the M-shaped antenna element 1 and the M-shaped antenna elements 2 and 2*b* differ from each other in comparison with the ninth preferred embodiment.

Referring to FIG. 38, the lengths of the transmission conductors 6, 6*a* and 6*b* are set so as to be parallel to each other in the Y-axis direction and equal to each other. The M-shaped antenna element 1 is set so that the length of a loop circuit looping from the feeding portion 12 via the radiation conductor 4, the transmission conductor 6 and the radiation conductor 3 back to the feeding portion 12 become an integral multiple of the half-wavelength of the frequency f1, and the length of a loop circuit looping from the feeding portion 12 via the radiation conductor 4, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the transmission conductor 6*c*, the transmission conductor 6*a* and the radiation conductor 3*a* back to the feeding portion 12 becomes an integral multiple of the half-wavelength of the frequency f2, and the length of a loop circuit looping from the feeding portion 12 via the radiation conductor 4, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the transmission conductor 6*d*, the transmission conductor 6*b* and the radiation conductor 3*b* back to the feeding portion 12 become an integral multiple of the half-wavelength of the frequency f2, and the length of a loop circuit looping from the feeding portion 12 via the radiation conductor 4, the transmission conductor 6*d*, the transmission conductor 6*b* and the radiation conductor 5*b* back to the feeding portion 12 becomes an integral multiple of the half-wavelength of the frequency f2.

The M-shaped antenna apparatus constructed as above can operate at the two resonance frequencies f1 and f2. The antenna apparatus has a structure symmetrical with respect to the Y-Z plane as a whole, and therefore, it has a symmetrical bilateral directivity characteristic as a whole.

The M-shaped antenna apparatus constructed as above has the advantages that the conductors can be formed on the rectangular parallelepiped dielectric body 31, the dielectric substrate and the like by a simple method and the manufacturing method is extremely simple as described in connection with the third and fourth preferred embodiments.

In the aforementioned preferred embodiments, the lengths of the transmission conductor 6*c* and the transmission conductor 6*d* are set so as to be equal to each other. However, the present invention is not limited to this, and it is acceptable to set the lengths of the transmission conductor 6*c* and the transmission conductor 6*d* different from each other.

Eleventh Preferred Embodiment

Figure 39:
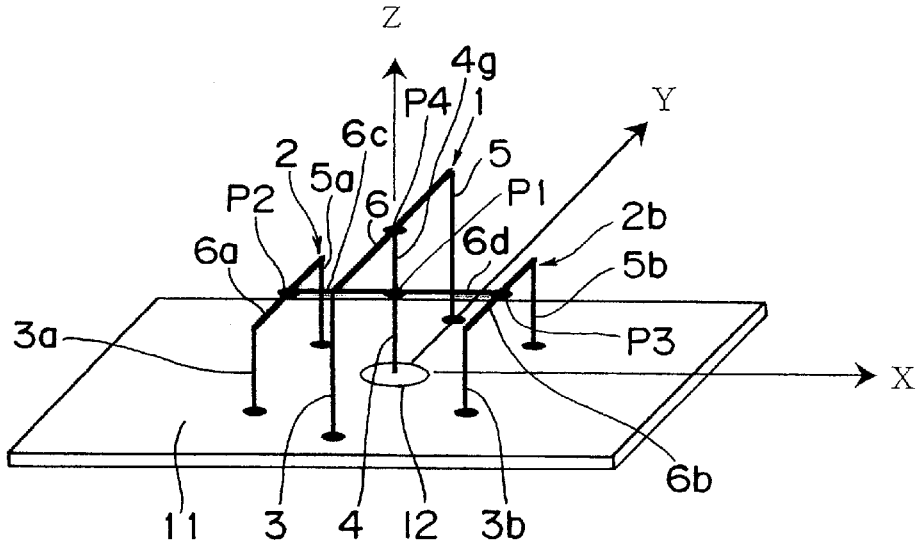
FIG. 39 is a perspective view showing a construction of an M-shaped antenna apparatus according to an eleventh preferred embodiment of the present invention.

FIG. 39 is a perspective view showing a construction of an M-shaped antenna apparatus according to an eleventh preferred embodiment of the present invention. The M-shaped antenna apparatus of this eleventh preferred embodiment is characterized in that M-shaped antenna elements 2 and 2*b* having a construction similar to that of the M-shaped antenna elements 2 and 2*b* of the seventh preferred embodiment are provided, the M-shaped antenna element 1 is formed on the Y-Z plane, and the lengths of the radiation conductors 3 and 5 of the M-shaped antenna element 1 are each set so as to be longer than the equal length of the radiation conductors 3*a*, 5*a*, 3*b* and 5*b* of the other M-shaped antenna elements 2 and 2*b*.

Referring to FIG. 39, one end of the radiation conductor 4 is connected to the feeding portion 12, while the other end is connected to the connection point P1 of the transmission conductor 6*c* and the transmission conductor 6*d*. The radiation conductor 4*g* of the M-shaped antenna element 1 is extended in the Z-axis direction from this connection point P1 and connected to the connection point P4 that is the center point of the transmission conductor 6. Moreover, the lengths of the radiation conductors 3 and 5 of the M-shaped antenna element 1 are each set so as to be longer than the length of each of the radiation conductors 3*a*, 5*a*, 3*b* and 5*b* of the other M-shaped antenna elements 2 and 2*b*, and the height of the M-shaped antenna element 1 is higher than the equal height of the M-shaped antenna elements 2 and 2*b*.

The M-shaped antenna element 1 is set so that the length of a loop circuit looping from the feeding portion 12 via the radiation conductor 4, the radiation conductor 4*g*, the transmission conductor 6 and the radiation conductor 3 back to the feeding portion 12 become an integral multiple of the half-wavelength of the frequency f1, and the length of a loop circuit looping from the feeding portion 12 via the radiation conductor 4, the radiation conductor 4*g*, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the transmission conductor 6*c*, the transmission conductor 6*a* and the radiation conductor 3*a* back to the feeding portion 12 becomes an integral multiple of the half-wavelength of the frequency f2, and the length of a loop circuit looping from the feeding portion 12 via the radiation conductor 4, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the transmission conductor 6*d* the transmission conductor 6*b* and the radiation conductor 3*b* back to the feeding portion 12 becomes an integral multiple of the half-wavelength of the frequency f2, and the length of a loop circuit looping from the feeding portion 12 via the radiation conductor 4, the transmission conductor 6*d*, the transmission conductor 6*b* and the radiation conductor 5*b* back to the feeding portion 12 becomes an integral multiple of the half-wavelength of the frequency f2.

The M-shaped antenna apparatus constructed as above can operate at the two resonance frequencies f1 and f2 provided. Moreover, the M-shaped antenna apparatus has a symmetrical directivity characteristic since it has a structure symmetrical with respect to the Y-Z plane. Furthermore, by extending the height from the feeding portion 12 to the transmission conductor 6 using not only the radiation conductor 4 but also the radiation conductor 4*g* in the M-shaped antenna element 1, the impedance of the M-shaped antenna element 1 when seeing from the feeding portion 12 toward the M-shaped antenna element 1 can be increased, and impedance matching can be achieved so that the input impedance of the M-shaped antenna element 1 coincides with the impedance of the transmission line connected to the feeding portion 12 without using the matching conductor 8 of FIG. 15 or the like.

Twelfth Preferred Embodiment

Figure 40:
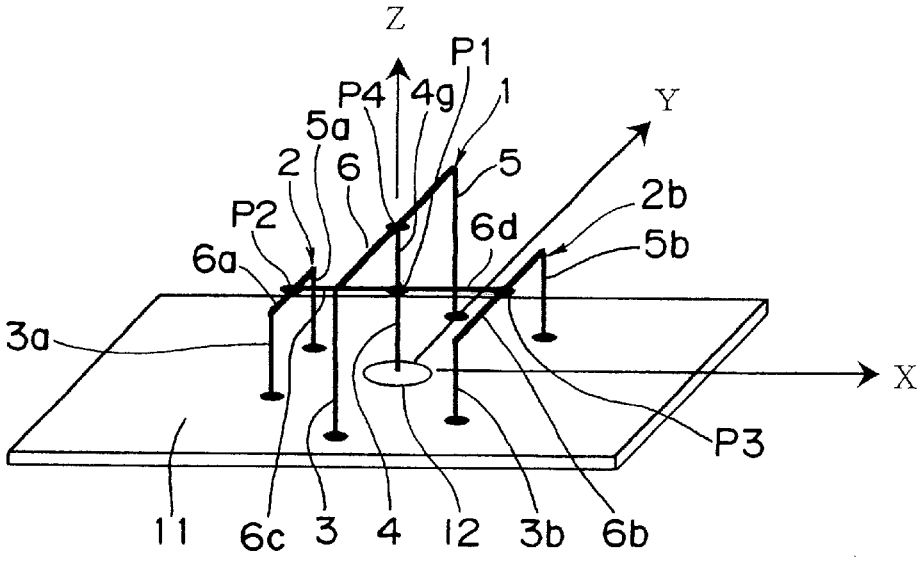
FIG. 40 is a perspective view showing a construction of an M-shaped antenna apparatus according to a twelfth preferred embodiment of the present invention.

FIG. 40 is a perspective view showing a construction of an M-shaped antenna apparatus according to a twelfth preferred embodiment of the present invention. The M-shaped antenna apparatus of this twelfth preferred embodiment is characterized in that the lengths of the transmission conductors 6, 6*a* and 6*b* of the M-shaped antenna elements 1, 2 and 2*b* are set so as to be different from each other according to the following equation (8) in comparison with the M-shaped antenna apparatus of the eleventh preferred embodiment.

(length of transmission conductor 6)>(length of transmission conductor 6*b*)>(length of transmission conductor 6*a*) (8)

The M-shaped antenna element 1 is set so that the length of a loop circuit looping from the feeding portion 12 via the radiation conductor 4, the radiation conductor 4*g*, the transmission conductor 6 and the radiation conductor 3 back to the feeding portion 12 becomes an integral multiple of the half-wavelength of the frequency f1, and the length of a loop circuit looping from the feeding portion 12 via the radiation conductor 4, the radiation conductor 4*g*, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the transmission conductor 6*c*, the transmission conductor 6*a* and the radiation conductor 3*a* back to the feeding portion 12 becomes an integral multiple of the half-wavelength of the frequency f2, and the length of a loop circuit looping from the feeding portion 12 via the radiation conductor 4, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the transmission conductor 6*d*, the transmission conductor 6*b* and the radiation conductor 3*b* back to the feeding portion 12 becomes an integral multiple of the half-wavelength of the frequency f3, and the length of a loop circuit looping from the feeding portion 12 via the radiation conductor 4, the transmission conductor 6*d*, the transmission conductor 6*b* and the radiation conductor 5*b* back to the feeding portion 12 becomes an integral multiple of the half-wavelength of the frequency f3.

The M-shaped antenna apparatus constructed as above can operate at the three resonance frequencies f1, f2 and f3 provided. Moreover, the M-shaped antenna apparatus has an asymmetrical directivity characteristic since it has an asymmetrical structure with respect to the Y-Z plane. Furthermore, by extending the height from the feeding portion 12 to the transmission conductor 6 using not only the radiation conductor 4 but also the radiation conductor 4*g* in the M-shaped antenna element 1, the impedance of the M-shaped antenna element 1 when seeing from the feeding portion 12 to the M-shaped antenna element 1 an be increased, and impedance matching can be achieved so that the input impedance of the M-shaped antenna element 1 coincides with the impedance of the transmission line connected to the feeding portion 12 without using the matching conductor 8 of FIG. 15 or the like.

Thirteenth Preferred Embodiment

Figure 41:
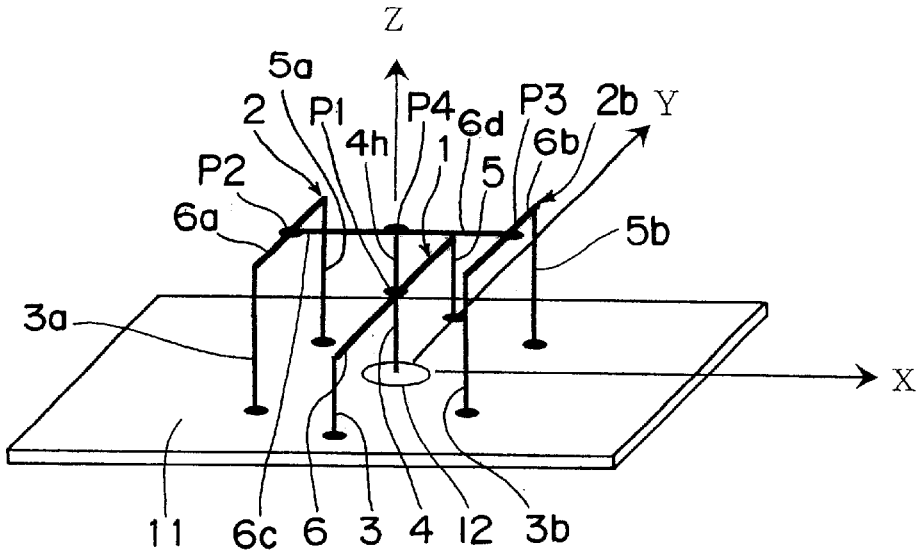
FIG. 41 is a perspective view showing a construction of an M-shaped antenna apparatus according to a thirteenth preferred embodiment of the present invention.

FIG. 41 is a perspective view showing a construction of an M-shaped antenna apparatus according to a thirteenth preferred embodiment of the present invention. The M-shaped antenna apparatus of this thirteenth preferred embodiment is characterized in that an M-shaped antenna element 1 that has a construction similar to that of the M-shaped antenna element 1 of the seventh preferred embodiment is provided and M-shaped antenna elements 2 and 2*b*, which have a construction similar to that of the M-shaped antenna elements 2 and 2*b* of the seventh preferred embodiment and is higher than the height of the M-shaped antenna element 1 are provided.

Referring to FIG. 41, one end of the radiation conductor 4 is connected to the feeding portion 12, while the other end is connected to the connection point P1 that is the center point of the transmission conductor 6. The connection point P1 is connected to the connection point P4 located between the transmission conductor 6*c* and the transmission conductor 6*d* via a radiation conductor 4*h* extended in the Z-axis direction, and the lengths of the transmission conductor 6*c* and the transmission conductor 6*d* are set so as to be equal to each other in this case. The connection point P4 is connected to the connection point P2 that is the center point of the transmission conductor 6*a* via the transmission conductor 6*c* extended in the -X-direction and connected to the connection point P3 that is the center point of the transmission conductor 6*b* via the transmission conductor 6*d* extended in the X-axis direction.

The M-shaped antenna element 1 is set so that the length of a loop circuit looping from the feeding portion 12 via the radiation conductor 4, the transmission conductor 6 and the radiation conductor 3 back to the feeding portion 12 becomes an integral multiple of the half-wavelength of the frequency f1, and the length of a loop circuit looping from the feeding portion 12 via the radiation conductor 4, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the radiation conductor 4*h*, the transmission conductor 6*c*, the transmission conductor 6*a* and the radiation conductor 3*a* back to the feeding portion 12 becomes an integral multiple of the half-wavelength of the frequency f2, and the length of a loop circuit looping from the feeding portion 12 via the radiation conductor 4, the radiation conductor 4*h*, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the radiation conductor 4*h*, the transmission conductor 6*d*, the transmission conductor 6*b* and the radiation conductor 3*b* back to the feeding portion 12 becomes an integral multiple of the half-wavelength of the frequency f2, and the length of a loop circuit looping from the feeding portion 12 via the radiation conductor 4, the radiation conductor 4*h*, the transmission conductor 6*d*, the transmission conductor 6*b* and the radiation conductor 5*b* back to the feeding portion 12 becomes an integral multiple of the half-wavelength of the frequency f2.

The M-shaped antenna apparatus constructed as above can operate at the two resonance frequencies f1 and f2 provided. Moreover, the M-shaped antenna apparatus has a symmetrical directivity characteristic since it has a structure symmetrical with respect to the Y-Z plane. Furthermore, by extending the height from the feeding portion 12 to the transmission conductors 6*a* and 6*b* using not only the radiation conductor 4 but also the radiation conductor 4*h* in the M-shaped antenna elements 2 and 2*b*, the impedances of the M-shaped antenna elements 2 and 2*b* when seeing from the feeding portion 12 toward the M-shaped antenna elements 2 and 2*b* can be increased, and impedance matching can be achieved so that the input impedances of the M-shaped antenna elements 2 and 2*b* coincide with the impedance of the transmission line connected to the feeding portion 12 without using the matching conductor 8 of FIG. 15 or the like.

Fourth Preferred Embodiment

Figure 42:
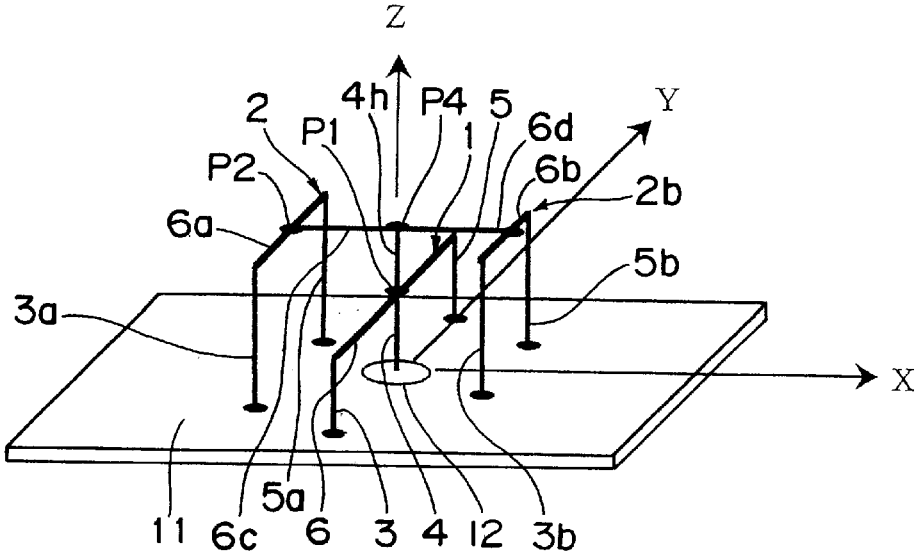
FIG. 42 is a perspective view showing a construction of an M-shaped antenna apparatus according to a fourteenth preferred embodiment of the present invention.

FIG. 42 is a perspective view showing a construction of an M-shaped antenna apparatus according to a fourteenth preferred embodiment of the present invention. The M-shaped antenna apparatus of this fourteenth preferred embodiment is characterized in that the lengths of the transmission conductors 6, 6*a* and 6*b* of the M-shaped antenna elements 1, 2 and 2*b* are set so as to be different from each other according to the following equation (9) in comparison with the M-shaped antenna apparatus of the thirteenth preferred embodiment.

(length of transmission conductor 6)>(length of transmission conductor 6*a*)>(length of transmission conductor 6*b*) (9)

The M-shaped antenna element 1 is set so that the length of a loop circuit looping from the feeding portion 12 via the radiation conductor 4, the transmission conductor 6 and the radiation conductor 3 back to the feeding portion 12 becomes an integral multiple of the half-wavelength of the frequency f1, and the length of a loop circuit looping from the feeding portion 12 via the radiation conductor 4, the transmission conductor 6 and the radiation conductor 5 back to the feeding portion 12 becomes an integral multiple of the half-wavelength of the frequency f1. The M-shaped antenna element 2 is set so that the length of a loop circuit looping from the feeding portion 12 via the radiation conductor 4, the radiation conductor 4*h*, the transmission conductor 6*c*, the transmission conductor 6*a* and the radiation conductor 3*a* back to the feeding portion 12 becomes an integral multiple of the half-wavelength of the frequency f2, and the length of a loop circuit looping from the feeding portion 12 via the radiation conductor 4, the radiation conductor 4*h*, the transmission conductor 6*c*, the transmission conductor 6*a* and the radiation conductor 5*a* back to the feeding portion 12 becomes an integral multiple of the half-wavelength of the frequency f2. Further, the M-shaped antenna element 2*b* is set so that the length of a loop circuit looping from the feeding portion 12 via the radiation conductor 4, the radiation conductor 4*h*, the transmission conductor 6*d*, the transmission conductor 6*b* and the radiation conductor 3*b* back to the feeding portion 12 becomes an integral multiple of the half-wavelength of the frequency f3, and the length of a loop circuit looping from the feeding portion 12 via the radiation conductor 4, the radiation conductor 4*h*, the transmission conductor 6*d*, the transmission conductor 6*b* and the radiation conductor 5*b* back to the feeding portion 12 becomes an integral multiple of the half-wavelength of the frequency f3.

The M-shaped antenna apparatus constructed as above can operate at the three resonance frequencies f1, f2 and f3 provided. Moreover, the M-shaped antenna apparatus has an asymmetrical directivity characteristic since it has an asymmetrical structure with respect to the Y-Z plane. Furthermore, by extending the height from the feeding portion 12 to the transmission conductors 6*a* and 6*b* using not only the radiation conductor 4 but also the radiation conductor 4*h* in the M-shaped antenna elements 2 and 2*b*, the impedances of the M-shaped antenna elements 2 and 2*b* when seeing from the feeding portion 12 to the M-shaped antenna elements 2 and 2*b* can be increased, and impedance matching can be achieved so that the input impedances of the M-shaped antenna elements 2 and 2*b* coincide with the impedance of the transmission line connected to the feeding portion 12 without using the matching conductor 8 of FIG. 15 or the like.

Other Modified Preferred Embodiments

The connection points P1, P2 and P3 are located in the center portions of the respective transmission conductors in the aforementioned preferred embodiments. However, the present invention is not limited to this, and the connection points may be located in the approximate center portions, or the substantial center portions. Otherwise, the connection points may each be located in the middle portion, or an arbitrary position located between the one end and the other end of each transmission conductor. The connection points P5 and P6 are located in the positions slightly shifted from the center portions of the respective transmission conductors. However, the present invention is not limited to this, and the connection points may each be located in the center portion, the approximate center portion or the middle portion of each transmission conductor.

The lengths of the transmission conductor 6*c* and the transmission conductor 6*d* are set so as to be equal to each other in the sixth to fourteenth preferred embodiments. However, the present invention is not limited to this, and the lengths of the transmission conductor 6*c* and the transmission conductor 6*d* may be set so as to be different from each other.

The plurality of M-shaped antenna elements 1, 2 and 2*b* are parallel to, for example, a plane such as the Y-Z plane and formed on planes different from each other in the sixth to fourteenth preferred embodiments. However, the present invention is not limited to this, and a plurality of M-shaped antennas of a plurality of M-shaped antennas may be formed on an identical plane. In other words, the M-shaped antenna apparatuses of the first to fourth preferred embodiments may be combined with the M-shaped antenna apparatuses of the sixth to fourteenth preferred embodiments.

The M-shaped antenna apparatuses provided with two or three M-shaped antennas have been described in connection with the aforementioned preferred embodiments. However, the present invention is not limited to this, and it is acceptable to construct an M-shaped antenna apparatus provided with a plurality of, or two or more M-shaped antennas.

Advantageous Effects of Preferred Embodiments

According to the preferred embodiments of the present invention, there can be easily provided an antenna apparatus, which has two or more resonance frequencies with a simple structure and is capable of obtaining a bilateral directivity characteristic.

Moreover, according to the preferred embodiments of the present invention, there can be easily provided an antenna apparatus, which has three or more resonance frequencies with a simple structure and is able to obtain a symmetrical or asymmetrical bilateral directivity characteristic.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An M-shaped antenna apparatus comprising at least two M-shaped antenna elements, a grounding conductor, and a feeding portion, said at least two M-shaped antenna elements including first and second M-shaped antenna elements respectively having first and second resonance frequencies different from each other, wherein said first M-shaped antenna element comprises:

a first transmission conductor;

a first radiation conductor connected between one end of said first transmission conductor and said grounding conductor;

a second radiation conductor connected between a middle portion of said first transmission conductor and said feeding portion; and a third radiation conductor connected between the other end of said first transmission conductor and said grounding conductor, and wherein said second M-shaped antenna element comprises:

a second transmission conductor;

a fourth radiation conductor connected between one end of said second transmission conductor and said grounding conductor;

a fifth radiation conductor connected between a middle portion of said second transmission conductor and said feeding portion; and a sixth radiation conductor connected between the other end of said second transmission conductor and said grounding conductor.

2. The M-shaped antenna apparatus as claimed in claim 1, wherein said fifth radiation conductor shares at least a part of said second radiation conductor.

3. The M-shaped antenna apparatus as claimed in claim 2, wherein said fifth radiation conductor shares a part of said first transmission conductor.

4. The M-shaped antenna apparatus as claimed in claim 1, further comprising at least one matching conductor, which has one end grounded and adjusts an input impedance of said M-shaped antenna apparatus.

5. The M-shaped antenna apparatus as claimed in claim 4, wherein the other end of at least one matching conductor out of said matching conductors is electrically connected to one of said radiation conductor and said transmission conductor.

6. The M-shaped antenna apparatus as claimed in claim 1, further comprising at least one directivity characteristic control conductor, which has one end grounded and changes a directivity characteristic of said M-shaped antenna apparatus.

7. The M-shaped antenna apparatus as claimed in claim 1, wherein at least one of said first and second transmission conductors further comprises an additional conductor section for changing the width thereof.

8. The M-shaped antenna apparatus as claimed in claim 1, wherein a space including at least a part of said M-shaped antenna element is filled with a dielectric body so as to oppose said grounding conductor.

9. The M-shaped antenna apparatus as claimed in claim 1, wherein said grounding conductor and at least one of said transmission conductors are each formed of a conductor pattern on a dielectric substrate, and at least one of said radiation conductors is formed of a through hole conductor formed in the dielectric substrate.

10. The M-shaped antenna apparatus as claimed in claim 1, wherein said at least two M-shaped antenna elements are formed on an identical plane.

11. The M-shaped antenna apparatus as claimed in claim 1, wherein said at least two M-shaped antenna elements are formed on planes different from each other.

12. The M-shaped antenna apparatus as claimed in claim 1, wherein said grounding conductor has a circular shape.

13. An M-shaped antenna apparatus comprising at least three M-shaped antenna elements, a grounding conductor, and a feeding portion, said at least three M-shaped antenna elements including first, second and third M-shaped antenna elements having first, second and third resonance frequencies, respectively, wherein said first M-shaped antenna element comprises:

a first transmission conductor;

a first radiation conductor connected between one end of said first transmission conductor and said grounding conductor;

a second radiation conductor connected between a middle portion of said first transmission conductor and said feeding portion; and a third radiation conductor connected between the other end of said first transmission conductor and said grounding conductor, wherein said second M-shaped antenna element comprises:

a second transmission conductor;

a fourth radiation conductor connected between one end of said second transmission conductor and said grounding conductor;

a fifth radiation conductor connected between a middle portion of said second transmission conductor and said feeding portion; and a sixth radiation conductor connected between the other end of said second transmission conductor and said grounding conductor, wherein said third M-shaped antenna element comprises:

a third transmission conductor; a seventh radiation conductor connected between one end of said third transmission conductor and said grounding conductor;

an eighth radiation conductor connected between a middle portion of said third transmission conductor and said feeding portion; and a ninth radiation conductor connected between the other end of said third transmission conductor and said grounding conductor, wherein said at least three M-shaped antenna elements are formed on planes different from each other, and wherein at least two of said first, second and third resonance frequencies are different from each other.

14. The M-shaped antenna apparatus as claimed in claim 13, wherein said at least three M-shaped antenna elements are formed so as to be parallel to each other, wherein a length of each of said first, second and third radiation conductors, a length of each of said fourth and sixth radiation conductors and a length of each of said seventh and ninth radiation conductors are set so as to be equal to each other, wherein said fifth radiation conductor shares at least a part of said second radiation conductor, and said eighth radiation conductor shares at least a part of said second radiation conductor, and wherein said antenna apparatus further comprises:

a fourth transmission conductor for connecting a middle portion of said first transmission conductor with a middle portion of said second transmission conductor; and a fifth transmission conductor for connecting a middle portion of said first transmission conductor with a middle portion of said third transmission conductor.

15. The M-shaped antenna apparatus as claimed in claim 14, wherein a length of said fourth transmission conductor and a length of said fifth transmission conductor are set so as to be equal to each other, and wherein lengths of said first, second and third transmission conductors are set so as to be equal to each other.

16. The M-shaped antenna apparatus as claimed in claim 14, wherein a length of said fourth transmission conductor and a length of said fifth transmission conductor are set so as to be equal to each other, and wherein at least two of lengths of said first, second and third transmission conductors are set so as to be different from each other.

17. The M-shaped antenna apparatus as claimed in claim 14, wherein a length of said fourth transmission conductor and a length of said fifth transmission conductor are set so as to be different from each other, and wherein lengths of said first, second and third transmission conductors are set so as to be equal to each other.

18. The M-shaped antenna apparatus as claimed in claim 13, wherein said at least three M-shaped antenna elements are formed so as to be parallel to each other, wherein a length of each of said fourth and sixth radiation conductors and a length of each of said seventh and ninth radiation conductors are set so as to be equal to each other, wherein said fifth radiation conductor shares at least a part of said second radiation conductor, said eighth radiation conductor shares at least a part of said second radiation conductor, and wherein said antenna apparatus further comprises:

a fourth transmission conductor for connecting a middle portion of said second radiation conductor with a middle portion of said second transmission conductor; and a fifth transmission conductor for connecting a middle portion of said second radiation conductor with a middle portion of said third transmission conductor.

19. The M-shaped antenna apparatus as claimed in claim 18, wherein a length of said fourth transmission conductor and a length of said fifth transmission conductor are set so as to be equal to each other, and wherein at least two of lengths of said first, second and third transmission conductors are set so as to be different from each other.

20. The M-shaped antenna apparatus as claimed in claim 13, wherein said at least three M-shaped antenna elements are formed so as to be parallel to each other, wherein a length of each of said fourth and sixth radiation conductors and a length of each of said seventh and ninth radiation conductors are set so as to be equal to each other, wherein said fifth radiation conductor shares said second radiation conductor and a tenth radiation conductor whose one end is connected to said second radiation conductor, and said eighth radiation conductor shares said second radiation conductor and said tenth radiation conductor, and wherein said antenna apparatus further comprises:

a fourth transmission conductor for connecting the other end of said tenth radiation conductor with a middle portion of said second transmission conductor; and a fifth transmission conductor for connecting the other end of said tenth radiation conductor with a middle portion of said third transmission conductor.

21. The M-shaped antenna apparatus as claimed in claim 20, wherein a length of said fourth transmission conductor and a length of said fifth transmission conductor are set so as to be equal to each other, and wherein at least two of lengths of said first, second and third transmission conductors are set so as to be different from each other.

22. The M-shaped antenna apparatus as claimed in claim 13, wherein said grounding conductor has a circular shape.

* * * * *